US007409183B2

(12) United States Patent
Tateishi et al.

(10) Patent No.: US 7,409,183 B2
(45) Date of Patent: Aug. 5, 2008

(54) RELEASING AGENT APPLYING MECHANISM, FIXING DEVICE, AND PRINTING APPARATUS

(75) Inventors: Yoshinobu Tateishi, Shiki-gun (JP); Toshiya Mikita, Yao (JP); Yasunori Minakuchi, Shiki-gun (JP); Masaru Tsuji, Nara (JP); Atsushi Ide, Nara (JP); Osamu Fujimoto, Yamatokoriyama (JP); Kazuhiro Matsuyama, Ikoma (JP); Toshio Yamanaka, Yao (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 86 days.

(21) Appl. No.: 11/004,851

(22) Filed: Dec. 7, 2004

(65) Prior Publication Data

US 2005/0123327 A1 Jun. 9, 2005

(30) Foreign Application Priority Data

Dec. 8, 2003 (JP) ..... 2003-409627
Dec. 8, 2003 (JP) ..... 2003-409628
Dec. 8, 2003 (JP) ..... 2003-409630

(51) Int. Cl.
*G03G 15/20* (2006.01)

(52) U.S. Cl. ..... 399/325

(58) Field of Classification Search ..... 399/324, 399/325; 219/216; 118/60, DIG. 1
See application file for complete search history.

(56) References Cited

U.S. PATENT DOCUMENTS 5,881,348 A * 3/1999 Onodera et al. ..... 399/325
6,032,016 A * 2/2000 Morigami et al. ..... 399/325
6,463,249 B2 * 10/2002 Mikita ..... 399/324
6,591,081 B2 * 7/2003 Hasegawa ..... 399/324
7,106,998 B2 * 9/2006 Tateishi et al. ..... 399/325
2003/0223788 A1 12/2003 Tateishi

FOREIGN PATENT DOCUMENTS

JP 7-210025 A 8/1995
JP 8-137317 A 5/1996
JP 11095592 A * 4/1999
JP 11-305584 A 11/1999
JP 2000-56610 A 2/2000
JP 2000122454 A * 4/2000
JP 2002-278345 A 9/2002
JP 2003-122167 A 4/2003

* cited by examiner

*Primary Examiner*—Robert Beatty
(74) *Attorney, Agent, or Firm*—Birch Stewart Kolasch & Birch, LLP

(57) ABSTRACT

In the present applying mechanism, a part of a guide sheet 33 bulges (arches) away from an oil application roller 16, with respect to a vertical line S passing through the center of a pipe 31. In other words, in the present applying mechanism, a part of the guide sheet 33 has a shape of avoiding (bypassing) the oil application roller 16 that has a high temperature. With this, oil flowing on the guide sheet 33 is kept away from the high-temperature oil application roller 16. The present applying mechanism can include an edge 50, or gap, in the guide sheet 33 for backing-up flow of oil to before the application roller in order to ensure even distribution of the oil to the application roller. The present applying mechanism can include a narrow gap between the pipe 31 and guide sheet 33.

34 Claims, 25 Drawing Sheets

RELEASING AGENT APPLYING MECHANISM, FIXING DEVICE, AND PRINTING APPARATUS

This Nonprovisional application claims priority under 35 U.S.C. § 119(a) on Patent Application No. 2003-409627 filed in Japan on Dec. 8, 2003, Patent Application No. 2003-409628 filed in Japan on Dec. 8, 2003, and Patent Application No. 2003-409630 filed in Japan on Dec. 8, 2003, the entire contents of which are hereby incorporated by reference.

FIELD OF THE INVENTION

The present invention relates to a releasing agent applying mechanism for applying a releasing agent such as oil to a fixing roller of a printing apparatus.

BACKGROUND OF THE INVENTION

Printing apparatuses such as photocopiers and printers typically have a fixing device for fixing a transferred toner image to a printer sheet.

Such a fixing device performs the image fixation by thermo-compressing a printer sheet on which an image is transferred, using a fixing roller (a pair of rollers).

In the fixing device, a releasing agent such as silicone oil is supplied (applied) to the surface of the fixing roller. This is performed to prevent the image from being transferred to the fixing roller (i.e. offset of the image) and to prevent the printer sheet from being entangled with the fixing roller, in order to stably perform the image fixation.

The aforesaid application of oil is described in the patent documents 1 through 3. (patent document 1: Japanese Laid-Open Patent Application No. 8-137317/1996 (Tokukaihei 8-137317; published on May 31, 1996); patent document 2: Japanese Laid-Open Patent Application No. 2002-278345 (Tokukai 2002-278345; published on Sep. 27, 2002); patent document 3: Japanese Laid-Open Patent Application No. 2003-122167 (Tokukai 2003-122167; published on Apr. 25, 2003))

FIGS. 24 and 25 illustrate a conventional art of applying oil to a fixing roller, described in the patent documents 2 and 3.

As shown in these figures, according to the conventional art, oil is sucked up from an oil tank 104 that always store the oil to a pipe-shaped member 105 and to which oil can be injected from the outside, by a piezo pump (or electromagnetic pump) 103 located above the oil tank 104, and consequently the oil is supplied to a pipe-shaped member 101.

On the upper side of this pipe-shaped member 101, a plurality of holes (oil excretory holes) are made along the longitudinal direction. On the lower side of the pipe-shaped member 101, there are (i) a felt 106 for collecting the oil showering down thereon from the pipe-shaped member 101 and (ii) an application roller 107 for applying the oil in the felt (releasing agent supplying felt) 106 to the fixing roller (application target member) 102.

The lowest stream (tip) of the pipe-shaped member 101 has been subjected to a process of preventing the oil leakage (e.g. a caulking process by which the tip is caulked by stamping and the like). With this, the oil does not leak except from the aforesaid holes.

The redundant oil not applied to the fixing roller 102 and still remaining in the felt 106 is collected by a concave oil pan (releasing agent collecting pan) 108 provided below the felt 106. The oil then returns to the oil tank 104 though a tube-shaped member 109 connected to the oil pan 108.

In the oil tank 104, a sensor 110 for detecting the remaining amount of the oil is provided. This sensor 110 detects the amount of the oil remaining in the tank, and transmits the result of the detection to a control section of the printing apparatus.

With this, when the remaining amount of the oil is small, a display panel and the like on the main body of the printing apparatus prompts the user to supply oil, or the printing by the printing apparatus is temporarily brought to a halt.

When the oil supply is insufficient at some parts of the fixing roller 102 in the longitudinal direction, the aforesaid offset of the image and the entanglement of the printer sheet occur. To prevent them, it is very important to evenly supply the oil (i.e. balance an amount of the supplied oil) along the longitudinal direction of the fixing roller 102.

For this reason, according the conventional art, all holes of the pipe-shaped member 101 face upward (i.e. made on the upper side of the pipe-shaped member 101). This allows the oil to be simultaneously discharged from all holes, when the printing apparatus is horizontally provided (i.e. in a normal state).

In the aforesaid conventional art, only the felt and the application roller are provided as intermediate members that are provided between the pipe and the fixing roller and spread the oil in the longitudinal direction.

For this reason, the oil may not be sufficiently spread and the oil application may not be evenly done in the longitudinal direction, when the oil has a relatively high viscosity.

To solve this problem, the patent documents 2 and 3teach that a guide member is attached to the pipe-shaped member 101, thereby achieving the evenness.

However, according to these conventional arts teaching that the guide member is provided for spreading the oil, the guide member is provided in the vicinity of the application roller touching the fixing roller. On this account, the oil flowing on the guiding member may be deteriorated by the heat from the application roller.

Also, according to these conventional arts teaching that the guide member is provided for spreading the oil, the spreading of the oil is performed solely by the capillary phenomenon of the felt. On this account, there is still a possibility that the oil is not sufficiently spread and not evenly applied in the longitudinal direction.

Furthermore, in the conventional arts where the oil discharged from the pipe permeates a guide part (felt) so that the spreading of the oil is performed, the guide part is closely in touch with the pipe. For this reason, the oil spreading along the longitudinal direction of the pipe solely depends on the capillary phenomenon of the guide section, so that the oil spreading cannot be evenly performed.

SUMMARY OF THE INVENTION

The present invention was done to solve the above-identified problem, and an objective of the present invention is to provide a releasing agent applying mechanism that can prevent a releasing agent from degrading by heat.

Another objective of the present invention is to provide a releasing agent applying mechanism that can evenly apply oil to a fixing roller.

To achieve these objectives, a releasing agent applying mechanism (present applying mechanism) of the present invention applies a releasing agent to a fixing roller of a printing apparatus, the releasing agent being discharged from a plurality of holes made on a pipe extending along the fixing roller, and to a releasing agent application roller that is in touch with the fixing roller so as to rotate, the releasing agent discharged from the pipe being supplied via a releasing agent guide, the releasing agent applying mechanism comprising an applying member that applies the releasing agent to the releasing agent application roller from below, the pipe being provided above the releasing agent application roller, the releasing agent guide being designed so as to supply, to the applying member, the releasing agent discharged from the pipe, and the releasing agent applying member being characterized in that a part of the releasing agent guide bulges away from the releasing agent application roller, with respect to a vertical line passing through a center of the pipe.

The present applying mechanism applies a releasing agent to a fixing roller of a printing apparatus such as a photocopier and a printer.

The fixing roller fixes an image on a piece of paper by compressing a printer sheet to which an image has been transferred.

The releasing agent is applied to the fixing roller, in order to prevent the image from being transferred to the fixing roller (i.e. offset of the image) and to prevent the printer sheet from being entangled with the fixing roller. Examples of such a releasing agent includes silicone oil.

As described above, the present applying mechanism has a hollow pipe extending along the fixing roller. This pipe has a plurality of holes and the releasing agent is discharged from these holes.

The present applying mechanism is provided with a releasing agent application roller.

This releasing agent application roller is provided below the pipe and along the fixing roller. The releasing agent application roller is in touch with the fixing roller so as to rotate. By this releasing agent application roller, the releasing agent discharged from the pipe and supplied to the releasing agent application roller is applied to the fixing roller.

The present applying mechanism is further provided with a releasing agent guide (guide member) and an applying member, in order to supply the releasing agent discharged from the pipe to the releasing agent application roller.

This applying member applies the releasing agent to the releasing agent application roller from below.

The releasing agent guide supplies the releasing agent discharged from the pipe to the applying member.

In the present applying mechanism, the releasing agent connects the pipe above the releasing agent application roller with the applying member below the releasing agent application roller. By this releasing agent guide, the releasing agent is carried from the pipe to the applying member.

Note that, the aforesaid "above" and "below" indicate positions in a vertical direction, and do not specify positions in a horizontal direction. For this reason, the positions of the pipe, the releasing agent application roller, and the applying member in the horizontal direction may be differently arranged.

The aforesaid "below (above) the releasing agent application roller" indicates an area below (above) the center of the releasing agent application roller.

It is particularly noted in the present applying mechanism that a part of the releasing agent guide bulges (arches) away from the releasing agent application roller, with respect to the vertical line passing through the center of the pipe.

This vertical line passing through the center of the pipe is a virtual straight line vertically going down from the center of the pipe.

In the present applying mechanism, in other words a part of the releasing agent guide is formed so as to avoid (bypass) the releasing agent application roller that has a high temperature.

With this, in the present applying mechanism, the releasing agent flowing on the releasing agent guide can be kept away from the high-temperature releasing agent application roller.

On this account, the present applying mechanism can restrain the degradation of the releasing agent on the releasing agent guide on account of the heat from the application roller.

By providing the present applying mechanism to a fixing device of a printing apparatus, a fixing device that can restrain the degradation of the releasing agent by heat can be realized.

To achieve the aforesaid objectives, a releasing agent applying mechanism (present applying mechanism) of the present invention applies a releasing agent to a fixing roller of a printing apparatus, the releasing agent being discharged from a plurality of holes made on a pipe extending along the fixing roller, and towards a releasing agent application roller that is in touch with the fixing roller so as to rotate, the releasing agent discharged from the pipe being supplied via a releasing agent guide, the releasing agent applying mechanism being characterized in that the releasing agent guide has a releasing agent storage that extends along a longitudinal direction of the pipe and is provided on releasing agent supplying paths on the releasing agent guide.

The present applying mechanism is provided with a releasing agent application roller.

This releasing agent application roller is provided along the fixing roller. The releasing agent application roller is in touch with the fixing roller so as to rotate. By this releasing agent application roller, the releasing agent discharged from the pipe and supplied to the releasing agent application roller is applied to the fixing roller.

It is particularly noted in the present applying mechanism that the releasing agent guide has a releasing agent storage that extends along a longitudinal direction of the pipe and is provided on releasing agent supplying paths on the releasing agent guide.

This releasing agent storage temporarily stops the flow of the releasing agent towards the releasing agent application roller, by storing the releasing agent on the releasing agent guide.

The releasing agent supplying paths are paths of the releasing agent flowing, on the releasing agent guide, towards the releasing agent application roller.

In the present applying mechanism, the releasing agent discharged from the pipe flows through the releasing agent supplying paths on the releasing agent guide, and is stored in the releasing agent storage on the releasing agent guide. In this releasing agent storage, the releasing agent evenly spreads along the longitudinal direction of the releasing agent storage (i.e. along the longitudinal direction of the pipe, the releasing agent application roller, and the fixing roller).

In the present applying mechanism, the releasing agent spilling over from the releasing agent storage is carried towards the releasing agent application roller. With this, the releasing agent spread in the releasing agent storage and along the longitudinal direction of the pipe can be carried towards the releasing agent application roller.

As described above, in the present applying mechanism, the releasing agent spreads on the releasing agent guide and along the longitudinal direction of the pipe, and then the releasing agent is carried towards the releasing agent application roller. On this account, the releasing agent discharged from the pipe can be supplied to the whole length (entirety) of the releasing agent application roller. It is therefore possible to extremely evenly apply the releasing agent to the entirety of the fixing roller (i.e. the amount of the applied oil is balanced).

By providing the present applying mechanism to a fixing device of a printing apparatus, a fixing device that can evenly apply the releasing agent to the fixing roller can be realized.

To achieve the objectives above, a releasing agent applying mechanism (present applying mechanism) of the present invention applies a releasing agent to a fixing roller of a printing apparatus, the releasing agent being discharged from a plurality of holes made on a pipe extending along the fixing roller, and to a releasing agent application roller that is in touch with the fixing roller so as to rotate, the releasing agent discharged from the pipe being supplied via a releasing agent guide, the releasing agent guide being made of a material resistant to the releasing agent, and the releasing agent applying mechanism being characterized in that, between the releasing agent guide and the pipe, a gap that extends along a longitudinal direction of the pipe and allows surface tension to act on the releasing agent is formed.

The present applying mechanism is provided with a releasing agent application roller.

This releasing agent application roller is provided along the fixing roller. The releasing agent application roller is in touch with the fixing roller so as to rotate. By this releasing agent application roller, the releasing agent discharged from the pipe and supplied to the releasing agent application roller is applied to the fixing roller.

The present applying mechanism is further provided with a releasing agent guide (guide member), in order to supply the releasing agent discharged from the pipe to the releasing agent application roller.

The releasing agent guide is made of a material resistant to the releasing agent. This material resistant to the releasing agent indicates a material that avoids the permeation of the releasing agent (i.e. a material that does not allow the releasing agent to permeate the same).

For this reason, the releasing agent does not permeate the inside of the releasing agent guide. Thus the releasing agent guided by the releasing agent guide flows on the whole one surface (front surface; surface to which the releasing agent is guided) of the releasing agent guide, and hence a required amount of the releasing agent can be reduced because the back surface of the releasing agent guide is not used for carrying the releasing agent. Furthermore, since the releasing agent does not permeate the inside of the releasing agent guide, it is possible to increase the speed of supplying the releasing agent to the releasing agent application roller by the releasing agent guide.

When the releasing agent guide allows the releasing agent to permeate the same, the releasing agent permeates the inside of the releasing agent guide, so that the surface tension does not act on the releasing agent. Moreover, the releasing agent is delivered to the releasing agent application roller only after a sufficient amount of the releasing agent permeates the releasing agent guide. On this account, a large amount of the releasing agent is required at the time of starting (preparing for) the use of the present applying mechanism, and the preparation for the use takes time.

When the releasing-agent-resistant releasing agent guide is adopted, it is unnecessary to cause the releasing agent to permeate the releasing agent guide. For this reason, an amount of the releasing agent required for the preparation for the use can be reduced and the time for the preparation for the use can be significantly shortened.

It is particularly noted in the present applying mechanism that, with the pipe, the releasing agent guide forms a gap that extends along a longitudinal direction of the pipe and allows surface tension to act on the releasing agent is formed. In other words, the gap extending along the longitudinal direction of the pipe and allowing the surface tension to act on the releasing agent is formed between the pipe and the releasing agent guide.

Therefore, to this gap, the releasing agent spilling over from the holes of the pipe is guided, and on this occasion the releasing agent is in contact with the releasing agent guide. On this releasing agent guided to the gap, the surface tension acts. On this account, the oil can spread along the longitudinal direction of the gap (i.e. along the longitudinal direction of the pipe).

In this manner, in the present applying mechanism, the releasing agent can be supplied to the releasing agent application roller, with the releasing agent being maintained to spread along the longitudinal direction of the gap (i.e. the surface of the releasing agent having been spread along the longitudinal direction of the pipe is maintained).

On this account, the releasing agent discharged from the pipe can be supplied to the whole length (entirety) of the releasing agent application roller. It is therefore possible to extremely evenly apply the releasing agent to the entirety of the fixing roller (i.e. the amount of the applied oil is balanced).

By providing the present applying mechanism to a fixing device of a printing apparatus, it is possible to realize a fixing device which can evenly apply the oil to the fixing roller, can prevent the offset of the image, and can prevent the printer sheet from being entangled.

Note that, the width of the gap is suitably set in accordance with the type of the oil, the viscosity of the releasing agent, the material of the releasing agent guide, the amount (speed) of the releasing agent supplied from the pipe, the diameter of the pipe, and the like.

For a fuller understanding of the nature and advantages of the invention, reference should be made to the ensuing detailed description taken in conjunction with the accompanying drawings.

BRIEF DESCRIPTION OF THE DRAWINGS

FIG. 16(*b*) is a cross section of the releasing agent guide shown in FIG. 12.

FIG. 17(*b*) is a cross section of a further arrangement of the releasing agent guide in the oil applying mechanism of the embodiment of the present invention.

FIG. 17(*c*) is a cross section of yet another arrangement of the releasing agent guide in the oil applying mechanism of the embodiment of the present invention.

FIG. 19(*b*) is a cross section of the releasing agent guide shown in FIGS. 17(*a*) and 18.

FIG. 20(*b*) is a cross section of the releasing agent guide shown in FIG. 17(*b*).

FIG. 21(*b*) is a cross section of the releasing agent guide shown in FIG. 17(*c*).

FIG. 23(*b*) is a cross section of the releasing agent guide shown in FIG. 22.

DESCRIPTION OF THE EMBODIMENTS

Figure 2:
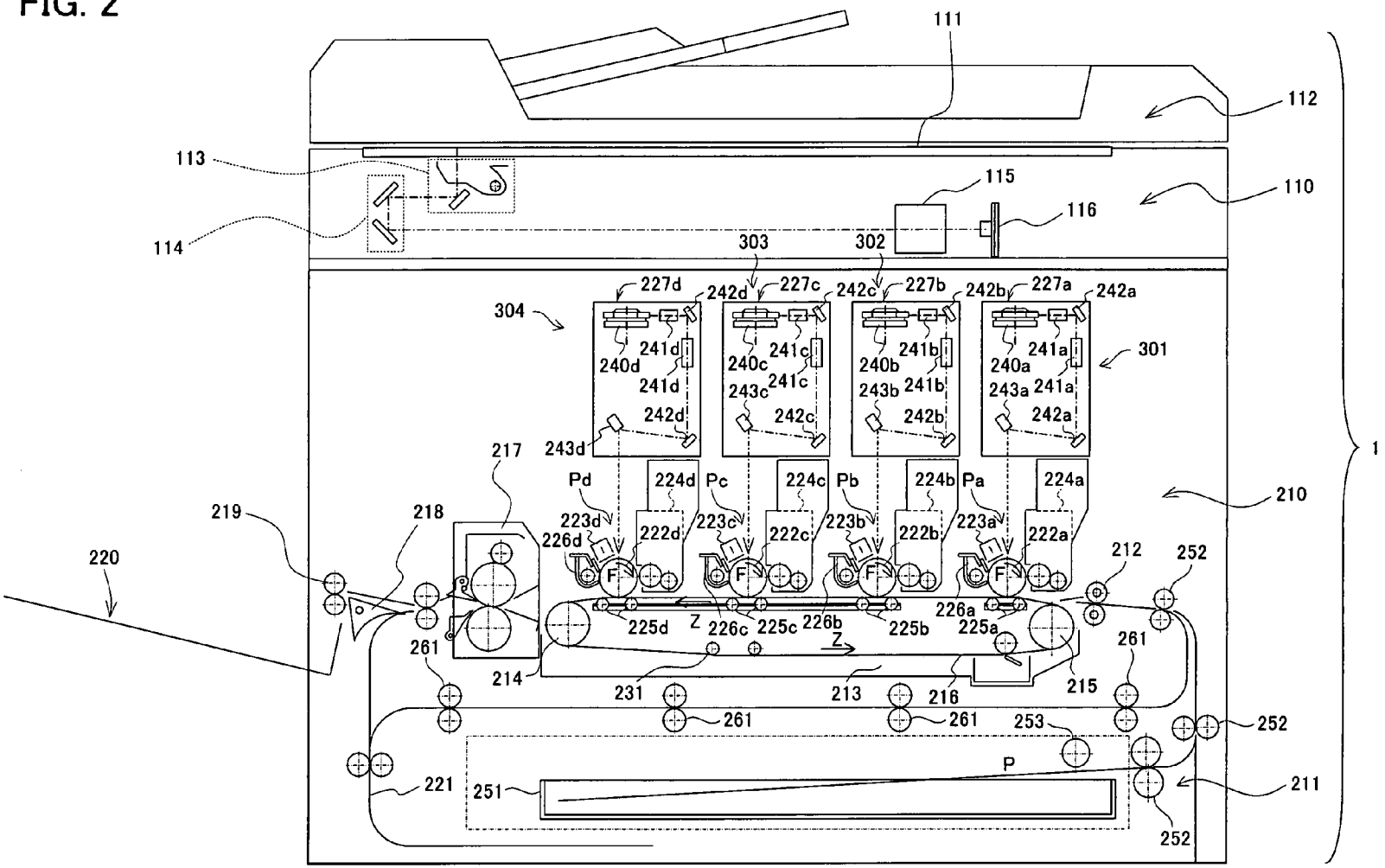
FIG. 2 illustrates a digital color photocopier including a fixing device having the oil applying mechanism shown in FIG. 1.

The following will discuss an embodiment of the present invention. FIG. 2 illustrates a photocopier 1 that is a below-mentioned digital color photocopier of the present embodiment. This photocopier 1 has a facsimile function and a printing function, in addition to a typical photocopying function.

In the first place, how the photocopier 1 is structured is illustrated. As shown in FIG. 2, the photocopier 1 includes an RADF 112, a scanning section 110, an image forming section 210, and a paper feeding mechanism 211. The photocopier 1 is further provided with an operation panel (not illustrated).

The RADF 112 is a document feeder of the photocopier 1, and functions as a reversing automatic document feeder (RADF).

That is to say, the RADF 112 feeds a document, which is set in place, to the surface of a document table 111 of the scanning section 110. After the scanning section 110 reads an image on the document, the RADF 112 feeds the document to a predetermined part for taking out the document.

The RADF 112 also has such a function of reversing the document after the image thereon is read by the scanning section 110, and feeding the document back to the document table 111. With this, the photocopier 1 allows the scanning section 110 to read images on both sides of one document.

The RADF 112 is openable with respect to the document table 111. The user keeps the RADF 112 to be closed on the occasion of using the RADF 112. Meanwhile, opening the RADF 112 allows the user to directly put a document on the document table 111.

The scanning section 110 reads an image on the document fed by the RADF 112, and is an image input device of the photocopier 1. As shown in FIG. 2, this scanning section 110 is provided with a first scanning unit 113, a second scanning unit 114, an optical lens 115, and a CCD 116, in addition to the aforesaid document table 111.

The scanning units 113 and 114 move back and forth in parallel to the document table 111, so as to read an image on a document provided on the document table 111.

The first scanning unit 113 includes: an exposure lamp for subjecting a document image to exposure; and a first mirror for deflecting, to a predetermined direction, a reflection image coming from the document. The first scanning unit 113 moves back and forth at a predetermined speed and in parallel to the document table 111, with a constant distance from the lower surface of the document table 111 being maintained.

The second scanning unit 114 has second and third mirrors that deflect, toward the optical lens 115, the reflection image having been deflected by the first mirror. The second scanning unit 114 moves back and forth in parallel to the document table 111, with a relative speed with respect to the first scanning unit 113 being kept constant.

The optical lens 115 reduces the size of the reflection image that comes from the document and has been deflected by the first to third mirrors, and the optical lens 115 causes the reflection image to be focused at a predetermined location on the CCD 116.

The CCD (Charge Coupled Device) 116 is photoelectric transfer elements (line sensors) that subject the focused reflection image to photoelectric transfer, generate image information as an electric signal, and consequently output the generated image information to the image forming section 210.

This CCD 116 can read color images. That is, from a color reflection image, the CCD 116 can generate image information of line data in which colors are separated into color components R (red), G (green) and B (blue).

The image information generated by the CCD 116 is further transferred to an image processing section (not illustrated), and subjected to a predetermined image processing. Then the image information is supplied to the image forming section 210.

The image forming section 210 prints an image on a printer sheet, in accordance with image information supplied from the CCD 116. As shown in FIG. 2, this image forming section 210 includes a black image transfer section 301, an yellow image transfer section 302, a magenta image transfer section 303, and a cyan image transfer section 304.

These transfer sections 301 through 304 are practically identical to each other. In accordance with the image information, the transfer sections 301 through 304 transfer a black image, yellow image, magenta image, and cyan image to a printer sheet.

As shown in FIG. 2, these transfer sections 301 through 304 include LSUs 227*a* through 227*d* and image forming stations Pa through Pd, respectively.

To the LSUs (Laser beam Scanner Units) 227*a* through 227*d*, respective pixel signals corresponding to the black component, yellow component, magenta component, and cyan component of the image information are supplied. In accordance with these pixel signals, the LSUs 227*a* through 227*d* perform the exposure of below-mentioned photosensitive drums 222*a* through 222*d* of the image forming stations Pa through Pd, so as to generate electrostatic latent images.

To generate a dot-shaped laser beam modulated in accordance with the image information, each of the LSUs 227*a* through 227*d* includes: a semiconductor laser diode; and a laser control section for controlling the power of the semiconductor laser diode and the timing of the light generation (both of these members are not illustrated).

As shown in FIG. 2, the LSUs 227*a* through 227*d* are further provided with polygon mirrors 240*a* through 240*d*, f-θ lenses 241*a* through 241*d*, and mirrors 242*a* through 242*d* and 243*a* through 243*d*.

Each of the polygon mirrors 240*a* through 240*d* deflects, to the main scanning direction, the laser beam emitted from the semiconductor laser element. The aforesaid f-θ lenses and mirrors are used for causing the laser beams, which have been deflected by the polygon mirrors 240*a* through 240*d*, to be focused on the respective surfaces of the photosensitive drums 222*a* through 222*d*.

In accordance with the laser beams from the LSUs 227*a* through 227*d*, the image forming stations Pa through Pd generate toner images corresponding to the respective colors, and then sequentially transfer these toner images to the printer sheet.

As shown in FIG. 2, these image forming stations Pa through Pd are provided with the respective photosensitive drums 222*a* through 222*d*, and around these photosensitive drums 222*a* through 222*d*, chargers 223*a* through 223*d*, developers 224*a* through 224*d*, dischargers 225*a* through 225*d* for transfer, and cleaners 226*a* through 226*d* are provided in the direction of the arrow F.

Each of the photosensitive drums (transfer drums) 222*a* through 222*d* is a drum-shaped transfer roller on which photosensitive materials are provided, and is driven so as to rotate in the direction of the arrow F. The chargers 223*a* through 223*d* are used for evenly charging the photosensitive drums 222*a* through 222*d*.

The developers 224*a* through 224*d* store black toner, yellow toner, magenta toner, and cyan toner, respectively. Using these toners, the developers 224*a* through 224*d* develop the electrostatic latent images formed on the respective photosensitive drums 222*a* through 222*d*, so as to generate toner images.

The dischargers 225*a* through 225*d* transfer, to the printer sheet, the toner images formed on the photosensitive drums 222*a* through 222*d*. The powers (voltages) of these dischargers 225*a* through 225*d* are controlled by a power control section (not illustrated).

The cleaners 226*a* through 226*d* shown in FIG. 2 remove the residual toners on the photosensitive drums 222*a* through 222*d*, after the transfer to the printer sheet is conducted.

The paper feeding mechanism 211 feeds the printer sheet to a predetermined position in the image forming section 210, in order to allow the color toner images generated in the image forming section to be transferred to the printer sheet. In addition, the paper feeding mechanism 211 can eject the printer sheet to the outside, after the toner images are transferred to the printer sheet.

As shown in FIG. 2, the paper feeding mechanism 211 includes a printer paper cassette 251, a drawing roller 253, carrier rollers 252 and 261, resist rollers 212, a transfer carrier belt mechanism 213, a fixing device 217, a feeding direction switching gate 218, paper ejection rollers 219, and an output tray 220.

The printer paper cassette 251 stores printer sheets P that are cut-sheets used in the photocopier 1.

The drawing roller 252 is a pickup roller for drawing the printer sheets P one by one from the printer paper cassette 251.

The carrier rollers 252 feed the printer sheet P, which has been drawn from the printer paper cassette 251, to a main carrier path L, and carry the printer sheet P through the main carrier path L.

A before-resist detection switch detects whether or not the printer sheet P carried by the carrier rollers 252 has passed through a predetermined position on the main carrier path L, and outputs a predetermined detection signal.

The resist rollers 212 temporarily keep the printer sheet P having been carried through the main carrier path L. Then in synchronism with the image forming stations Pa through Pd, the resist rollers 212 feed the printer sheet P to the transfer carrier belt mechanism 213, in such a manner as to cause the toner images on the photosensitive drums 222*a* through 222*d* to be suitably transferred to the printer sheet P.

In other words, in accordance with the detection signal from the before-resist detection switch, the resist rollers 212 feed the printer sheet P to the transfer carrier belt mechanism 213, in such a manner as to cause the edges of the respective toner images on the photosensitive drums 222*a* through 222*d* to be pressed on the edge of the print range of the printer sheet P.

As shown in FIG. 2, the transfer carrier belt mechanism 213 includes a driving roller 214, a driven roller 215, a carrier belt 216, and an auxiliary roller 231.

The carrier belt 216 is provided between the driving roller 214 and the driven roller 215, and is driven in the direction of the arrow Z by a frictional force acting between the carrier belt 216 and the rollers. The carrier belt 216 electrostatically adsorbs the printer sheet P supplied by the resist rollers 212, and feeds the printer sheet P to the image forming stations Pa through Pd and the fixing device 217.

That is to say, at the image forming stations Pa through Pd, the toner images with the respective colors are transferred to and stacked up on the printer sheet P. After the transfer by the image forming station Pd finishes, the printer sheet P is peeled off gradually from the front edge to the rear edge, from the carrier belt 216 by a static eliminator 229. The printer sheet P is then supplied to the fixing device 217.

By the fixing device 217, the toner images having been transferred to the printer sheet P but having not been fixed thereto yet are fixed to the printer sheet P by heat. After this thermal fixation, the printer sheet P is supplied to the feeding direction switching gate 218.

Note that, the fixing device 217 will be specifically described later.

By the switching gate 218, the carrier path of the printer sheet P after the fixation is selectively switched between an ejection path toward the output tray 220 and an auxiliary carrier path S.

This auxiliary carrier path S is used for reversing the printer sheet P and sending the printer sheet P back to the image forming section 210.

That is to say, the printing sheet P supplied to the auxiliary carrier path S is reversed through a switchback carrier path 221, carried through the auxiliary carrier path S by the carrier rollers 261, and consequently sent back to the image forming section 210.

Embodiment 1

The following specifically describes the fixing device 217 that is a characteristic feature of the photocopier 1 of the present embodiment.

Figure 3:
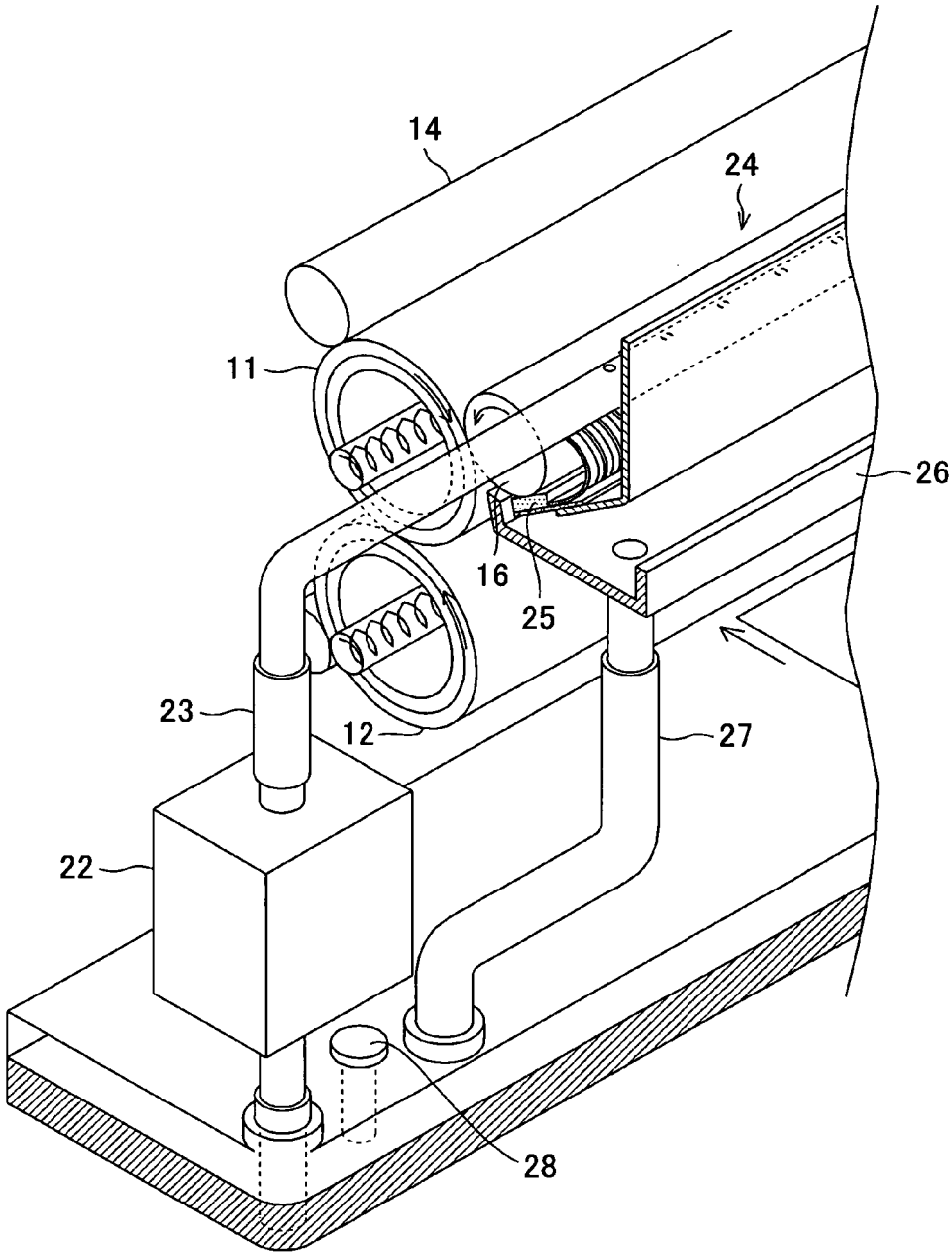
FIG. 3 is an oblique perspective view of the fixing device that is provided in the digital color photocopier shown in FIG. 2 and has the oil applying mechanism shown in FIG. 1.
Figure 4:
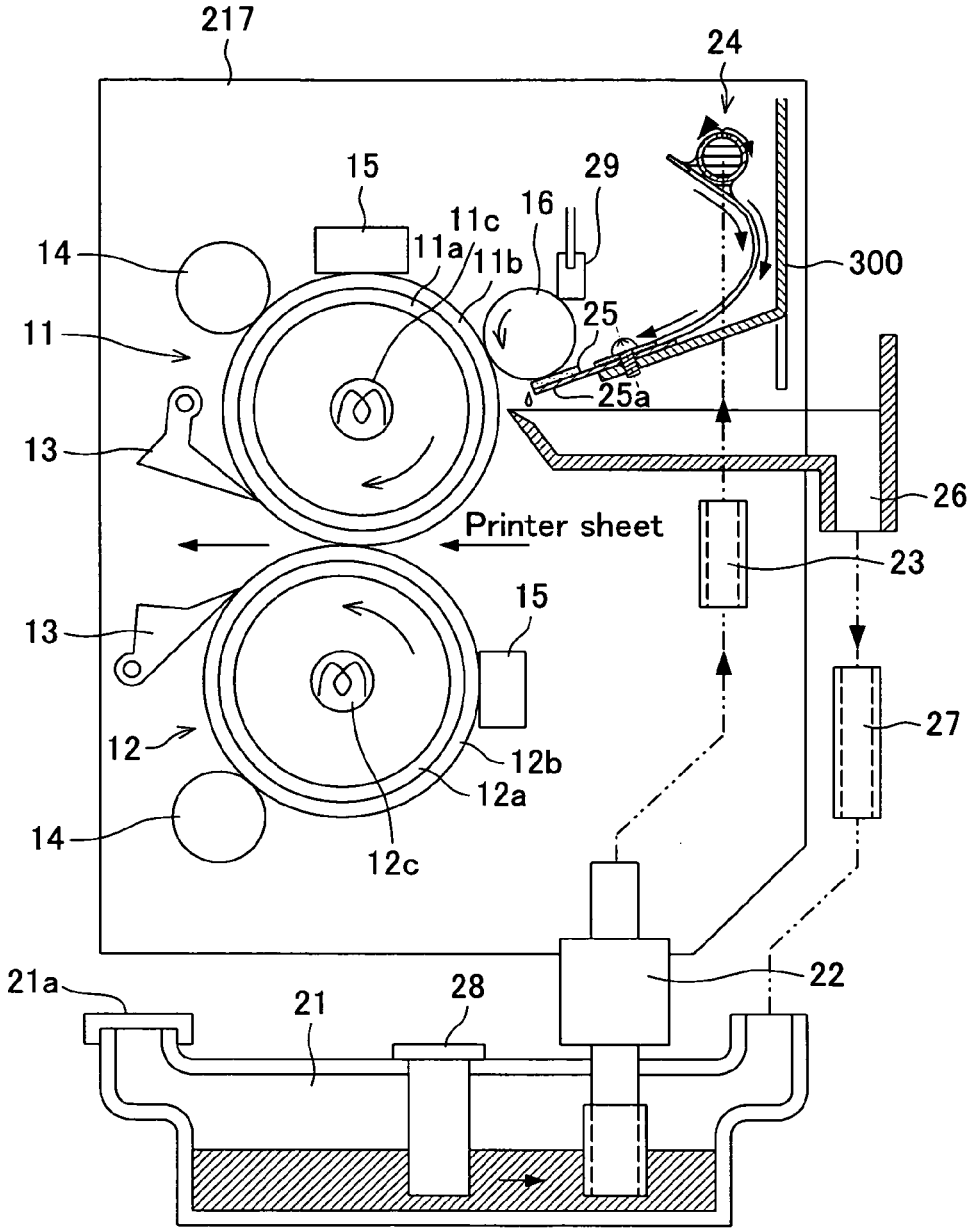
FIG. 4 is a cross section of the fixing device that is provided in the digital color photocopier shown in FIG. 2 and has the oil applying mechanism shown in FIG. 1.

FIG. 3 is an oblique perspective view of the fixing device 217. FIG. 4 is a front view of the fixing device 217.

As these figures show, the fixing device 217 includes a fixing roller pair made up of a fixing roller (upper fixing roller) 11 and a pressure roller (lower fixing roller) 12.

These rollers 11 and 12 pressurize each other. The fixing roller 11 has a rubber layer 11*b* that is provided on an aluminum shaft 11*a* and made of silicone rubber, and in the shaft 11*a*, a heater 11*c* made up of, for instance, a halogen lamp is provided. Similarly, the fixing roller 12 has a rubber layer 12*b* that is provided on an aluminum shaft 12*a* and made of silicone rubber, and in the shaft 12*a*, a heater 12*c* made up of, for instance, a halogen lamp is provided.

Note that, although the fixing roller 11 and the pressure roller 12 are both used for heating and pressuring the sheet, these rollers are termed differently for the sake of convenience.

Around each of these rollers 11 and 12, a peeling nail 13, a cleaning roller 14, and a roller temperature detector 15 are provided. The fixing roller 11 is further provided with an oil application roller 16.

The peeling nail 13 peels the printer sheet (recording member), which is entangled with the rollers 11 and 12, off from the surfaces of these rollers 11 and 12.

The cleaning roller 14 has a surface made of felt, and recovers the offset toner adhered to the surfaces of the rollers 11 and 12, by rubbing these rollers 11 and 12.

This offset toner indicates toner that has been moved to the rollers 11 and 12 from the toner images transferred to the printing sheet that will be fixed.

The roller temperature detector 15 is made up of a thermistor, and detects the temperature of the roller 11 or 12 by touching the surface thereof. The temperature detected by the roller temperature detector 15 is informed to a fixation control section (not illustrated) of the fixing device 217.

This fixation control section controls the outputs of power supply units (not illustrated) of the heaters 11*c* and 12*c*, in accordance with the results of the detections by the roller temperature detectors 15 of the respective rollers 11 and 12. That is to say, the fixation control section controls the operation of the power supply units in accordance with the detection results of the upper and lower roller temperature detectors, so as to turn ON/OFF the respective heaters in the fixing rollers and control the temperatures of the upper and lower fixing rollers.

With this, the fixation control section switches the heaters 11*c* and 12*c* of the rollers 11 and 12 to ON/OFF, so as to adjust the temperatures of the surfaces of the rollers 11 and 12.

Now, an oil applying mechanism (present applying mechanism) provided in the fixing device 217 is described below.

The present applying mechanism locates sideways and below the rollers 11 and 12, and evenly applies silicone oil (releasing agent; hereinafter, this silicone oil will be simply referred to as oil) to the surface of the fixing roller 11.

Note that the oil used in the present applying mechanism has a dimethylpolysiloxane structure and its kinetic viscosity at 25° C. is 100 cs.

As shown in FIG. 4, the present applying mechanism includes an oil tank 21, pump 22, tube-shaped member 23, pipe section 24, felt 25, oil pan 26, tube-shaped member 27, oil sensor 28, and blade 29, in addition to the aforesaid oil application roller 16.

The oil tank 21 stores the silicone oil, and has an oil feed opening 21*a* through which the oil is supplied from the outside.

The pump 22 sucks up the oil from the oil tank 21, and is made up of either a piezo pump or an electromagnetic pump.

The tube-shaped member 23 supplies, to the pipe section 24, the oil having been sucked up by the pump 22.

The pipe section 24 includes a hollow pipe that is substantially identical in length with the fixing roller 11 and that extends along the fixing roller 11 (and the oil application roller 16) in the longitudinal direction (i.e. in the direction perpendicular to the drawing in FIG. 4).

From the whole length thereof, the pipe section 24 supplies the oil to the felt 25.

The felt (applying member) 25 is a plate-shaped felt that is provided below the oil application roller 16, extends along the longitudinal direction of the fixing roller 11 and in parallel to the fixing roller 11 (and the oil application roller 16), and is substantially identical in length with the fixing roller 11. The surface of the felt 25 is on a slant to some extent under the oil application roller 16, and the felt 25 is in touch with the oil application roller 16.

The felt 25 is fully soaked with the oil supplied from the pipe section 24, and supplies the oil to the entire surface of the below-described oil application roller 16. (In other words, the felt 25 functions as an oil supplying felt.) Note that, the felt 25 is provided on a felt supporter (applying member) 25*a* that is slightly larger than the felt 25, made of metal (stainless steel plate 0.2 mm thick), and has elasticity. Because of this elasticity of the felt supporter 25*a*, the felt 25 is in touch with the oil application roller 16 in an elastic manner (i.e. the felt 25 is pressurized toward the oil application roller 16).

At a position below the center of the oil application roller 16, the felt supporter 25*a* is fixed to a steel plate 300 of the housing of the fixing device 217 (or the housing of the photocopier 1).

The surface of the oil application roller (releasing agent application roller) 16 is made of rubber. The oil application roller 16 is in touch with the fixing roller 11, extends in parallel to the fixing roller 11, and is substantially identical in length with the fixing roller 11.

This oil application roller 16 rotates in accordance with the rotation of the fixing roller 11, so as to apply the oil from the felt 25 to the surface of the fixing roller 11.

The blade 29 shown in FIG. 4 is a rubber-like member and provided for evenly smoothing out the oil on the surface of the oil application roller 16. In other words, the blade 29 causes the supplied oil to be shaped like a film. Note that, this blade 29 is omitted in FIG. 3.

By the way, a part of the oil supplied to the felt 25 drops from the felt 25, instead of being supplied to the oil application roller 16.

The oil pan 26 is a concave member for collecting such oil (redundant oil) falling from the felt 25.

The oil collected by the oil pan 26 returns to the oil tank 21 via the tube-shaped member 27.

The oil sensor 28 is provided in the oil tank 21 and detects an amount of the oil remaining in the tank 21. That is to say, the sensor 28 detects the remaining amount of the oil in the tank 21, and sends the result of the detection to the fixation control section of the fixing device 217.

With this, when the remaining amount of the oil is small, a display panel and the like on the photocopier 1 prompts the user to supply oil or the printing by the photocopier 1 is temporarily brought to a halt.

Detecting that a sufficient amount of oil is injected to the oil tank 21, the oil sensor 28 sends this result of the detection to the fixation control section. In response to this, the prompt to the user and/or the halt of the printing is/are cancelled.

Next, the pipe section 24 is discussed.

Figure 1:
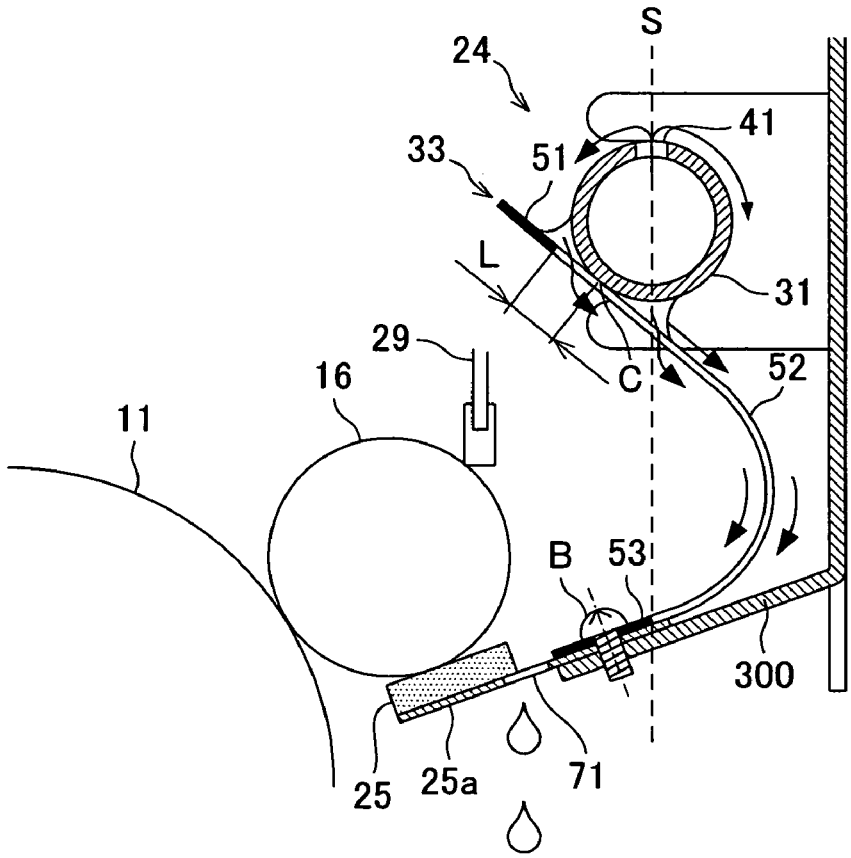
FIG. 1 is a cross section of a pipe section in an oil applying mechanism of an embodiment of the present invention.
Figure 5:
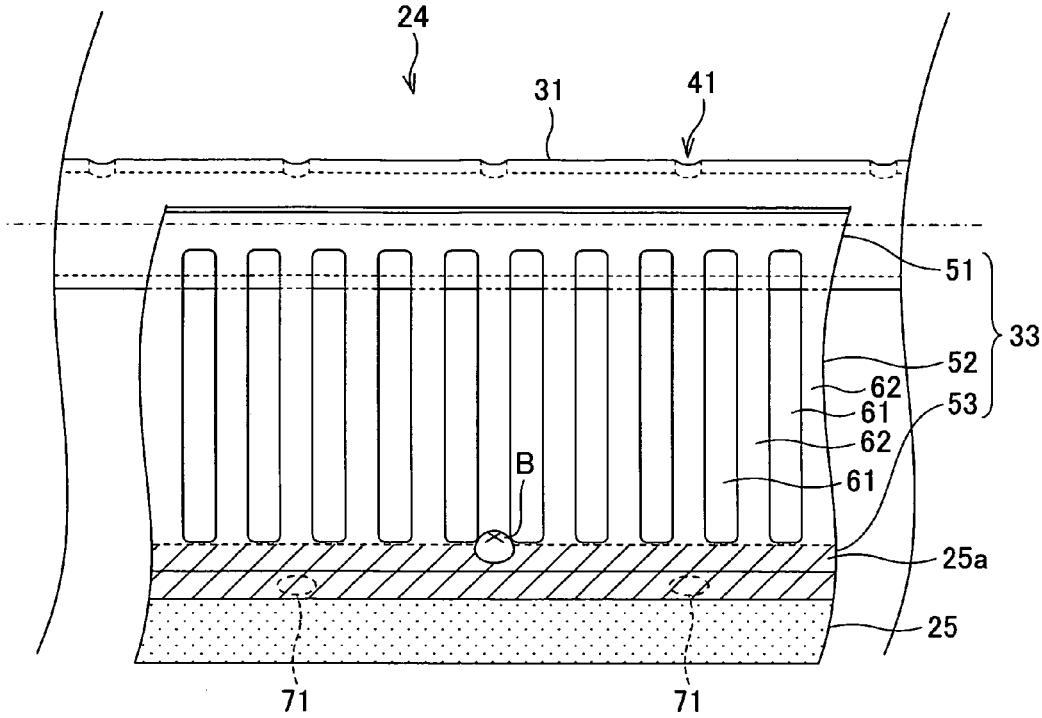
FIG. 5 is an expansion plan view of the pipe section shown in FIG. 1.

FIG. 1 is a cross section of the pipe section 24. FIG. 5 is an expansion plan view of the pipe section 24 (i.e. FIG. 5 shows a guide sheet 33 in ground plan).

As illustrated in these figures, the pipe section 24 is made up of a pipe 31 and a guide sheet 33.

The pipe 31 is a hollow member that is provided above the oil application roller 16 and has holes 41 made at predetermined intervals.

These holes 41 line up on the top side (summit) of the pipe 31, and the oil supplied to the pipe 31 is discharged from these holes.

One end of the pipe 31 is connected to the aforesaid tube-shaped member 23, so that the oil is supplied therethrough.

The other end (lowest stream) of the pipe 31 is caulked (stamped by, for instance, a pressing machine) in order to prevent the oil leakage.

With the arrangements above, all of the oil supplied to the pipe 31 is discharged through the holes 41.

The guide sheet (releasing agent guide; guiding member) 33 is a rectangular resin sheet (PET (polyethylene terephthalate) 0.1 mm thick) made up of a top portion 51, a middle portion 52, and a bottom portion 53 that are successively provided in this order. In other words, the guide sheet 33 is arranged in such a manner that the top portion 51 and the bottom portion 53 are provided on the respective edges of the middle portion 52.

It is noted that the sheet is shaped like a thin plate and made of resin, and the releasing agent can trickle down on and/or inside the sheet.

This guide sheet 33 causes the oil, which is discharged from the holes 41 of the pipe 31 above the oil application roller 16, to pass through the side of the oil application roller 16, and the guide sheet 33 guides (supplies) the oil to the felt 25 below the oil application roller 16.

As shown in FIG. 1, the guide sheet 33 is arranged in such a manner that the top portion 51 is on the pipe 31 side, while the bottom portion 53 is on the felt 25 side.

Also, in the guide sheet 33, the most part of the middle portion 52 bulges (arches) away from the oil application roller 16, with reference to a vertical line S vertically extending from the center of the pipe 31 (i.e. the center of the hole 41).

That is to say, the guide sheet 33 is arranged such that, below the center of the oil application roller 16 (and on the oil application roller 16 side with reference to the vertical line S), the bottom portion 53 is screwed to the steel plate 300 by a screw B, so as to sandwich the felt supporter 25*a* with the steel plate 300. (Note that, at the screwed part, the steel plate 300, the felt supporter 25*a*, and the bottom portion 53 are deposited in this order. Also, the bottom portion 53 is in parallel to the oil application roller 16 (and the felt 25).)

Moreover, the end of the felt supporter 25*a* crosses over the bottom portion 53 and reaches the middle portion 52.

From bottom up, the middle portion 52 steps over the vertical line S and extends away from the oil application roller 16, and is then folded back to the oil application roller 16 side. On the oil application roller 16 side with respect to the vertical line S, the middle portion 52 is obliquely in touch with the lower part of the pipe 31 above the oil application roller 16, in an elastic manner.

In other words, the guide sheet 33 is obliquely in touch with the pipe 31, and the side of the guide sheet 33 close to the felt 25 falls downward.

Note that, "close to (far from) the felt 25" indicates the length measured along the guide sheet 33, and is nothing to do with the actual length.

A contact point C between the middle portion 52 and the pipe 31 is on the oil application roller 16 side with respect to the vertical line S. At this contact point C, the middle portion 52 is in contact with the pipe 31, in an oblique manner as described above.

Note that, in the present applying mechanism, the top portion 51 of the guide sheet 33 is provided in such a manner as to avoid the contact with the pipe 31.

As shown in FIG. 5, the middle portion 52 of the guide sheet 33 has slits 61 provided at predetermined intervals.

Each of these slits 61 is a slot (opening) that is 4 mm wide, that extends along the longitudinal direction of the middle portion 52 (i.e. in the direction from the bottom portion 53 to the contact point C), and that is in parallel to each other. A space between two slits 61 is termed a guide section 62 for guiding the oil.

Note that, the width of each guide section 62 is also 4 mm.

Such slits 61 are not provided on the top portion 51 and the bottom portion 53, so that these portions 51 and 53 have flat surfaces. (In other words, a portion of the guide sheet 33 where the slits 61 are made is the middle portion 52, while portions on the both sides of the middle portion 52, where the slits 61 are not made, are the portions 51 and 53.)

Moreover, as shown in FIGS. 1 and 5, oil discharging holes 71 are made at a section between (i) a part of the felt supporter 25*a* where the felt 25 is mounted and (ii) a part sandwiched between the bottom portion 53 of the guide sheet 33 and the steel plate 300.

The oil discharging holes 71 are used for discharging the redundant oil to the oil pan 26.

Next, the following describes how the present applying mechanism performs the application of the oil onto the fixing roller 11.

The application of the oil to the fixing roller 11 is carried out in such a manner that, the pump 22 sucks up oil from the oil tank 21, and supplies the oil to the pipe section 24 via the tube-shaped member 23.

The oil supplied to the pipe section 24 is stored in the pipe 31. When the amount of the oil exceeds the capacity of the pipe 31, the oil starts to be discharged through the holes 41.

The oil discharged through the holes 41 trickles down on the outer surface of the pipe 31, and is caught by the front surface (the surface contacting the pipe 31) of the middle portion 52 of the guide sheet 33. Between the front surface of the middle portion 52 and the outer surface of the pipe 31, the oil having reached the front surface of the middle portion 52 spreads along the longitudinal direction of the pipe 31, on account of the surface tension.

Subsequently, the oil reaches the back surface (the surface on the oil application roller 16 side) of the middle portion 52, via the slits 61. The oil trickles down on both the front surface (i.e. on the guide sections 62) and the back surface of the middle portion 52 that bulges away from the oil application roller 16 with reference to the vertical line S, and the oil consequently reaches the bottom portion 53.

A part of the oil having flown on the back surface of the middle portion 52 flows on the bottom portion 53 and reaches the felt 25.

On the other hand, on the lower side of the guide sheet 33, a part of the oil having flown on the front surface of the middle portion 52 reaches the felt supporter 25*a* jutting from the bottom portion 53 towards the middle portion 52 side. Then the oil enters the back surface side of the middle portion 52 via the slits 61 (i.e. the oil appears on the back side), and consequently reaches the felt 25 via the bottom portion 53.

Then the oil soaks into the felt 25, and is applied to the surface of the fixing roller 11 by the oil application roller 16.

An amount of the oil that is supplied from the felt 25 to the oil application roller 16 and finally reaches the fixing roller 11 is about 10% of the oil arriving at the felt 25. The remaining (about 90% of) oil spills over from the felt 25, and is discharged to the oil pan 26 through the end (end part on the oil application roller 16 side) of the felt 25 and the oil discharging holes 71.

As described above, the present applying mechanism is arranged in such a manner that a part of the guide sheet 33 bulges away from the oil application roller 16 (i.e. arches away from the oil application roller 16), with respect to the vertical line S passing through the center of the pipe 31.

In other words, in the present applying mechanism, a part of the guide sheet 33 is formed so as to bypass the high-temperature oil application roller 16 (i.e. a part of the guide sheet 33 detours around the oil application roller 16).

With this arrangement, the present applying mechanism can keep the oil trickling down the guide sheet 33 away from the high-temperature application roller 16.

For this reason, according to the present applying mechanism, it is possible to restrain the deterioration of the oil trickling down the guide sheet 33, the deterioration being caused by the heat of the application roller.

Note that, the temperature of the surface of the fixing roller 11 that heats the printer sheet is kept at 180° C., when the temperature control is properly carried out. (the surface may reach about 200° C. when a trouble occurs.) The surface temperature of the oil application roller 16 contacting the aforesaid high-temperature fixing roller 11 is about 150° C.

On the other hand, the temperature of the atmosphere around the pipe 31 is typically at about 100° C. This temperature is significantly lower than the temperature of the oil application roller 16.

On this account, in the present applying mechanism, it is possible to keep the temperature, to which the oil is exposed during the trickling down from the guide sheet 33 to the felt 25, to be about 100° C., by adopting the guide sheet 33 that is shaped so as to bypass the oil application roller 16.

Furthermore, in the present applying mechanism, the bottom portion 53 of the guide sheet 33 is fixed to the felt supporter 25*a* (steel plate 300), and from this point of fixation, the guide sheet 33 extends away from the oil application roller 16, with respect to the vertical line S. Then the guide sheet 33 is folded back and crosses over the vertical line S, and consequently touches the lower part of the pipe 31.

In short, in the present applying mechanism, the guide sheet 33 is in touch with the pipe 31. On this account, at the contact point (line) between the pipe 31 and the guide sheet 33, the oil discharged from the pipe 31 spreads along the longitudinal direction (the direction of the extension of the pipe 31) due to surface tension, and then the oil is carried to the felt 25.

The oil discharged from the pipe 31 is therefore supplied to the whole length (i.e. entirety) of the felt 25 (and the oil application roller 16). This makes it possible to apply the oil to the entirety of the fixing roller 11, in a highly even manner (i.e. the amount of the applied oil is balanced).

In the present arrangement, the guide sheet 33 is provided with the slits 61 extending from the fixed bottom portion 53 and towards the contact point with the pipe 31.

This allows the oil discharged from the pipe 31 to reach the back surface side of the guide sheet 33, via the slits 61, so that the oil is supplied to the felt 25 via the both surfaces of the guide sheet 33. On this account, the speed of supplying the oil is increased.

According to the present applying mechanism, the middle portion 52 of the guide sheet 33 is in touch with the pipe 31, while the top portion 51 is provided so as to avoid the contact with the pipe 31.

This is because, if the pipe 31 is in touch with the top portion 51 where the slits 61 are not formed, the oil spilling from the holes 41 to the oil application roller 16 side (the side away from the felt 25) mounts up between the pipe 31 and the top portion 51, and consequently drips from the both ends of the top portion 51 in the longitudinal direction.

That is to say, when the middle portion 52 is in touch with the pipe 31, the oil spilling from the holes 41 to the oil application roller 16 side is allowed to reach the back surface side via the slits 61 of the middle portion 52, and then arrive at the felt 25, through the guide sections 62.

According to the present applying mechanism, the guide sheet 33 in touch with the pipe 31 is on the slant with respect to the pipe 31, and the side of the guide sheet 33 close to the felt 25 falls downward.

In this arrangement, around the contact point C, the guide sheet 33 ascends toward the side away from the felt 25.

For this reason, the oil falls on the guide sheet 33 on the side close to the felt 25 directly flows toward the felt 25. At the same time, the oil falls on the guide sheet 33 on the side away from the felt 25 does not flow in the direction far from the felt 25 (in the direction away from the felt 25 on the guide sheet 33).

Moreover, in the present applying mechanism, the guide sheet 33 is caused to be in touch with the pipe 31, on account of the elasticity of the sheet itself. It is therefore unnecessary to adhere the guide sheet 33 to the pipe 31 using, for instance, an adhesive. This makes it easy to assemble the present applying mechanism.

Furthermore, it is possible to avoid the partial decrease of the spreadability (evenness) of the supplied oil because of the irregularity of the adhered parts (i.e. some parts are adhered while other are not). (The spreadability decreases if there is a part that is not properly adhered).

Also, it is possible to avoid the guide sheet 33 to be torn away from the pipe 31 due to the decrease of the adhesive property, during the use of the present applying mechanism. Furthermore, with the arrangement above, the guide sheet 33 can be easily replaced.

In the present applying mechanism, the rigidity of the guide sheet 33 is low (i.e. the guide sheet 33 has elasticity). Thus, utilizing the elasticity of the guide sheet 33, the bottom portion 53 of the guide sheet 33 can be screwed to the steel plate 300 in such a manner as to pressurize the guide sheet 33 onto the pipe 31. This further makes it easy to assemble the present applying mechanism.

In the present applying mechanism, the felt supporter 25*a* has discharging holes 71, so that the redundant oil can be channeled off to the oil pan 26.

Note that, when the felt 25 includes a lot of oil, the evenness of the oil applied to the oil application roller 16 is liable to deterioration. On this account, it is preferable that the oil discharging holes be provided and the redundant oil be collected by the oil pan 26.

In the present embodiment, the pipe 31 is provided above the oil application roller 16.

The pipe 31 may be provided either (i) over the oil application roller 16 (i.e. the bottom end of the pipe 31 is over the top end of the oil application roller 16) or (ii) partially above the oil application roller 16 (i.e. the center of the pipe 31 is above the center of the oil application roller 16).

In the present embodiment, the felt 25 is provided below the oil application roller 16. This indicates that the contact point between the felt 25 and the oil application roller 16 locates below the center of the oil application roller 16.

In the present embodiment, the guide sheet 33 is made of PET 0.1 mm thick.

It is not preferable to set the thickness of the guide sheet 33 to be excessively thin, because the guide sheet 33 is easily broken down on the occasion of the assembly and the elasticity of the guide sheet 33 decreases.

For this reason, the thickness of the guide sheet 33 preferably falls within the range between 0.025 mm and 0.25 mm.

Also, any types of resin other than PET can be adopted as the material of the guide sheet 33, on condition that the resin is heat-resistant.

Therefore, the guide sheet 33 is preferably made of a material that can form a thin plate having the aforesaid thickness, is resistant to heat up to about 200° C., and is oil-resistant.

Examples of such a material of the guide sheet 33 includes a thin plate (film) made of plastic (polyimide, polyethylene terephthalate, polyamide, etc.) and a metal thin plate (stainless steel plate and the like).

Above all, as the material of the guide sheet 33, a material that does not allow the oil spilling from the pipe 31 to permeate, i.e. an oil-resistant material is particularly preferable.

The present applying mechanism is arranged in such a manner that the oil is caused to spread along the longitudinal direction, by utilizing the surface tension generated by causing the guide sheet 33 to be in touch with the pipe 31.

On the other hand, when the guide sheet 33 is permeable (e.g. when felt is adopted as the guide sheet 33), the spreading of the oil entirely relies on the capillary phenomenon inside the guide sheet 33. This lowers the spreadability of the oil in the longitudinal direction. Moreover, the oil is apt to remain in the inside of the guide sheet 33, so as to be deteriorated.

Moreover, when a certain amount of the oil remains in the guide sheet 33, the flow of the oil has to be uneconomically increased.

That is to say, when the guide sheet 33 allows the oil to permeate the same, the oil is delivered to the felt 25 only after a sufficient amount of the oil permeates the guide sheet 33. On this account, a large amount of the oil is required at the time of starting (preparing for) the use of the present applying mechanism (because the flow must fall within the range of about 4-5 cc/min), and the preparation for the use takes time.

Furthermore, since it is impossible from the outside to judge whether or not the guide sheet 33 is dry (i.e. whether or not a sufficient amount of the oil has permeated the guide sheet 33), it is necessary to keep the oil flow to be about 4-5 cc/min, even at a time of not starting the use of the guide sheet 33.

On the other hand, when the guide sheet 33 is oil-resistant, it is unnecessary to cause the guide sheet 33 to be permeated with the oil. On this account, the flow of the oil can be reduced to 2-3 cc/min, and the time for the preparation can be significantly shortened.

When the guide sheet 33 is thin, the present applying mechanism is preferably dealt with in such a manner as to avoid the deformation of the guide sheet 33.

In the present applying mechanism, in particular, the guide sheet 33 and the pipe 31 are caused to be in touch with each other by the elasticity (repulsive force) of the guide sheet 33. The assembly of the present applying mechanism involves the effect against the repulsive force of the guide sheet 33, so that the guide sheet 33 is liable to the deformation.

To prevent this, it is preferable to put a double-faced adhesive tape on the contact surface between the bottom portion 53 and the felt supporter 25*a*, on the occasion of assembling the present applying mechanism. It is also preferable to fold the guide sheet 33 so as to touch the pipe 31, with the guide sheet 33 being tentatively adhered to the felt supporter 25*a*. With this, the guide sheet 33 can be efficiently attached, and the deformation of the guide sheet 33 can be prevented.

It is preferable that the widths (lengths in the longitudinal direction) of the oil application roller 16 and the felt 25 be slightly longer than the width of a printer sheet having the maximum size. Also, it is preferable that the width of the blade 29 be broader than the width of the oil application roller 16, and the width of the fixing roller 11 be substantially identical with the width of the oil application roller 16. Furthermore, the width of the pressure roller 12 is preferably broader than the width of the fixing roller 11.

It is preferable in the present applying mechanism that, between the outer surface of the pipe 31 and the middle portion 52 (slits 61 and guide sections 62) of the guide sheet 33, the oil sufficiently spread along the longitudinal direction on account of the surface tension.

For this reason, the width of each slit 61 of the guide sheet 33 is preferably within the range between about 0.5 mm and 5 mm.

With this, the oil can spread, by the surface tension, along the longitudinal direction of the pipe 31, without causing the clogging of paper powder, dust and the like in the slits 61.

When the widths of the slits 61 are not broader than 0.5 mm, paper powder, dust and the like may clog up the slits 61.

On the other hand, when the widths of the slits 61 exceed 5 mm, the surface tension does not effectively occur. This deteriorates the spreadability of the oil, and makes it difficult to spread the oil to the entirety of the guide sections 62 and the slits 61.

The guide sections 62 of the guide sheet 33 may be formed so as to increase their widths toward the felt 25.

In the present applying mechanism, in the middle portion 52 of the guide sheet 33, the number of the slits 61 (guide sections 62) is preferably as large as possible, across the width (in the longitudinal direction) of the middle portion 52. (For instance, it is preferable that the number of the slits 61 be larger than the number of the holes 41 of the pipe 31.) The oil flowing on the middle portion 52 cannot easily cross over the slits 61. On this account, when a large number of the slits 61 are formed, the oil having been spread in the longitudinal direction on account of the surface tension between the pipe 31 and the guide sheet 33 (middle portion 52) can reach the felt 25, with the state of spreading being maintained.

The length L (see FIG. 1) from the contact point C between the guide sheet 33 and the pipe 31 to the top portion 51 is preferably not shorter than 1 mm. With this, it is possible to avoid the clogging of paper powder, dust and the like in the slits 61 in the vicinity of the contact point C. On this account, it is possible to avoid such a trouble that, between the guide sheet 33 and the pipe 31, the oil accumulates up to the top portion 51, and spills over from the both ends of the pipe 31 in the longitudinal direction.

In the present embodiment, the guide sheet 33 is made up of (i) the middle portion 52 having the slits 61 and (ii) the top and bottom portions 51 and 53 that are flat, provided on the both sides of the middle portion 52, and do not have the slits 61.

The slits 61 may also be made at the bottom portion 53.

Moreover, as described above, the pump 22 of the present applying mechanism is either a piezo pump or an electromagnetic pump.

A piezo pump operates in accordance with a frequency of an AC power supply, and is more expensive than an electromagnetic pump that is driven by a DC power supply (the price of the piezo pump is about twice as much as that of the electromagnetic pump). For this reason, the low-priced electromagnetic pump may be suitable in some cases.

As the pump 22 of the present applying mechanism, it is possible to adopt an electromagnetic pump that can be driven by a DC pulse current (having a cycle of 30 ms-300 ms and a pulse width of 3 ms-50 ms).

The flow of such an electromagnetic pump can be set within the range between 1 cc/min and 10 cc/min, by adjusting the pulse width and the cycle of the supplied pulse current.

As described above, when the oil-resistant guide sheet 33 is adopted, the flow with which the present applying mechanism suitably operates is typically 2-3 cc/min.

In the meanwhile, when the material of the guide sheet 33 is permeable (e.g. when felt is adopted), the oil must be supplied with the flow of 4-5 cc/min.

In the present embodiment, the kinetic viscosity of the oil used in the present applying mechanism is 100 cs at 25° C. The present applying mechanism, however, can adopt oil whose kinetic viscosity falls within the range between 100 cs and 300 cs at 25° C.

Regarding this kinetic viscosity, since the flashing point of oil having kinetic viscosity less than 100 cs is low, adopting this oil may cause flash at the fixing device 217. Meanwhile, oil having kinetic viscosity more than 300 cs cannot be easily supplied using a piezo pump and a solenoid pump.

In the present embodiment, silicone oil having a dimethylpolysiloxane structure is used. The viscosity variation of this oil in accordance with the temperature change is relatively small. The kinetic viscosity at 0° C. is about twice as much as the kinetic viscosity at 25° C., while the kinetic viscosity at 50° C. is about half as much as the kinetic viscosity at 25° C.

The viscosity variation of the oil adopted to the present applying mechanism, in accordance with the temperature change, is not limited to the above. As a matter of course, oil whose kinetic viscosity is lower than the above can be adopted. Also, oil whose kinetic viscosity is higher than the above can also be adopted by adjusting the members of the present applying mechanism to that kinetic viscosity.

The present embodiment uses silicone oil as the releasing agent. The present applying mechanism, however, can also adopt any types of releasing agents other than the silicone oil.

In the present embodiment, the present applying mechanism applies the oil to the fixing roller 11 of the fixing device 217. Not being limited to this, however, it is possible to adopt such an arrangement that the oil application roller 16 is caused to be in touch with the pressure roller 12 rather than the fixing roller 11, and the oil is applied to the pressure roller 12. Also, the oil may be applied to the both of the rollers 11 and 12.

In the present embodiment, the oil application roller 16 rotates in accordance with the rotation of the fixing roller 11. However, the oil application roller 16 may be driven by a driving mechanism different from that of the fixing roller 11. Furthermore, the rotative direction of the oil application roller 16 may be identical or different from the rotative direction of the fixing roller 11.

In the present embodiment, the felt 25 is a heat-resistant Nomex® felt that is 3 mm thick. A heat-resistant Nomex® felt that is about 1 mm to 5 mm thick can be adopted as the felt 25.

In the present embodiment, the guide sheet 33 and the felt 25 are provided as separate members. However, these two members may be integrated into one member.

That is to say, it is possible to adopt such an arrangement that the bottom portion 53 of the guide sheet 33 is extended to the vicinity of the oil application roller 16, and the felt 25 is provided thereon. In this case, the oil discharging holes 71 are made at the bottom portion 53, and the bottom portion 53 is screwed on the steel plate 300.

In the present embodiment, the scanning by the laser beam from the laser beam scanner units 227*a* through 227*d* is performed and the exposure is carried out, so that the optical writing with respect to a photoreceptor is realized. In place of the laser beam scanner units 227*a* through 227*d*, a solid scanning writing optical system (LED head) made up of a light emitting diode array, an imaging lens array, and the like may be adopted.

This LED head is smaller in size than the laser beam scanner units 227*a* through 227*d*, has no movable part, and is silent. For these reasons, the LED head is preferably adopted to an image forming apparatus such as a tandem digital color photocopier that requires a plurality of optical writing units.

In the present embodiment, the photocopier 1 is a printing apparatus that can print color images (i.e. color image forming apparatus).

The use of the releasing agent plays an important role in the color image forming apparatus, and the state of the releasing agent greatly influences on the quality of a printed image (i.e. quality of image formation). For these reasons, the present applying mechanism is highly effective for the color image forming apparatus.

However, as a matter of course, effects similar to the above can be obtained when the present applying mechanism is adopted to a printing apparatus for black and white images (i.e. a black-and-white image forming apparatus).

The releasing agent applying mechanism of the present invention can be rephrased in the following manner: A releasing agent applying mechanism that applies a releasing agent to a fixing roller of a printing apparatus, in which the releasing agent is discharged from holes made on a pipe extending along the fixing roller, and the releasing agent discharged from the pipe is, via a releasing agent guide, supplied to a releasing agent applying roller that is in touch with a fixing roller so as to rotate, the releasing agent applying mechanism including an applying member that applies, from below, the releasing agent to the releasing agent application roller, the pipe is provided above the releasing agent application roller, the releasing agent guide is formed so as to supply the releasing agent, which has been discharged from the pipe, to the applying member, a part of the releasing agent guide bulging away from the releasing agent application roller with respect to a vertical line passing through the center of the pipe, a bottom portion of the releasing agent guide being fixed on the applying member, and from this point of fixation, the releasing agent guide extending in a direction away from the releasing agent application roller, being then folded back and crosses over the vertical line, and consequently touching a lower part of the pipe.

In the conventional art, the releasing agent (e.g. silicone oil), which spills over from the holes of the pipe-shaped member for supplying the releasing agent, drops to the vicinity of an application target member (fixing roller and pressure roller). For this reason, even if intermediate members (releasing agent application roller and releasing agent supplying felt), which are in touch with the application target member and supply the releasing agent thereto, are provided, the releasing agent does not sufficiently spread because of its relatively high viscosity. On this account, often the supply of the releasing agent along the longitudinal direction is not evenly done, and toner images are not properly transferred to a printer sheet. Moreover, if, on the occasion of supplying the releasing agent to a supply target via a guide member, supplying paths are provided in the vicinity of a high-temperature part, the releasing agent is liable to deteriorate on account of the high temperature. The objective of the present invention can be rephrased as follows: The objective of the present invention is to provide (i) a releasing agent supplying apparatus in which a guide member is provided between a supply target and a pipe-shaped member, and after a releasing agent is spread by the guide member and the pipe-shaped member, the releasing agent is led, by supplying paths, to a part where the ambient temperature is low, so that the releasing member is supplied to the supply target without being exposed to a high temperature so much, and hence the deterioration of the releasing agent is prevented and the releasing agent is evenly supplied, (ii) a fixing device including the aforesaid apparatus, and (iii) an image forming apparatus including this fixing device.

As the guide sheet 33, a thin plate that is heat resistant and 0.025 mm-0.25 mm thick can be adopted. However, although depending on the material, a too thin guide sheet 33 is liable to breakage in the assembling process in a factory, and also the elasticity of such a thin guide sheet 33 is low. The guide sheet 33 is therefore preferably made of a material such as plastic and metal that can form a thin plate. Moreover, heat resistance (to a temperature about 200° C.) and oil resistance are necessary for the guide sheet 33. For these reasons, a plate made of polyimide, polyethylene terephthalate, polyamide, etc., or a metal plate such as a stainless steel plate are suitable. When the guide sheet 33 has low rigidity (i.e. a certain degree of elasticity), in other words, when a film or metal thin plate is adopted, the guide sheet 33 is fixed to a base by a connecting member such as a screw, in such a manner as to pressurize the guide sheet 33 towards the pipe 31. Since the guide sheet 33 and the pipe 31 in this case are not adhered to each other, the oil spilling over to the opposite side of the pipe 31 can also reach the back surface of the guide sheet 33, via openings at around the partition members between the pipe 31 and the guide sheet 33. On account of the inclination of the guide sheet 33, the releasing agent is guided toward the fixing roller that is the supply target, via the both surfaces of the guiding part of the guide sheet 33.

The width of each opening (slit 61) of the guide sheet 33 preferably falls within the range between about 0.5 mm and 5 mm, in order to spread the releasing agent (silicone oil) in the longitudinal direction by the capillary phenomenon between the outer surface of the pipe 31 and the guiding part and between the outer surface of the pipe 31 and the openings (slits 61). With this, the oil can spread along the longitudinal direction of the pipe 31 by the capillary phenomenon, without causing the clogging of paper powder, dust, and the like in the openings. The clogging may occur when the width is not more than 0.5 mm. Meanwhile, when the width exceeds 5 mm, the capillary phenomenon does not suitably occur and hence the spreadability of the releasing agent deteriorates, and also the releasing agent does not spread at the guide sections so as to drop therefrom. For these reasons, the length L is set so as to be 1 mm or more, and this makes it possible to prevent the releasing agent from spilling over on the top side of the slant section of the guide sheet 33, which is caused by the clogging of dust and the like and dropping from the both ends in the longitudinal direction.

Each of the guide sections of the guide sheet 33 may be formed so as to increase its width toward the supply target. The width, however, may be kept to be 4 mm in the ratio of 1:1, or the ratio may be varied. When the guide sheet 33 formed using a thin steel plate or plastic (film or thin molded article) is caused to be in touch with the pipe 31, the guide sheet 33 is fixed to a base using a connecting member such as a screw, so as to be surely in touch with the pipe 31 and so as to be pressurized toward the pipe 31 by means of the elasticity of the guide sheet 33. Since the guide sheet 33 being thus arranged is not adhered to the pipe 31 using, for instance, an adhesive, these members are easily assembled and partial deterioration of the spreadability of the oil (i.e. whether or not the oil is evenly supplied) on account of the unevenness of the adhesive can be avoided. Furthermore, the guide sheet 33 and the pipe 31 are not peeled off from each other on the occasion of the use of the applying mechanism, and the guide sheet 33 can be replaced with ease.

By the way, in the present embodiment, a color image forming apparatus is exemplified as the image forming apparatus. This is because the use of the releasing agent plays an important role in the color image forming apparatus, and the quality of image formation greatly depends on the state of the releasing agent. However, it is needless to say that the present invention is also effective for a black-and-white image forming apparatus.

The present invention can be expressed as first to seventh releasing agent supplying apparatuses, a first fixing device, and a first image forming apparatus, as described below. That is to say, the first releasing agent supplying apparatus supplies a releasing agent to a fixing device that has a fixing section made up of a rotatable fixing roller and a pressure roller pressurized to and closely contacting the fixing roller, and in this releasing agent supplying apparatus in which the releasing agent supplied by a releasing agent supply pump spills over from holes that are aligned along the axis of a pipe-shaped member and are made on the top side of the pipe-shaped member, the releasing agent is then supplied to at least one of the fixing roller and the pressure roller, via intermediate guide means, and a guide member that is a part of the intermediate guide means bypasses a high-temperature part. According to this arrangement, since the releasing agent is guided so as to bypass the high-temperature part, it is possible to prevent the releasing agent from deteriorating on account of the heat of the fixing roller and the oil application roller.

The second releasing agent supplying apparatus is arranged such that, in the first releasing agent supplying apparatus, the guide member has a bulged portion, and guides the releasing agent away from the supply target and then towards the supply target, so that the releasing agent is supplied to the supply target. According to this arrangement, the guide member bulges so as to guide the releasing agent away from the supply target (i.e. in the direction away from the fixing roller and the oil application roller) and then guide towards the supply target. With this, it is possible to cause the releasing agent to avoid the exposure to high-temperature radiation heat from the fixing roller and the oil application roller, so as to reduce the degradation of the releasing agent by heat.

The third releasing agent supplying apparatus is arranged in such a manner that, in the first or second releasing agent supplying apparatus, the guide member is provided below a pipe-shaped member, the guide member has partition members including openings and guide section parts extending to the vicinity of the supply target, and the guide section parts are in touch with the pipe-shaped member at a portion where the partition members and the guide section parts are both formed. According to this arrangement, the guide member has guide section parts extending to the vicinity of the supply target and partition members having openings and extending in a similar manner as the guide section parts. The pipe-shaped member contacts the guide member, so that the releasing agent spread along the longitudinal direction of the pipe-shaped member is guided by the guide member, and consequently reaches the vicinity of the supply target with the spreading state being maintained. In this manner the releasing agent can be evenly supplied.

The fourth releasing agent supplying apparatus is arranged in such a manner that, in the first to third releasing agent supplying apparatus, the guide member is made of non-permeable material, and the releasing agent is supplied by being guided on the both surfaces of the guide member. According to this arrangement, the non-permeable material is used so that the releasing agent does not permeate the inside of the guide member, the releasing agent is quickly guided on the both surfaces of the guide section parts of the guide member, and the releasing agent is unlikely to remain on the surfaces of the guide member. For these reasons, the degradation of the releasing agent by heat can be prevented.

Furthermore, the fifth releasing agent supplying apparatus is arranged in such a manner that, in the third releasing agent supplying apparatus, the guide member is in touch with the pipe-shaped member, on account of the elasticity of the guide member. According to this arrangement, a predetermined gap can be certainly formed between the guide section parts of the guide member and the pipe-shaped member, on account of the elasticity of the guide member. Also, the sixth releasing agent supplying apparatus is arranged in such a manner that, in the third releasing agent supplying apparatus, the guide member is in touch with the pipe-shaped member from below, and the guide member being in touch with the pipe-shaped member is on the tilt. For this reason, all of the releasing agent spilled over from the holes on the upper side of the pipe-shaped member are caught by the guide member and spread by the capillary phenomenon, so that the releasing agent can be guided to the supply target.

The seventh releasing agent supplying apparatus is arranged in such a manner that, in the third releasing agent supplying apparatus, the guide section parts and the partition members are alternately provided, and the numbers of these parts and members are sufficiently larger than the number of excretory holes made on the pipe-shaped member, from which the releasing agent is discharged. According to this arrangement, the guide section parts and the partition members that are alternately provided are sufficiently larger in number than the excretory holes from which the releasing agent is discharged. On this account, by the pipe-shaped member and the guide sections, the releasing agent can be guided, with the state of spreading along the longitudinal direction being maintained.

A first fixing device includes a fixing section made up of a rotative fixing roller and a pressure roller closely contacting the fixing roller, and from a pipe-shaped member that is provided above the fixing roller and has a plurality of holes on the upper side in the axis direction, the releasing agent supplied by a releasing agent supplying pump spills over, and is supplied to either the fixing roller or the pressure roller via the intermediate guide means, and the first fixing device has one of the aforesaid first to seventh releasing agent supplying apparatus. According to this arrangement, the aforesaid effects can be obtained by the fixing device. A first image forming apparatus includes the first fixing device. According to this arrangement, the image forming apparatus includes the aforesaid fixing device so that the aforesaid effects can be obtained, and hence image formation is suitably performed.

The releasing agent guide having the aforesaid shape is formed in such a manner that, the bottom portion of the releasing agent guide is fixed to the applying member, and from this point of fixation the releasing agent guide extends away from the releasing agent application roller, then is folded back and crosses over the vertical line, and consequently touches the lower part of the pipe.

According to this arrangement, the releasing agent guide is in touch with the pipe. For this reason, at the contact point (line) between the pipe and the releasing agent guide, the releasing agent discharged from the pipe is caused to spread by the surface tension along the longitudinal direction of the pipe (i.e. in the direction of the length of the pipe), and then the releasing agent is supplied to the applying member.

Because of the above, the releasing agent discharged from the pipe can be evenly applied to the whole length (entirety) of the applying member (and the releasing agent application roller). On this account, to the entirety of the fixing roller, the releasing agent can be applied extremely evenly (i.e. an amount of the applied releasing agent is balanced).

In the aforementioned arrangement, the releasing agent guide preferably has slits extending from the fixed bottom portion and toward the contact point with the pipe.

With this, the releasing agent discharged from the pipe can reach the back side of the releasing agent guide, via the slits. On this account, the releasing agent can be supplied to the applying member via the both surfaces of the releasing agent guide, so that the speed of supplying the releasing agent improves.

Note that, in the arrangement above, the releasing agent flows on parts of the releasing agent guide where the slits are not formed (i.e. the releasing agent flows between the slits (i.e. guide sections)).

On the releasing agent guide, these slits preferably extend beyond the contact point with the pipe.

That is to say, the releasing agent discharged from the pipe trickles down the outer surface of the pipe on the both sides of the aforesaid vertical line passing through the center of the pipe, and on the both sides of the contact point between the pipe and the releasing agent guide, the releasing agent is caught by the releasing agent guide.

Note that, the both sides of the contact point between the pipe and the releasing agent guide indicate (i) a side of the releasing agent guide close to the applying member and (ii) a side of the releasing agent guide crossing over the aforesaid contact point from the applying member (i.e. a side far from the applying member). By the way, "close to (far from) the applying member" indicates the length from the pipe to the applying member measured along the releasing agent guide, so that this length is nothing to do with the actual length.

The releasing agent dropping on the side of the releasing agent guide close to the applying member flows on the releasing agent guide and reaches the applying member.

On the other hand, if no measures are taken, the releasing agent dropping on the side of the releasing agent guide far from the applying member cannot flow to the applying member, because the contact point between the pipe and the releasing agent guide exists on the paths to the applying member.

To solve this problem, the slits are made on the releasing agent guide in such a manner as to get across the contact point with the pipe. With this, the releasing agent dropping on the side far from the applying member passes through the slits and reaches the back side of the releasing agent guide, so that the releasing agent is supplied to the applying member via the back side. On this account, it is possible to avoid the accumulation of the oil between the releasing agent guide and the pipe.

It is preferable that the releasing agent guide that is in touch with the pipe be on the slant with respect to the pipe, and the side of the releasing agent guide close to the applying member fall downward.

This state of "on the slant" is of course neither a horizontal state nor a perpendicular (vertical) state.

According to this arrangement, the releasing agent guide inclines from the side close to the applying member to the side far from the applying member, with respect to the contact point with the pipe.

This allows the oil caught by the side of the releasing agent guide close to the applying member to flow to the applying member. Also, it is possible to prevent the oil, which is caught by the side far from the applying member, from flowing in the direction away from the applying member on the releasing agent guide.

The number of the slits of the releasing agent guide is preferably larger than the number of the holes of the pipe.

The releasing agent flowing on the releasing agent guide cannot easily cross over the slits. On this account, when a large number of slits are made, the releasing agent, which has been spread along the longitudinal direction because of the surface tension acting between the pipe and the releasing agent member, can reach the applying member, with the state of the spreading being maintained.

The releasing agent guide is preferably in touch with the pipe, on account of the elasticity of the releasing agent guide. According to this arrangement, it is unnecessary to adhere the releasing agent guide to the pipe by using an adhesive and the like. This makes it possible to easily assemble the present applying mechanism.

Furthermore, it is possible to avoid the partial decrease of the spreadability (evenness) of the supplied oil because of the irregularity of the adhered parts (i.e. some parts are adhered while other are not). (The spreadability decreases if there is a part that is not properly adhered).

Furthermore, it is possible to avoid the releasing agent guide to be torn away from the pipe due to the decrease of the adhesive property, during the use of the present applying mechanism. Furthermore, with the arrangement above, the releasing agent guide can be easily replaced.

In the present applying mechanism, the releasing agent guide is preferably made of a material that is resistant to the releasing agent.

Note that the material that is resistant to the releasing agent indicates a material that can avoid the permeation of the releasing agent (i.e. the releasing agent cannot permeate the material).

With this, it is possible to avoid the permeation of the releasing agent into the releasing agent guide. On this account, the speed of supplying the releasing agent to the applying member via the releasing agent guide can be increased. Since the time during which the releasing agent is on the releasing agent guide is shortened, the degradation of the releasing agent due to the heat is further restrained.

When the releasing agent guide allows the releasing agent to permeate the same, the releasing agent is delivered to the applying member only after a sufficient amount of the releasing agent permeates the releasing agent guide. On this account, a large amount of the releasing agent is required at the time of starting (preparing for) the use of the present applying mechanism, and the preparation for the use takes time.

On the contrary, when the releasing agent guide is resistant to the releasing agent, it is unnecessary to cause the releasing agent to permeate the releasing agent guide. This makes it possible to reduce the amount of the releasing agent required for the preparation for the use, and the time of the preparation can be greatly shortened.

Embodiment 2

Figure 7:
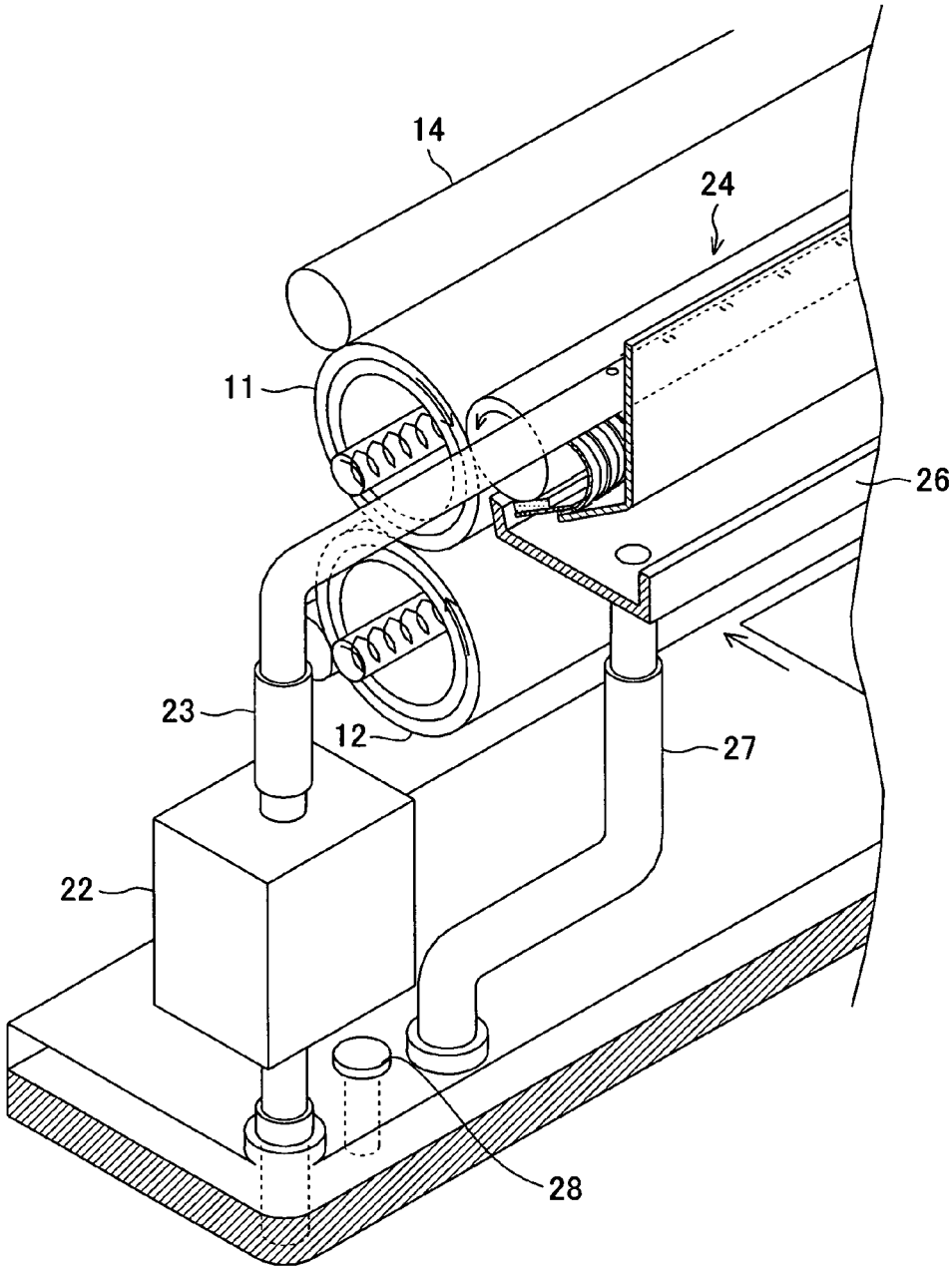
FIG. 7 is an oblique perspective view of a fixing device that is provided in the digital color photocopier shown in FIG. 2 and has the oil applying mechanism shown in FIG. 6.
Figure 8:
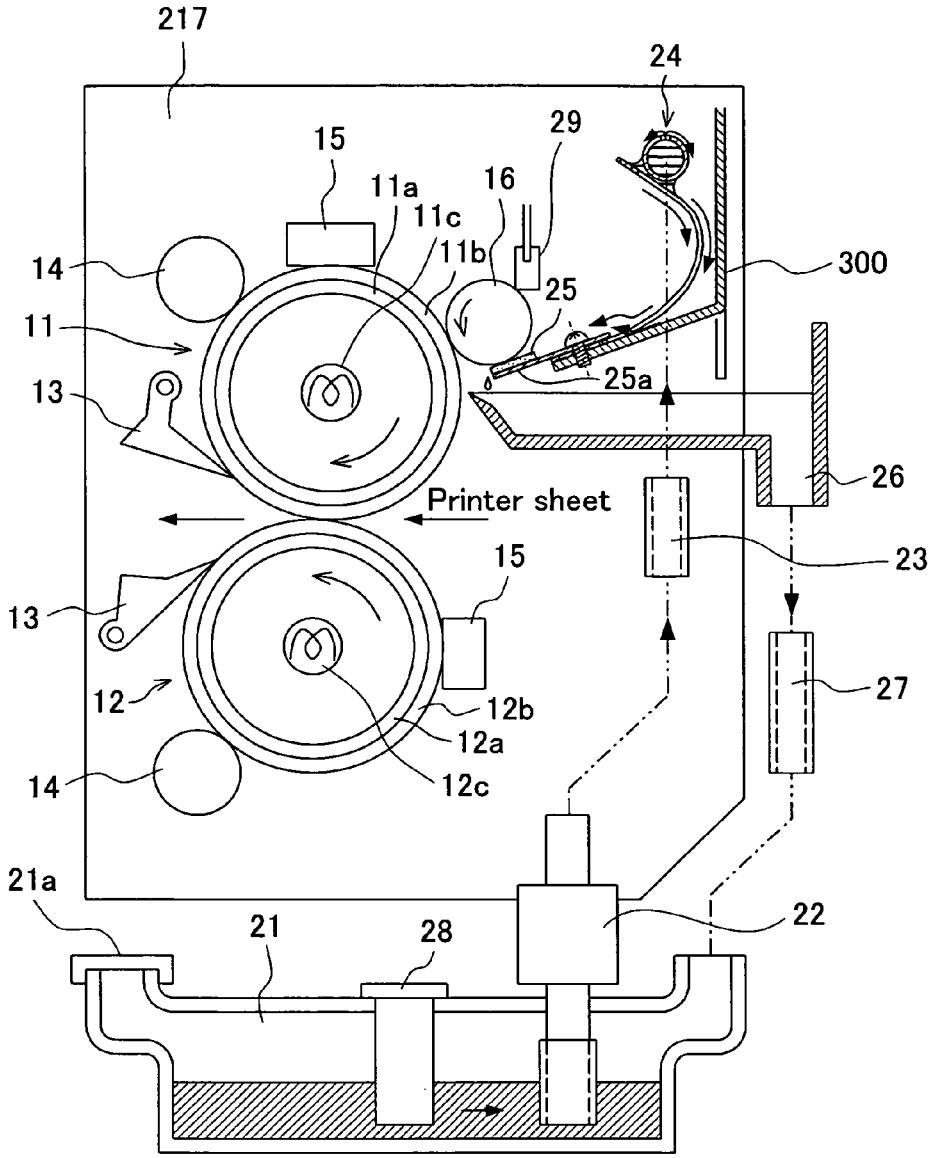
FIG. 8 is a cross section of the fixing device that is provided in the digital color photocopier shown in FIG. 2 and has the oil applying mechanism shown in FIG. 6.

Another embodiment of the present invention will be discussed. FIG. 7 is an oblique perspective view of a fixing device 217. FIG. 8 is a front view of the fixing device 217. The arrangement shown in FIGS. 7 and 8 is basically identical with the arrangement shown in FIGS. 3 and 4, except the arrangement of the pipe section 24.

Figure 6:
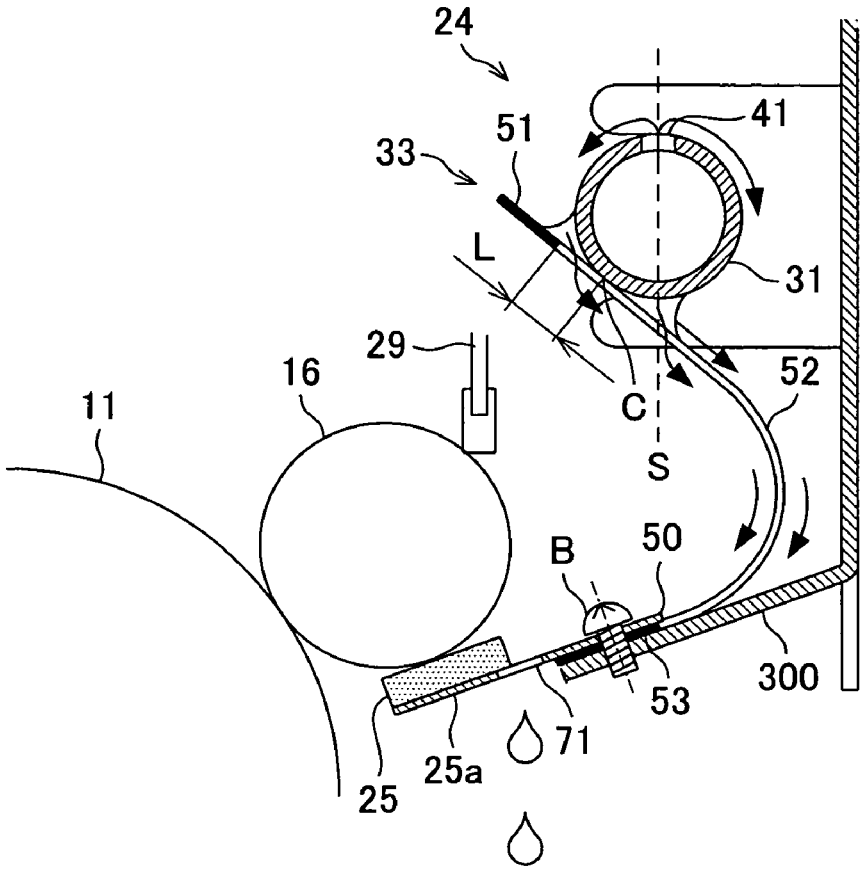
FIG. 6 is a cross section of a pipe section of an oil applying mechanism of another embodiment of the present invention.
Figure 9:
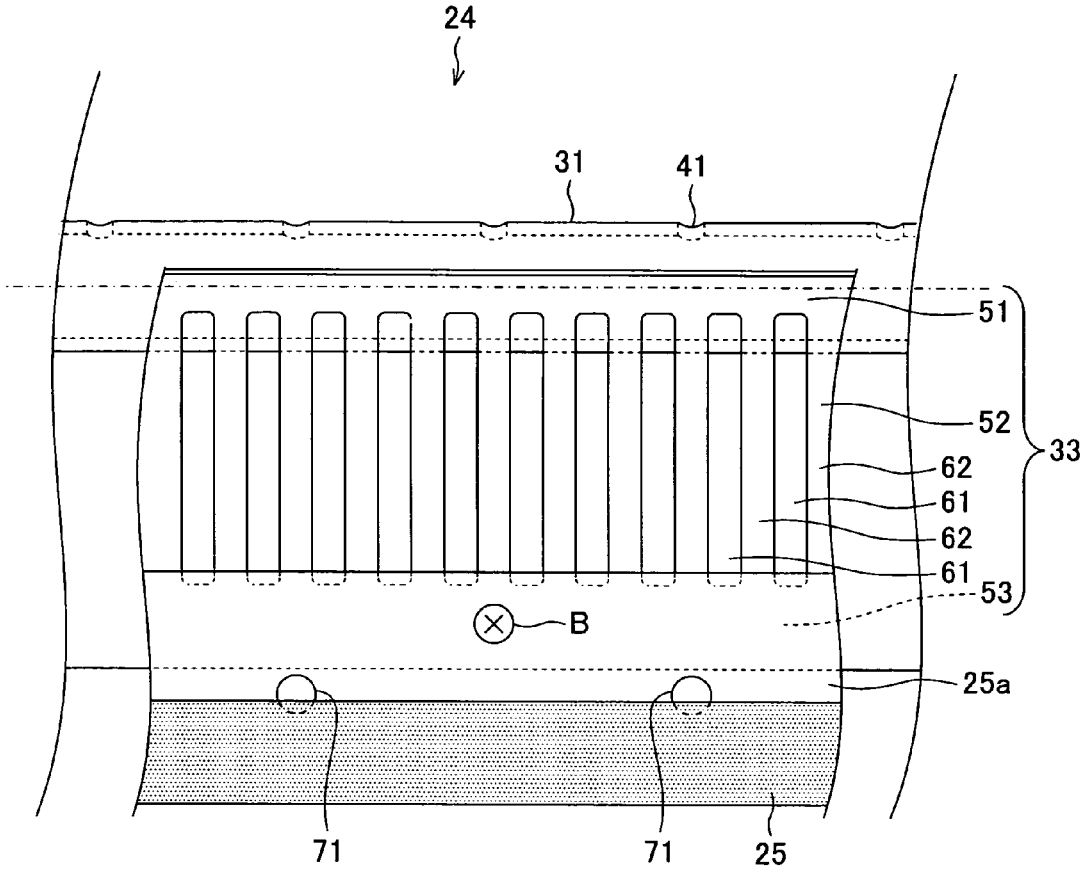
FIG. 9 is an expansion plan view of the pipe section shown in FIG. 6.
Figure 10:
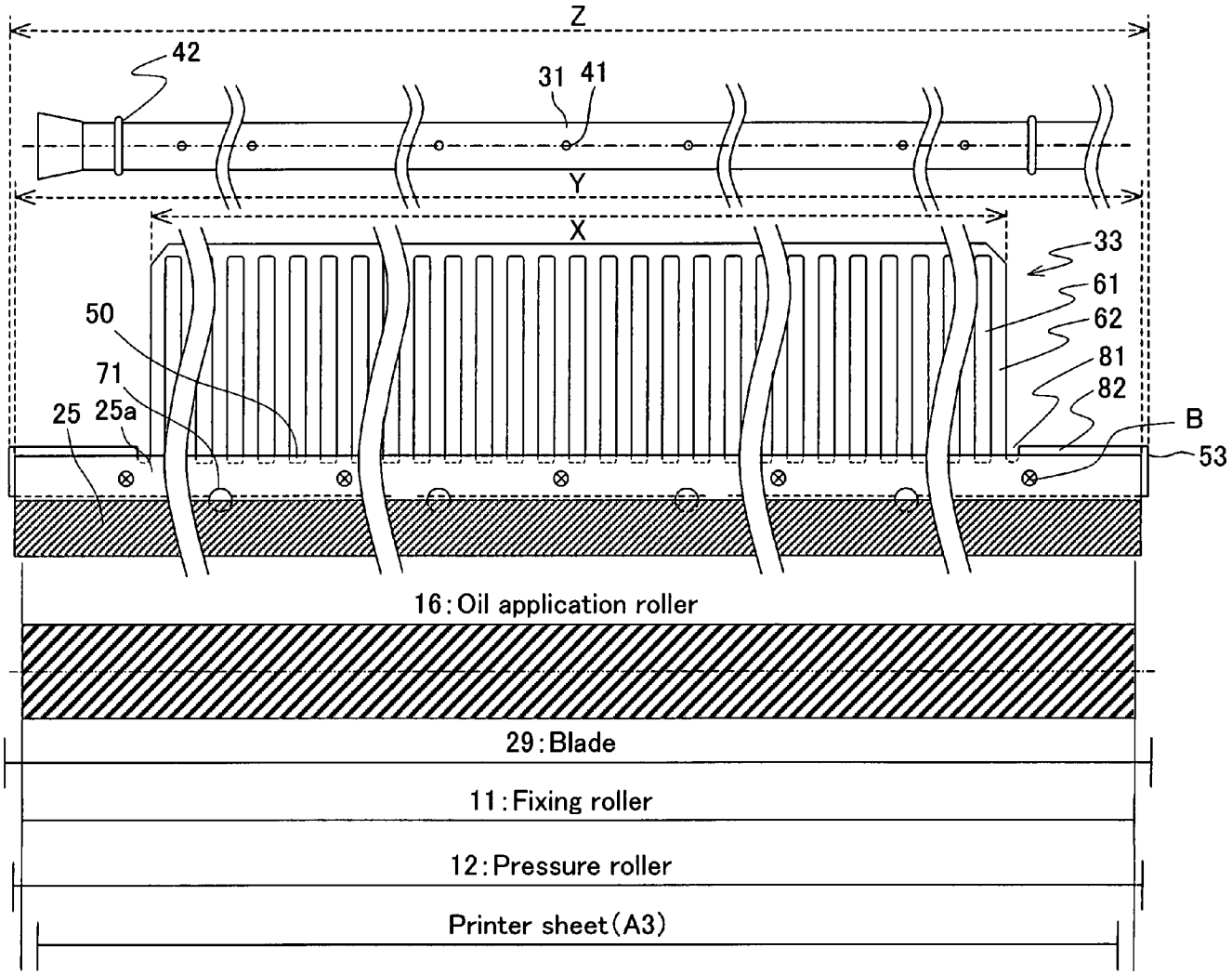
FIG. 10 is an expansion plan view of another arrangement of the pipe section of FIG. 6.

Now, how the pipe section 24 is arranged will be described. FIG. 6 is a cross section of the pipe section 24, and FIGS. 9 and 10 are expansion plan views thereof.

As these figures illustrate, the pipe section 24 is arranged basically identical with the pipe-shaped member shown in FIGS. 1 and 5.

However, in the pipe section 24 of the present embodiment, the both ends of the pipe 31 are provided with protrusions 42, respectively, in order to prevent the oil from flowing on the surface of the pipe 31. These protrusions 42 may be formed by putting an O-ring on the pipe 31 or by molding the pipe 31.

This guide sheet 33 causes the oil discharged from the holes 41 of the pipe 31 to pass by the oil application roller 16, and guides (carries) the oil to the felt 25.

As shown in FIG. 6, in the present embodiment, the guide sheet 33 is arranged in such a manner that the top portion 51 is provided on the pipe 31 side, while the bottom portion 53 is provided on the felt 25 side.

The guide sheet 33 is deposited on the felt supporter 25*a* in such a manner that the bottom portion 53 is below the felt supporter 25*a*. In other words, on the guide sheet 33, the bottom portion 53 and the felt supporter 25*a* are deposited. In the vicinity of the border between the middle portion 52 and the bottom portion 53, a projecting portion that is as thick as the felt supporter 25*a* and extends along the longitudinal direction of the pipe 31 is formed (i.e. an edge portion (projecting portion) 50 of the felt supporter 25*a* is formed). This edge portion 50 can be seen as a partition section that is formed on the oil supplying paths on the guide sheet 33 and extends along the longitudinal direction of the pipe 31. The edge portion 50 is provided at the end of the oil supplying paths on the guide sheet 33.

As described later, when the oil discharged from the pipe 31 flows on the middle portion 52 and reaches the edge portion 50, the oil is blocked by the side wall of the edge portion 50. In other words, the edge portion 50 blocks the oil so that an oil storage is formed along the longitudinal direction of the pipe 31. In this wise, the edge portion 50 functions as a dam formed on the guide sheet 33. The felt supporter 25*a* here is 0.2 mm thick. Therefore, on the guide sheet 33, a dam with a height of 0.2 mm is formed along the longitudinal direction of the pipe 31.

The guide sheet 33 is also arranged such that most of the middle portion 52 bulges (arches) away from the oil application roller 16, with respect to the vertical line S passing through the center of the pipe 31 (i.e. the center of the holes 41).

That is to say, in the guide sheet 33, the bottom portion 53 is screwed to the steel plate 300 by a screw B so that the bottom portion 53 is sandwiched between the steel plate 300 and the felt supporter 25*a*. (At the screwed portion, the steel plate 300, the bottom portion 53, and the felt supporter 25*a* are deposited in this order. The bottom portion 53 is provided in parallel to the oil application roller 16 (felt 25).)

In addition to the above, the end portion of the felt supporter 25*a* outreaches the bottom portion 53 and overlaps the middle portion 52.

In the applying mechanism shown in FIG. 6, the contact point C between the middle portion 52 and the pipe 31 is on the oil application roller 16 side with respect to the aforesaid vertical line S. At this contact point C, the middle portion 52 is in touch with the pipe 31 in a tilted manner, as described above.

Incidentally, in the present applying mechanism, the top portion 51 of the guide 33 is provided so as to avoid the contact with the pipe 31.

Furthermore, as shown in FIG. 9, the middle portion 52 of the guide sheet 33 has a plurality of slits 61 provided at predetermined intervals. These slits 61 are formed so as to cross over the edge portion 50 of the felt supporter 25*a* (i.e. extend to the side close to the oil application roller 16 with respect to the edge portion 50). In other words, at a part of the edge portion 50 where the guide sheet 33 and the felt supporter 25*a* are deposited (hereinafter, the part will be referred to as a deposited part), the middle portion 52 and the felt supporter 25*a* are deposited.

As shown in FIG. 10, the present applying mechanism is arranged in such a manner that, in the longitudinal direction, the width Y of the edge portion 50 of the felt supporter 25*a* is wider than the width of the portion where the guide section 62 is formed (i.e. wider than the widths of the releasing agent supplying paths).

At the deposited part, the felt supporter 25*a* is screwed to the guide sheet 33. At this deposited part, furthermore, the width Z of the guide sheet 33 in the longitudinal direction is wider than the width Y of the felt supporter 25*a* in the longitudinal direction.

In the present applying mechanism, the both ends of the guide sheet 33 at the deposited part have respective bump sections 82 that jut towards the contact point with the pipe 31 (i.e. towards the upstream of the releasing agent supplying paths) and are higher than the edge portion 50 of the felt supporter 25*a*. Also, between the area where the guide section 62 is formed and the bump sections 82 (i.e. between the releasing agent supplying paths and the bump sections 82), openings 81 are formed.

Now, how the oil is applied to the fixing roller 11 in the present applying mechanism is discussed.

To apply the oil to the fixing roller 11, first, the pump 22 sucks up the oil from the oil tank 21, and supplies the oil to the pipe section 24 via the tube-shaped member 23.

The oil supplied to the pipe section 24 is stored in the pipe 31. When the amount of the oil exceeds the capacity of the pipe 31, the oil starts to be discharged from the holes 41.

The oil discharged from the holes 41 trickles down on the outer surface of the pipe 31, and is caught by the front surface (surface contacting with the pipe 31) of the middle portion 52 of the guide sheet 33. Along the longitudinal direction of the pipe 31, the oil caught by the front surface of the middle portion 52 spreads between the front surface of the middle portion 52 and the outer surface of the pipe 31, on account of the surface tension.

Subsequently, a part of the oil moves to the back surface (surface on the oil application roller 16 side) of the middle portion 52, via the slits 61. Then the oil flows on the front and back surfaces of the middle portion 52 bulging away from the oil application roller 16 with respect to the vertical line S (i.e. the oil flows on the guide sections 62).

When the oil having flown on the both surfaces of the middle portion 52 reaches the edge portion 50 of the felt supporter 25*a*, the oil is blocked by the edge portion 50. This blockage occurs on account of the protruding shape of the edge portion 50 (felt supporter 25*a*). With this, an oil storage where the oil spreads along the longitudinal direction of the edge portion 50 (i.e. along the longitudinal direction of the pipe 31) is formed. On this occasion, a part of the oil flowing on the front surface of the middle portion 52 moves to the back surface again via the slits 61, while being blocked by the edge portion 50.

Note that the oil storage temporarily stops the flow of the oil towards the oil application roller 16, by storing the oil on the guide sheet 33.

The oil storage formed at the edge portion 50 evenly spreads in the longitudinal direction on the guide sheet 33. When the oil further flows into this oil storage, the oil goes beyond the edge portion 50 and reaches the felt section 25*a*. That is to say, after the oil storage sufficiently and evenly spreads along the longitudinal direction of the pipe 31, the oil crosses over the edge portion 50 and flows towards the oil application roller 16. Then the oil is supplied to the felt 25 via the felt section 25*a*. In this manner, it is possible to supply, to the felt 25, the oil that has been spread in the longitudinal direction.

Note that, a part of the oil forming the oil storage drops from the both ends of the guide sheet 33 in the longitudinal direction, and as redundant oil, the oil having been dropped is collected by the oil pan 26.

The oil having flown on the back surface of the middle portion 52 is blocked by the edge portion 50 and forms the oil storage. On the other hand, the oil having flown on the front surface of the middle portion 52 enters to the back surface side of the middle portion 52 via the slits 61 (i.e. the oil appears on the back side) so as to form, with the oil having frown on the front surface, the oil storage. Consequently all of the oil reaches the felt 25 after spilling over from the edge portion 50 and passing through the felt supporter 25*a*.

Then the oil soaks into the felt 25, and is applied to the surface of the fixing roller 11 by the oil application roller 16.

An amount of the oil that is supplied from the felt 25 to the oil application roller 16 and finally reaches the fixing roller 11 is about 10% of the oil arriving at the felt 25. The remaining (about 90% of) oil is spilled over from the felt 25, and discharged to the oil pan 26 through the end part (end part on the oil application roller 16 side) of the felt 25 and the oil discharging holes 71.

As described above, the present applying mechanism is arranged such that the guide sheet 33 has the oil storage that is provided on the oil supplying paths on the guide sheet 33 and extends along the longitudinal direction of the pipe 31. The oil discharged from the pipe 31 is stored in this oil storage, and then the oil spilled over from the oil storage (i.e. the oil climbing over the edge portion 50) is carried towards the oil application roller 16.

With this, in the present applying mechanism, the oil guided from the holes 41 of the pipe 31 to the oil storage is caused to spread along the oil storage (i.e. along the longitudinal direction of the pipe 31, the oil application roller 16, and the fixing roller 11).

In the present applying mechanism, furthermore, the oil spilling over from the oil storage is carried towards the oil application roller 16. With this, the releasing agent spreads in the oil storage and along the longitudinal direction of the pipe 31, and then carried towards the oil application roller 16.

In this wise, in the present applying mechanism, after the oil is caused to spread on the guide sheet 33 and along the longitudinal direction of the pipe 31, the oil is supplied towards the oil application roller 16. For this reason, the oil discharged from the pipe 31 can be evenly supplied to the whole length (entirety) of the oil application roller 16. It is therefore possible to extremely evenly apply the oil to the entirety of the fixing roller 11 (i.e. the amount of the applied oil is balanced).

In the present applying mechanism, the dam is formed on the guide sheet 33, by the felt supporter 25*a* deposited on the guide sheet 33. In other words, the guide sheet 33 is partitioned by the edge portion (partition, dam) 50 jutting along the longitudinal direction of the pipe 31. On this account, the oil is blocked at this edge portion 50, so as to be evenly spread along the longitudinal direction of the edge portion 50 (i.e. along the longitudinal direction of the pipe 31). In this manner, the oil storage can be formed along the partition section (dam). It is therefore possible to supply the oil, which is evenly spread by the edge portion 50, towards the oil application roller 16.

In the present applying mechanism, the guide sheet 33 has the felt 25 by which the oil is applied to the oil application roller 16, and this felt 25 is placed on the felt supporter 25*a*. On the guide sheet 33, the deposited part where the guide sheet 33 and the felt supporter 25*a* are deposited is provided.

With this, the oil flowing on the guide sheet 33 is blocked by the felt supporter 25*a* at the deposited part, and the oil evenly spreads along the felt supporter 25*a*. In this manner, the oil storage is formed along the longitudinal direction of the felt supporter 25*a*.

On this account, the oil evenly spread by the deposited part can be carried towards the oil application roller 16, over the felt supporter 25*a*.

In the present applying mechanism, in the longitudinal direction, the width Y of the felt supporter 25*a* is designed so as to be wider than the widths X of the oil supplying paths (guide sections 62) from the end part of the guide sheet 33 on the pipe 31 side to the felt supporter 25*a*.

With this, on the guide sheet 33, the size of the oil supplying paths to the felt supporter 25*a* is reduced in the longitudinal direction.

The width of the felt supporter 25*a* is widened in the longitudinal direction, so that a lot of oil can be supplied over the felt supporter 25*a* and towards the oil application roller 16. This makes it possible to reduce an amount oil flowing in the longitudinal direction of the guide sheet 33 and not arriving at the oil application roller 16 (i.e. an amount of the redundant oil can be reduced). On this account, a lot of oil can be efficiently supplied to the oil application roller 16.

In the present applying mechanism, the felt supporter 25*a* is fixed to the steel plate 300, with the guide sheet 33 being interposed therebetween, and the width Z of the guide sheet 33 in the longitudinal direction is designed so as to be wider than the width Y of the felt supporter 25*a* in the longitudinal direction.

With this, the fixed portion between the guide sheet 33 and the felt supporter 25*a* is wide, and hence the felt supporter 25*a* can be stably fixed to the guide sheet 33.

In the present applying mechanism, at the deposited part, the both ends of the guide sheet 33 in the longitudinal direction have protrusions 53 jutting towards the upstream of the oil supplying paths (i.e. towards the pipe 31 side).

On this account, when the oil blocked by the felt supporter 25*a* spreads along the longitudinal direction of the felt supporter 25*a*, the protrusions 53 stop the flow of the oil. In other words, using the protrusions 53, it is possible to prevent the oil from flowing towards the both ends of the guide sheet 33 in the longitudinal direction. For this reason, the deterioration of the efficiency of the supply of the oil towards the oil application roller 16 can be prevented.

In the present applying mechanism, the felt supporter 25*a* is made up of a metal plate having elasticity.

On this account, it is possible to cause the felt 25 to be surely in touch with the releasing agent application roller, in an elastic manner. The releasing agent evenly spread in the felt is thus surely supplied to the oil application roller 16.

In the present applying mechanism, the edge portion 50 is formed at the end part of the oil supplying paths (guide sections 62) on the guide sheet 33.

With this, the oil can be carried towards the oil application roller 16, immediately after the oil climbs over the edge portion 50. Thus the oil evenly spread at the edge portion 50 can be carried towards the oil application roller 16. In other words, it is possible to prevent the oil from being unevenly carried towards the oil application roller 16, after the oil climbs over the edge portion 50.

In the present applying mechanism, the guide sheet 33 has the slits 61 extending from the oil storage and towards the contact point C with the pipe 31.

This allows the oil discharged from the pipe 31 to enter the back surface side (the side opposite to the side of contacting the pipe 31) of the guide sheet 33, via the slits 61. On this account, the oil can be supplied to the felt 25 via the both surfaces of the guide sheet 33 and via the felt supporter 25*a*, and hence the speed of supplying the oil can be increased.

In the present applying mechanism, the slits 61 extends over the contact point C with the pipe 31. That is to say, the oil discharged from the pipe 31 trickles down on the outer surface of the pipe 31 on the both sides of the vertical line S passing through the center of the pipe 31, and the oil is then caught by the guide sheet 33 at the both sides of the contact point between the pipe 31 and the guide sheet 33.

The oil dropping on the side of the guide sheet 33 close to the felt supporter 25*a* (felt 25; oil application roller 16) flows on the guide sheet 33 and consequently reaches the felt supporter 25*a*.

On the other hand, if no modifications are made, the oil dropping on the side far from the felt supporter 25*a* cannot flow to the felt supporter 25*a*, because of the presence of the contact point C between the pipe 31 and the guide sheet 33.

To solve this problem, the slits 61 are made on the guide sheet 33 so as to cross over the contact point C between the guide sheet 33 and the pipe 31. With this, the oil dropping on the side far from the felt supporter 25*a* can enter the back surface side of the guide sheet 33 via the slits 61, so that the oil can be supplied to the felt supporter 25*a* via the back surface of the guide sheet 33. This makes it possible to prevent the oil from being accumulated between the guide sheet 33 and the pipe 31.

In the present applying mechanism, the guide sheet 33 connects the pipe 31 from which the oil is discharged with the felt 25 and the felt supporter 25*a* that supply the oil to the oil application roller 16. Using this guide, the oil is carried from the pipe 31 to the felt 25.

According to this arrangement, the guide sheet 33 is placed below the felt supporter 25*a*, and the guide sheet 33 has the deposited part where the felt supporter 25*a* and the guide sheet 33 are deposited. In other words, the guide sheet 33 is deposited on the felt supporter 25*a* in such a manner that the guide sheet 33 locates underside of the felt supporter 25*a*. That is, at the deposited part, there are two layers arranged such that the felt supporter 25*a* locates on the top side of the guide sheet 33.

When the oil arrives at the deposited part via the guide sheet 33, the edge portion 50 of the felt supporter 25*a* blocks the oil. On this account, the oil storage is formed along the felt supporter 25*a* (along the longitudinal direction of the pipe 31). Therefore, after the oil is evenly spread in the oil storage, the oil climbing over the edge portion 50 of the felt supporter 25*a* can be carried towards the oil application roller 16.

Incidentally, it is possible to prevent the oil from dropping from the both ends of the guide sheet 33 in the longitudinal direction, by forming walls on the both ends of the guide sheet 33.

The oil dropping from the both ends, however, can be collected by the oil pan 26, as the redundant oil. On this account, it is unnecessary to form the walls or the bump sections 82. In this case, supplying an increased amount of oil prevents the shortage of the oil supply and makes it possible to stably supply the oil to the oil application roller 16.

In the present applying mechanism, the felt supporter 25*a* is fixed to the steel plate 300 with the bottom portion 53 of the guide sheet 33 being interposed therebetween, and from this point of fixation, the guide sheet 33 extends away from the oil application roller. 16 with respect to the vertical line S, and then the guide sheet 33 is folded towards the oil application roller 16 with respect to the vertical line S, and consequently touches the lower part of the pipe 31.

In short, in the present applying mechanism, the pipe 31 is in touch with the guide sheet 33. For this reason, at the contact point (line) between the pipe 31 and the guide sheet 33, the oil discharged from the pipe 31 is spread by the surface tension along the longitudinal direction of the pipe 31 (i.e. in the direction of the length of the pipe 31), and then the oil is supplied to the felt 25.

On this account, the oil discharged from the pipe 31 can be evenly supplied to the whole length (entirety) of the felt 25 (and the oil application roller 16). It is therefore possible to extremely evenly apply the oil to the entirety of the fixing roller 11 (i.e. the amount of the applied oil is balanced).

In the foregoing arrangement, the guide sheet 33 is provided with the slits 61 extending from the fixed bottom portion 53 and towards the contact point with the pipe 31.

With this, the oil discharged from the pipe 31 can enter the back surface side of the guide sheet 33, via the slits 61. It is therefore possible to supply the oil to the felt 25, using the both surfaces of the guide sheet 33. The speed of supplying the oil is therefore increased.

In the present applying mechanism, the guide sheet 33 is connected with the felt supporter 25*a* and the felt 25, and the oil is supplied to the oil application roller 16 via the felt 25. Alternatively, the following arrangement may be adopted: the guide sheet 33 is provided with a partition portion jutting along the longitudinal direction of the pipe 31, and the oil is blocked by this partition section so that the oil storage is formed.

In this case, the oil storage is preferably formed at the end part of the guide sheet 33. This end part indicates the end portion on the side close to the oil application roller 16 (i.e. on the side far from the pipe 31; the lowest stream of the oil supplying paths on the guide sheet 33).

With the arrangement above, it is possible to supply the oil to the oil application roller 16, immediately after the oil spills over from the oil storage. On this account, the evenly spread oil can be certainly supplied to the oil application roller 16. In other words, it is possible to prevent the oil from being unevenly carried towards the oil application roller 16, after the oil spills over from the oil storage.

In the present applying mechanism, the height of the edge portion 50 is 0.2 mm. In the present applying mechanism, the height of the partition section provided on the guide sheet 33 or the height of the felt supporter 25*a* at the deposited part where the guide sheet 33 and the felt supporter 25*a* are deposited is preferably not less than 0.025 mm and not more than 0.5 mm.

If the thickness of the felt supporter 25*a* (edge portion 50) is too thick, i.e. of the height of a member of blocking the oil on the guide sheet 33 is too high, the oil cannot climb over the felt supporter 25*a*, so as to flow to the both ends of the guide sheet 33 in the longitudinal direction. It is therefore impossible to efficiently supply the oil towards the oil application roller 16.

In the meanwhile, if the aforesaid height is too low, the felt supporter 25*a* cannot suitably block the oil, so that the oil climbs over the felt supporter 25*a* before the oil is evenly spread along the longitudinal direction of the guide sheet 33. It is therefore impossible to evenly supply the oil to the oil application roller 16.

For the reasons above, when the thickness of the felt supporter 25*a* (edge portion 50) falls within the range between 0.025 mm and 0.5 mm, the oil can be evenly spread in the longitudinal direction, and the evenly-spread oil can be supplied to the oil application roller 16.

Note that, in accordance with the viscosity of the oil, the height of the partition section and the thickness of the felt supporter 25*a* are determined to the extent that the oil can climb over them.

In the present applying mechanism, the edge portion 50 forms the dam (partition) so as to block the oil, and forms the oil storage along the longitudinal direction of the pipe 31. The oil storage, however, may be formed as a groove extending along the longitudinal direction of the pipe 31.

When the oil discharged from the pipe 31 flows through the oil supplying paths (guide sections 62) on the guide sheet 33, the oil is accumulated in the aforesaid groove. The oil guided to this groove flows along the groove (i.e. along the longitudinal direction of the pipe 31, the oil application roller 16, and the fixing roller 11), until the groove brims over. In this manner, the oil storage can be formed along the groove.

According to this arrangement, the oil evenly spread by the groove crosses over the groove (i.e. spills over from the groove), and is carried towards the oil application roller 16. In this manner, by the oil storage formed along the groove, the oil spread along the longitudinal direction of the pipe can be supplied to the oil application roller.

On this account, after the oil is evenly spread along the longitudinal direction of the pipe 31, the oil can be carried towards the oil application roller.

However, when the guide sheet 33 has a groove, the felt supporter 25*a* is deposited above the guide sheet 33 at the deposited part, so that the guide sheet 33 cannot be pressed as in the case of forming the dam or the partition section on the guide sheet 33.

In the present applying mechanism, a part of the guide sheet 33 avoids the high-temperature oil application roller 16 (i.e. bypasses the oil application roller 16).

Figure 11:
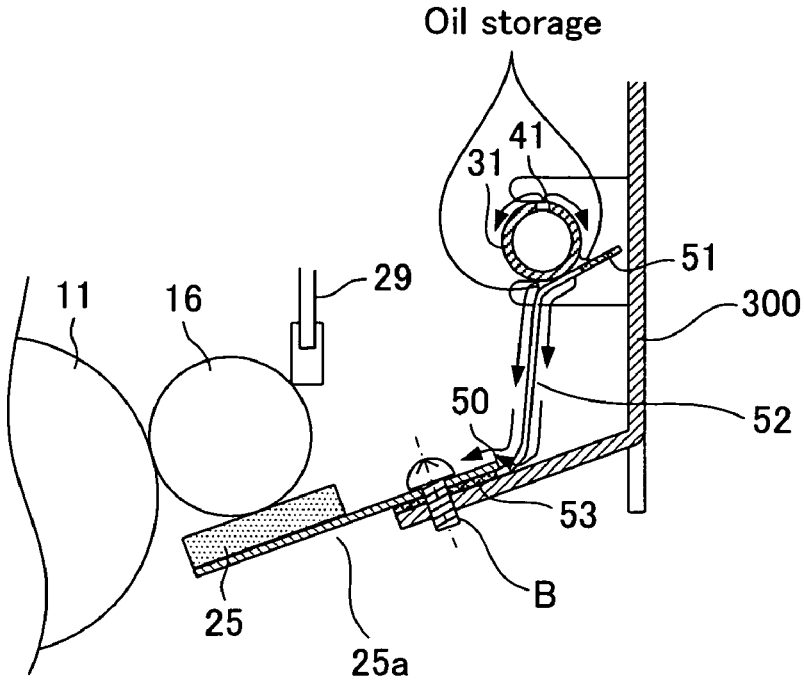
FIG. 11 is a cross section of a pipe section of an oil applying mechanism of a further embodiment of the present invention.

It is, however, possible to adopt such an arrangement that the guide sheet 33 does not bypass the oil application roller 16. That is to say, as long as the guide sheet 33 has the oil storage on the oil supplying paths and the oil is carried towards the oil application roller 16 after being spread along the longitudinal direction of the pipe 31, any types of arrangements can be adopted. For instance, an oil applying mechanism shown in FIG. 11 may be adopted. FIG. 11 is a cross section of the oil applying mechanism. As in the figure, this applying mechanism is arranged in such a manner that the guide sheet 33 is S-shaped from and the pipe 31 towards the felt supporter 25*a*. According to this arrangement, the oil discharged from the pipe 31 can be evenly supplied to the whole length (entirety) of the oil application roller 16, in a manner similar to the above. It is therefore possible to extremely evenly apply the oil to the entirety of the fixing roller 11 (i.e. the amount of the applied oil is balanced).

When the guide sheet 33 is thin, the present applying mechanism is preferably dealt with in such a manner as to avoid the deformation of the guide sheet 33.

In the present applying mechanism, the guide sheet 33 and the pipe 31 are caused to be in touch with each other by the elasticity (repulsive force) of the guide sheet 33. The assembly of the present applying mechanism involves the effect against the repulsive force of the guide sheet 33, so that the guide sheet 33 is liable to the deformation.

To prevent this, it is preferable to put a double-faced adhesive tape on the contact surface between the bottom portion 53 and the felt supporter 25*a*, on the occasion of assembling the present applying mechanism. It is also preferable to fold the guide sheet 33 so as to touch the pipe 31, with the guide sheet 33 being tentatively adhered to the felt supporter 25*a*. With this, the guide sheet 33 can be efficiently attached, and the deformation of the guide sheet 33 can be prevented.

It is preferable that the widths (lengths in the longitudinal direction) of the oil application roller 16 and the felt 25 be slightly longer than the width of a printer sheet having the maximum size. Also, it is preferable that the width of the blade 29 be broader than the width of the oil application roller 16, and the width of the fixing roller 11 be substantially identical with the width of the oil application roller 16. Furthermore, the width of the pressure roller 12 is broader than the width of the fixing roller 11 (see FIG. 10).

The present invention can be rephrased as the following first to eighth releasing agent supplying apparatuses, first fixing device, and a first image forming apparatus. That is to say, the first releasing agent supplying apparatus is arranged in such a manner that, a releasing agent is supplied to a fixing device including a fixing section made up of a rotative fixing roller and a pressure roller pressurized to and closely contacting the fixing roller, and from a plurality of holes provided in the axial direction and made on the upper surface of a pipe-shaped member that is provided on the upper part of the fixing roller, a releasing agent supplied from a releasing agent supply pump spills over from the holes and is supplied to at least one of the fixing roller and the pressure roller, via intermediate guide means, and in this releasing agent supplying apparatus, the releasing agent supplied from the guide member forming the intermediate guide means climbs over a dam. According to this arrangement, the dam is provided on the releasing agent supplying paths of the guide member, so that the releasing agent guided by the guide member can be again spread in the longitudinal direction and equalized in thickness. On this account, it is possible to make the releasing agent be even, even if the amount of the releasing agent guided by the guide member is uneven.

The second releasing agent supplying apparatus is arranged in such a manner that, in the first releasing agent supplying apparatus, the dam locates at the end portion of the releasing agent supplying paths on the guide member. When the dam locates at the end portion of the releasing agent supplying paths on the guide member, the unevenness generated in the course of guiding the releasing agent on the guide member can be made even, and the releasing agent is supplied to the next member.

The third releasing agent supplying apparatus is arranged in such a manner that, in the second releasing agent supplying apparatus, the aforesaid dam is formed by a supporting member that supports a supplying member that elastically contacts the fixing roller or an application roller member for applying the releasing agent to the fixing roller, and supplies the releasing member to the supplying member. According to this arrangement, the dam is formed by the supporting member that elastically supports the supplying member for supplying the releasing agent to the supply target. On this account, after making the releasing agent guided by the guide member be even by the dam, the releasing agent climbing over the dam can be evenly supplied to the supply target.

The fourth releasing agent supplying apparatus is arranged in such a manner that, in the third releasing agent supplying apparatus, the supporting member is formed by a thin steel plate having resilience, and at the end part of the thin steel plate, the aforesaid dam is formed. According to this arrangement, the supporting member is made up of the thin steel plate having resilience so that the supplying member is stably in touch with the supply target, and the supplying member is in touch with the supply target with sufficient resilience even if a thin plate is used. On this account, the height of the dam can be restrained and the spreadability of the releasing agent in the longitudinal direction can be obtained without obstructing the guiding of the releasing agent by the dam.

The fifth releasing agent supplying apparatus is arranged in such a manner that, in the first to fourth releasing agent supplying apparatuses, the dam is wider in the longitudinal direction than the total widths of the guide sections of the guide member that guides the releasing agent on the guide member. According to this arrangement, since the releasing agent easily spreads, it is possible to sufficiently perform the spreading in the longitudinal direction by the dam, even if the guide sections guiding the releasing agent are slightly narrower than the width of the supply target. For this reason, the widths of the guide sections can be restrained and hence the size of the releasing agent supplying apparatus can be reduced in the longitudinal direction, and it is possible to reduce an amount of the releasing agent that cannot be used effectively because it spreads too broadly towards the both sides in the longitudinal direction, so that the supply of the releasing agent is performed efficiently.

The sixth releasing agent supplying apparatus is arranged in such a manner that, in the fifth releasing agent supplying apparatus, the guide member has a tip portion where the end portion of the supporting member overlaps and fixes the tip portion, and the width of the tip portion is not narrower than the width of the supporting member that forms the dam, and a tip of the tip portion of the guide member in the lateral direction extends over the tip of a base below the guide member. According to this arrangement, the tip portion of the guide member is supported and clipped by the supporting member, the width of the tip portion is not narrower than the width of the supporting member in the longitudinal direction, and the tip of the tip portion of the guide member in the lateral direction extends over the supporting member and the tip of the base to which the guide member is fixed. On this account, the supporting member can be stably fixed to the base, without being tilted.

The seventh releasing agent supplying apparatus is arranged in such a manner that, in the fifth releasing agent supplying apparatus, the releasing agent spilling over from the pipe-shaped member spreads along the longitudinal direction of the pipe-shaped member, by the outer surface of the pipe-shaped member and the guide member being in touch with the pipe-shaped member, and by the openings as the partition sections for dividing, in the longitudinal direction, the guide sections formed on the guide member, the spread releasing agent is guided on the both surfaces of the guide sections with the spread state being maintained, and in this seventh releasing agent supplying apparatus, the partition sections extend beyond the dam and towards the lower side of the supporting member. According to this arrangement, the releasing agent spread in the longitudinal direction by the pipe-shaped member and the guide member being in touch with the pipe-shaped member is guided on the both surfaces of the guide sections, with the spread state being maintained, by partitioning the releasing agent to a plurality of parts by the openings. The releasing agent cannot be guided at the partition sections, and thanks to the dam the releasing agent guided on the back surface side can easily return to the front surface side through the openings. For this reason, the releasing agent can be supplied in an even manner.

The eighth releasing agent supplying apparatus is arranged in such a manner that, in the first to seventh releasing agent supplying apparatuses, the both ends of the tip portion of the guide member in the longitudinal direction protrude (stick out) over the dam and towards the releasing agent supplying side, and a second partition section is formed between the both ends and the guide member. According to this arrangement, the both ends of the tip portion of the guide member protrude over the dam and towards the releasing agent supplying side, and the second partition section is formed between the both ends and the guide member, so that the releasing agent is restrained from flowing along the dam and towards the both ends in the longitudinal direction, and the reduction of the efficiency of the supply of the releasing agent can be prevented.

The first fixing device is a fixing device including a fixing section made up of a rotative fixing roller and a pressure roller pressurized to and closely in touch the fixing roller, and from the holes that are provided on the top surface of the fixing roller and aligned along the axial direction, the releasing agent supplied from the releasing agent supply pump spills over from the holes, and the releasing agent is supplied to at least one of the fixing roller and the pressure roller, via the intermediate guide means, and this fixing device is provided with any one of the first to eighth releasing agent supplying apparatuses. According to this arrangement, the fixing device can obtain the aforesaid effects. The tenth releasing agent supplying apparatus includes the first fixing device. According to this arrangement, the aforesaid effects can be obtained by an image forming apparatus including the aforesaid first fixing device, so that image formation is suitably performed.

As described above, in the present applying mechanism, the releasing agent guide has, on the releasing agent supplying paths, a protrusion extending along the longitudinal direction of the pipe. With this, a releasing agent storage is formed.

According to this arrangement, when the releasing agent discharged from the pipe flows on the releasing agent supplying paths on the releasing agent guide, the releasing agent is blocked by a protruding section provided on the paths. In other words, this protruding section is a "dam" formed on the releasing agent guide.

The releasing agent blocked by the protruding section flows along the protruding section, i.e. along the longitudinal direction of the protruding section (i.e. the longitudinal direction of the releasing agent application roller and the fixing roller; towards the both ends of the protruding section in the longitudinal direction). With this, the releasing agent storage is formed along the longitudinal direction of the protruding section.

In this arrangement, the releasing agent evenly spread by the protruding section crosses over the protruding section and flows towards the releasing agent application roller. In this manner, the releasing agent spread along the longitudinal direction of the pipe by the releasing agent storage formed by the protruding section can be supplied to the releasing agent applying roller.

The present applying mechanism may be arranged in such a manner that, the releasing agent guide is provided with an applying member by which the releasing agent is applied to the releasing agent application roller, the applying member is placed on the supporting member, the supporting member has a deposited part where the supporting member and the releasing agent guide are deposited, and the protruding section is made up of the supporting member at the deposited part.

According to this arrangement, on the releasing agent guide (in the releasing agent supplying paths), the deposited part where the supporting member on which the applying member is placed and the releasing agent guide are deposited is formed. On the releasing agent guide, moreover, the supporting member is superposed from above. That is to say, the supporting member protrudes with respect to the releasing agent guide, so that the supporting member functions as the protruding section. On this account, the releasing agent flowing on the releasing agent guide is blocked by the supporting member at the deposited part, and hence the releasing agent evenly spreads along the longitudinal direction of the supporting member. For this reason, it is possible to form the releasing agent storage along the longitudinal direction of the supporting member.

According to the arrangement above, furthermore, the releasing agent evenly spread at the deposited part can be carried towards the releasing agent application roller, over the deposited part (i.e. over the supporting member at the deposited part).

In the present applying mechanism, in the longitudinal direction, the width of the protruding section is preferably wider than the total widths of the releasing agent supplying paths up until the protruding section on the releasing agent guide.

As described above, the protruding section spreads the releasing agent along the longitudinal direction of the protruding section. On this account, even if the total widths of the releasing agent supplying paths up until the protruding section on the releasing agent guide are narrower than the width of the protruding section in the longitudinal direction, the protruding section can spread the releasing agent along the longitudinal direction of the protruding section. It is therefore possible to restrain the size of the releasing agent supplying paths up until the protruding section on the releasing agent guide.

It is possible to supply a larger amount of the releasing agent towards the releasing agent application roller over the protruding section, by widening the width of the protruding section in the longitudinal direction. With this, it is possible to restrain the amount of the releasing agent flowing along the longitudinal direction of the releasing agent guide and not arriving at the releasing agent application roller. This makes it possible to efficiently supply a large amount of the releasing agent to the releasing agent application roller.

The present applying mechanism is preferably arranged in such a manner that, at the deposited part, the supporting member is fixed to the releasing agent guide, and the width of the releasing agent guide in the longitudinal direction is designed so as to be wider than the width of the supporting member in the longitudinal direction.

According to this arrangement, at the deposited part, the supporting member is fixed to the releasing agent guide, and the width of the releasing agent guide in the longitudinal direction is designed so as to be wider than the width of the supporting member in the longitudinal direction, the releasing agent guide being provided below the supporting member. In other words, at the deposited part, the both ends of the releasing agent guide protrude in the longitudinal direction. With this, a part where the releasing agent guide is fixed to the supporting member can be widened. This makes it possible to stably fix the supporting member to the releasing agent guide.

The present applying member is preferably arranged in such a manner that, the both ends of the releasing agent guide at the deposited part are provided with bump sections jutting over the supporting member and towards the upstream of the releasing agent supplying paths.

According to this arrangement, at the deposited part, the both ends of the releasing agent guide in the longitudinal direction are provided with the bump sections jutting over the supporting member and toward the upstream of the releasing agent supplying paths (i.e. towards the pipe side).

On this account, when the releasing agent blocked by the supporting member spreads along the longitudinal direction of the supporting member, the bump sections stop the flow of the releasing agent. In other words, the flow of the releasing agent towards the both ends of the releasing agent guide in the longitudinal direction is stopped by the bump sections. On this account, it is possible to prevent the releasing agent from flowing towards the both ends of the releasing agent guide in the longitudinal direction. Therefore, it is possible to prevent the reduction of the efficiency of the supply of the oil towards the releasing agent application roller.

In the present applying mechanism, the supporting member is preferably made of metal having elasticity.

As described above, the applying member placed on the supporting member applies the releasing agent to the releasing agent application roller. On this account, the applying member can be surely in touch with the releasing agent application roller in an elastic manner, by adopting the supporting member made of metal having elasticity. It is therefore possible to certainly supply, to the releasing agent application roller, the releasing agent that has been evenly spread in the applying member.

In the present applying mechanism, the height of the protruding section preferably falls within the range of 0.025 mm and 0.5 mm.

If the height of the protruding section for blocking the releasing agent is too high on the releasing agent supplying paths on the releasing agent guide, the releasing agent cannot climb over the protruding section, so that the releasing agent flows towards the both ends of the releasing agent guide in the longitudinal direction. In this case, it is not possible to efficiently supply the releasing agent to the releasing agent application roller.

On the other hand, if the height of the protruding section is too low, the releasing agent cannot be sufficiently blocked, so that the releasing agent climbs over the protruding section before being evenly spread along the longitudinal direction of the releasing agent guide. In this case, it is not possible to evenly supply the releasing agent to the releasing agent application roller.

To solve this problem, when the height of the protruding section falls within the range between 0.025 mm and 0.5 mm, the releasing agent can be evenly spread along the longitudinal direction of the protruding section, and the releasing agent having been evenly spread can be carried towards the releasing agent application roller.

Note that, in accordance with the viscosity of the releasing agent, the height of the protruding section is determined to the extent that the releasing agent can climb over the same.

The present applying mechanism may be arranged in such a manner that the protruding section is formed at the end part of the releasing agent supplying paths on the releasing agent guide.

This end part indicates an end portion on the side close to the releasing agent application roller (on the side far from the pipe; the lowest stream of the releasing agent supplying paths on the releasing agent guide).

With the arrangement above, it is possible to supply the releasing agent to the releasing agent application roller, immediately after the releasing agent climbs over the protruding portion and starts to flow. On this account, the evenly-spread releasing agent can be certainly supplied to the releasing agent application roller. In other words, it is possible to prevent the releasing agent from being unevenly carried towards the releasing agent application roller, after the releasing agent climbs over the protruding portion and starts to flow.

The present applying mechanism may be arranged in such a manner that the releasing agent guide is provided with slits extending from the releasing agent storage towards the contact point with pipe.

According to this arrangement, the releasing agent discharged from the pipe can enter the back surface side of the releasing agent guide, via the slits. On this account, the releasing agent can be supplied to the applying member via the both surfaces of the releasing agent guide, so that the speed of supplying the releasing agent can be increased.

Note that, in this arrangement, the releasing agent flows on parts (between the slits; guide sections) of the releasing agent guide where the slits are not formed.

In this arrangement, the slits preferably extend beyond the contact point with the pipe.

That is, the releasing agent discharged from the pipe trickles down on the outer surface of the pipe, and at the both side of the contact point between the pipe and the releasing agent guide, the releasing agent is caught by the releasing agent guide.

Note that, the both sides of the contact point between the pipe and the releasing agent guide indicate (i) a side of the releasing agent guide close to the applying member and (ii) a side of the releasing agent guide crossing over the aforesaid contact point from the applying member (i.e. a side far from the applying member). By the way, "close to (far from) the applying member" indicates the length from the pipe to the applying member, measured along the releasing agent guide, so that this length is nothing to do with the actual length.

The releasing agent dropping on the side of the releasing agent guide close to the applying member flows on the releasing agent guide and reaches the applying member.

On the other hand, if no measures are taken, the releasing agent dropping on the side of the releasing agent guide far from the applying member cannot flow to the applying member, because the contact point between the pipe and the releasing agent guide exists on the paths to the applying member.

To solve this problem, the slits are made on the releasing agent guide in such a manner as to get across the contact point with the pipe. With this, the releasing agent dropping on the side far from the applying member passes through the slits and reaches the back side of the releasing agent guide, so that the releasing agent is supplied to the applying member via the back side. On this account, it is possible to avoid the accumulation of the releasing agent between the releasing agent guide and the pipe.

The present applying mechanism may be arranged in such a manner that the releasing agent storage may be formed by a groove extending along the longitudinal direction of the pipe.

According to this arrangement, the releasing agent guide is provided with the groove extending along the longitudinal direction of the pipe. When the releasing agent discharged from the pipe flows on the releasing agent supplying paths on the releasing agent guide, the releasing agent accumulates in the groove. Then the releasing agent guided to the groove flows along the longitudinal direction of the groove (i.e. the longitudinal direction of the pipe, the releasing agent application roller, and the fixing roller), until the groove brims over. In this wise it is possible to form the releasing agent storage along the groove.

In this arrangement, the releasing agent that is evenly spread by the groove crosses over (spills over from) the groove, and is carried toward the releasing agent application roller. In this manner, by the releasing agent storage formed as the groove, the releasing agent spread along the longitudinal direction of the pipe is carried toward the releasing agent application roller.

Thus, after being evenly spread along the longitudinal direction of the pipe, the releasing agent can be carried toward the releasing agent application roller.

Embodiment 3

Figure 12:
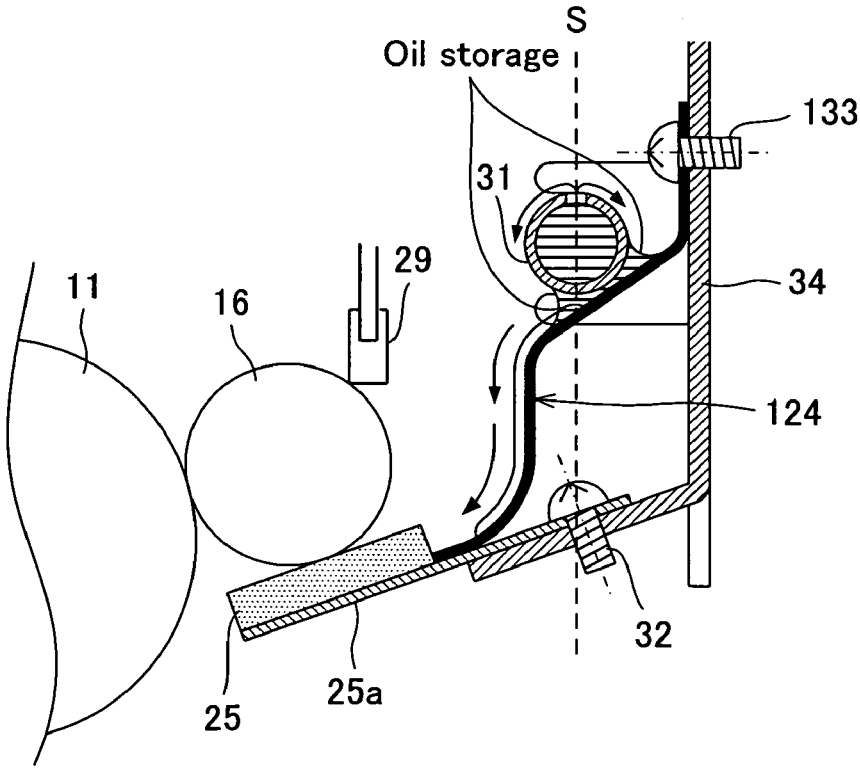
FIG. 12 is a cross section of a fixing device including an oil applying mechanism provided with a releasing agent guide of the embodiment of the present invention.
Figure 13:
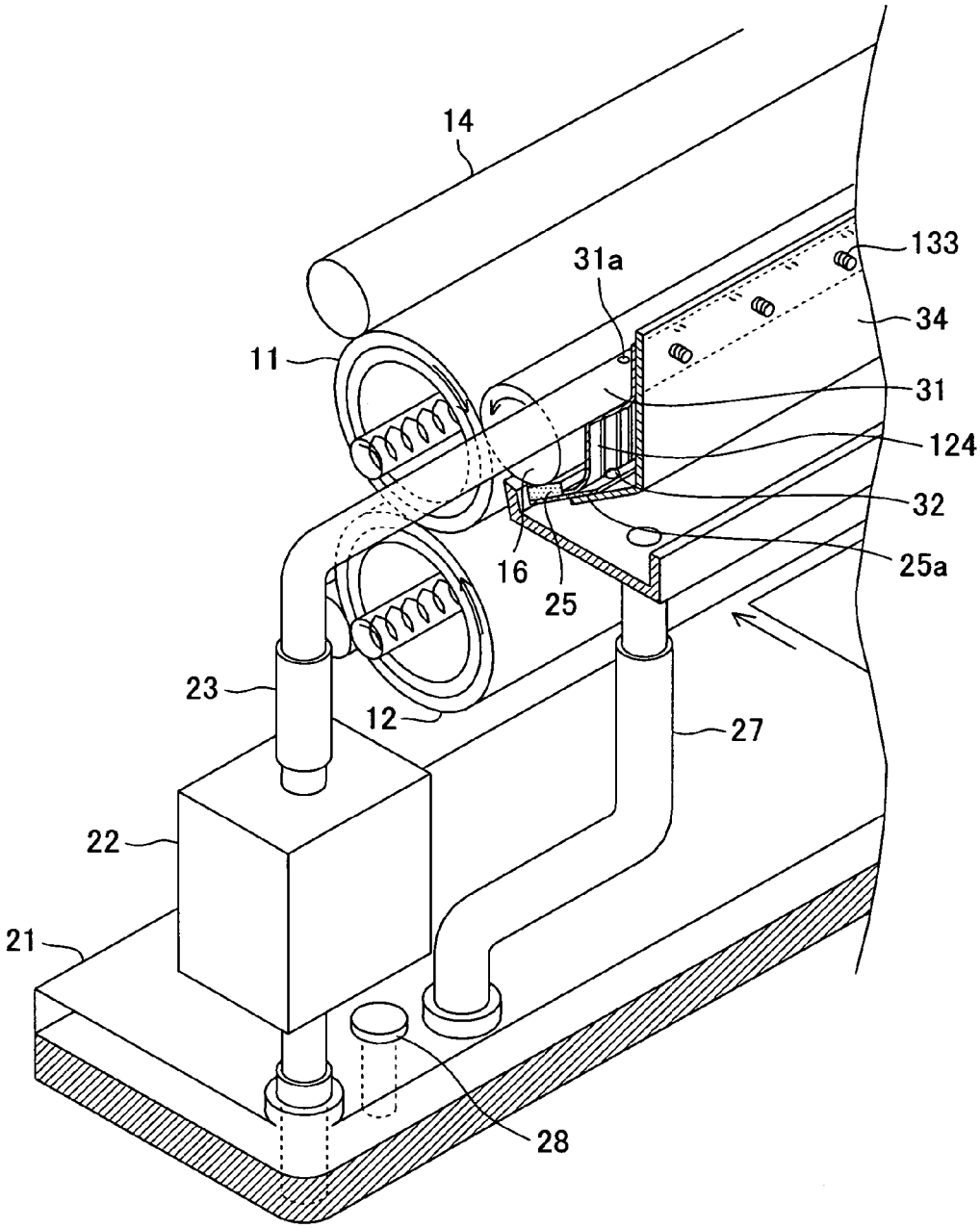
FIG. 13 is an oblique perspective view of a fixing device that is provided in the digital color photocopier shown in FIG. 2 and has the oil applying mechanism shown in FIG. 12.
Figure 14:
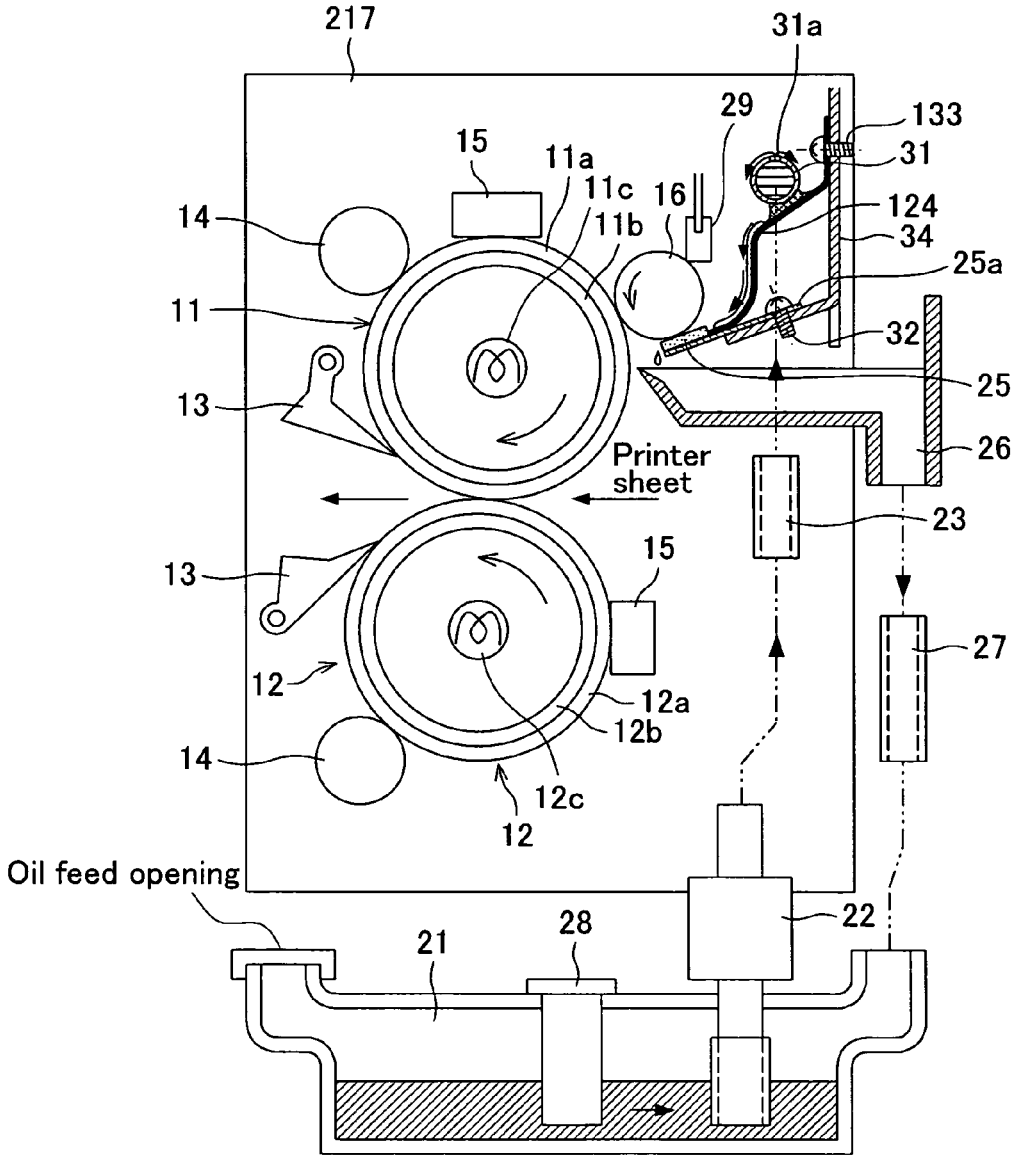
FIG. 14 is a front view of the fixing device that is provided in the digital color photocopier shown in FIG. 2 and has the oil applying mechanism shown in FIG. 12.

The following will discuss a further embodiment of the present invention. FIG. 12 is a cross section of a fixing device 217 including an oil applying mechanism provided with a releasing agent guide. FIG. 13 is an oblique perspective view of the fixing device 217. FIG. 14 is a front view of the fixing device 217. The fixing device shown in FIGS. 12, 13, and 14 is substantially identical with the fixing device shown in FIGS. 1, 3, 4, 6, 7, and 8, except that a guide sheet 124 is provided instead of the pipe section 24 in FIGS. 1, 3, 4, 6, 7, and 8.

An oil applying mechanism (present applying mechanism) provided in the fixing device 217 will be described.

The present applying mechanism locates sideways and below the rollers 11 and 12, and evenly applies silicone oil (releasing agent; hereinafter, this silicone oil will be simply referred to as oil) to the surface of the fixing roller 11.

Note that the oil used in the present applying mechanism is silicone oil and its kinetic viscosity at 25° C. is 100 cs.

As shown in FIG. 14, the present applying mechanism includes an oil tank 21, a pump 22, a tube-shaped member 23, a guide sheet 124, a felt 25, an oil pan 26, a tube-shaped member 27, an oil sensor 28, a blade 29, and a pipe 31, in addition to the aforesaid oil application roller 16.

The tube-shaped member 23 supplies, to the pipe 31, the oil having been sucked up by the pump 22.

The guide sheet (releasing agent guide) 124 is a plate-shaped sheet that is provided along the longitudinal direction of the fixing roller 11 and is substantially identical in length with the fixing roller 11. The sheet is shaped like a thin plate and has a surface on which the releasing agent can flow.

The guide sheet 124 bulges toward the oil application roller 16, in the vicinity of the pipe 31.

Moreover, the guide sheet 124 is provided so as to form a gap extending along the longitudinal direction of the pipe 31 (i.e. along the longitudinal direction of the fixing roller 11). That is to say, the guide sheet 124 and the pipe 31 are not closely in contact with each other, and there is a narrow gap therebetween in order to allow the oil to pass through. Note that, with the width of this gap formed between the pipe 31 and the guide sheet 124, a surface tension acts on the oil.

In the vicinity of the pipe 31, the guide sheet 124 is tilted toward the application roller 16. This allows the oil to flow easily.

One end of the guide sheet 124 (i.e. the end on the upstream side of the oil flow) is arranged so as to step over a vertical line S that passes through the center of the pipe 31.

The other end of the guide sheet 124 (i.e. the end on the lowest stream side of the oil flow) is arranged so as to be in touch with the felt supporter 25*a*.

The guide sheet 124 has such a function of causing the oil discharged from holes 31*a* of the pipe 31 to flow on the surface of the guide sheet 124 and reach the felt 25.

The end of guide sheet 124 on the upstream side of the oil flow is fixed to a supporter 34 by a connecting member (e.g. a screw) 133. The guide sheet 124 is made of a material that does not allow the oil to permeate the same (i.e. the material is resistant to the oil).

The felt 25 is a plate-shaped felt that is provided below the oil application roller 16 and along the longitudinal direction of the fixing roller 11, and is substantially identical in length with the fixing roller 11. The surface of the felt 25 is tilted and in touch with the oil application roller 16.

The felt 25 allows the oil, which has been discharged from the pipe 31 and supplied via the guide sheet, to permeate the entirety of the felt 25, and then supplies the oil to the entire surface of the oil application roller 16.

The felt 25 is placed on a felt supporter (applying member) 25*a* that is slightly larger than the felt 25 and made of resin or metal. This felt supporter 25*a* is screwed to the supporter 34 by a connecting member (e.g. a screw).

The pipe 31 is a hollow pipe provided along the longitudinal direction of the fixing roller 11 (i.e. in the direction perpendicular to the surface of FIG. 14) and is substantially identical in length with the fixing roller 11.

The pipe 31 is a hollow member that is provided above the application roller 16 and has a plurality of holes 31*a* provided at predetermined intervals. These holes 31*a* are aligned on the upper side (top) of the pipe 31, and from these holes 31*a* the oil supplied to the pipe 31 is discharged.

One end of the pipe 31 is connected to the aforesaid tube-shaped member 23 so that the oil is supplied through the same. Although not being illustrated, the other end of the pipe 31 (i.e. the lowest stream) is caulked (stamped by, for instance, a pressing machine) in order to prevent the oil leakage.

With the arrangement above, all of the oil supplied to the pipe 31 is discharged from the holes 31*a*.

The oil application roller 16 has a surface made of rubber, is in touch with the fixing roller 11, extends in parallel to the fixing roller 11, and is substantially identical in length with the fixing roller 11.

This oil application roller 16 rotates in accordance with the rotation of the fixing roller 11, so as to supply the silicone oil from the felt 25 to the surface of the fixing roller 11.

The blade 29 is a rubber-like member and provided for evenly smoothing out the oil on the surface of the oil application roller 16. In other words, the blade 29 causes the supplied oil to be shaped like a film.

Note that a part of the oil dropping on the felt 25 is not supplied to the oil application roller 16 but drops from discharging holes 25*b* made on the felt supporter 25*a* (see FIG. 16(*b*) that will be described later).

The releasing agent guide of the present applying mechanism will be discussed.

Figure 15:
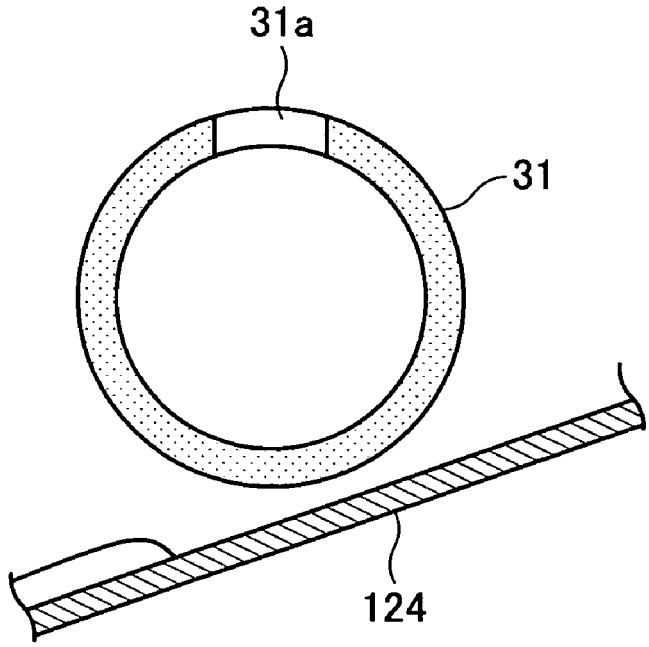
FIG. 15 is a cross section of the releasing agent guide shown in FIG. 12.

FIG. 12 is a cross section of the fixing device 217 including the present applying mechanism provided with the releasing agent guide. FIG. 15 is a cross section of the guide sheet 124 and the pipe 31 of the present applying mechanism. FIG. 16(*a*) is an expansion plan view of the releasing agent guide. FIG. 16(*b*) is a cross section of the releasing agent guide. Note that, in FIG. 16(*a*), a dotted line on the guide sheet 124 indicates the border between a plan view observed from the A direction in FIG. 16(*b*) and a plan view observed from the A' direction in FIG. 16(*b*).

As these figures illustrate, the releasing agent guide supplies the oil discharged from the pipe 31 to the oil application roller 16. The guide sheet 124 functions as a releasing agent guide of the present embodiment.

The guide sheet 124 includes guide sections 124*a* and partition sections 124*b*. The guide sheet being thus described is a polyethylene terephthalate 0.1 mm thick.

The guide sections 124*a* supply the oil discharged from the pipe 31 to the felt 25. These guide sections 124*a* neighbor to each other with the partition sections 124*b* being provided therebetween. One end of the guide section 124*a* (the end on the upstream side of the oil flow) is fixed to the supporter 34 by the connecting member 133.

The other end of the guide sheet 124 (the end on the downstream side of the oil flow) is fixed to the felt supporter 25*a*, towards the felt 25. This fixation is made not by the connecting member but by the elasticity of the guide sheet 124.

The partition sections (first protruding sections) 124*b* form the guide sections 124*a* by providing partitions, in the direction of the supply of the oil. On the surface (for supplying the oil) of the guide sheet 124, these partition sections 124*b* are provided at predetermined intervals and extend towards the direction of supplying the oil.

The partition sections 124*b* jut over the respective guide sections 124*a* and form protrusions, thereby acting as the walls between the neighboring guide sections 124*a*.

The height of the partition section 124*b* is determined on the ground of preventing the oil on the guide section 124*a* from climbing over the partition section 124*b* and entering the neighboring guide section 124*a*.

As described above, the guide sheet 124 is in touch with the felt supporter 25*a*, and the oil is supplied to the entire surface of the felt 25 via the felt supporter 25*a*.

Through the felt supporter 25*a*, the discharging holes 25*b* are made at predetermined intervals, and through these discharging holes 25*b* the redundant oil is collected by the oil pan 26.

The following will describe how the oil is applied to the fixing roller 11 in the present mechanism.

To apply the oil to the fixing roller 11, first, the pump 22 sucks up the oil from the oil tank 21, and supplies the oil to the pipe 31 via the tube-shaped member 23. The oil is stored in the pipe 31. When the amount of the oil exceeds the capacity of the pipe 31, the oil starts to be discharged from the holes 31*a*.

Figure 16:
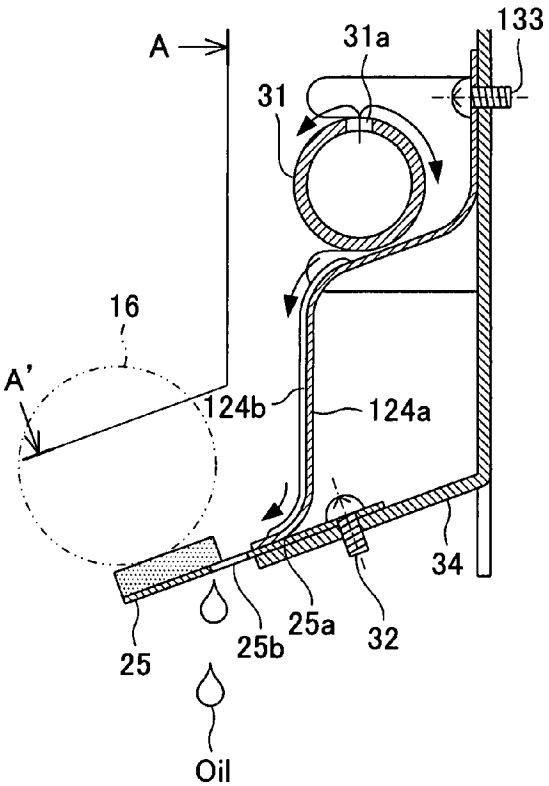
FIG. 16(*a*) is an expansion plan view of the releasing agent guide shown in FIG. 12.
Figure 16:
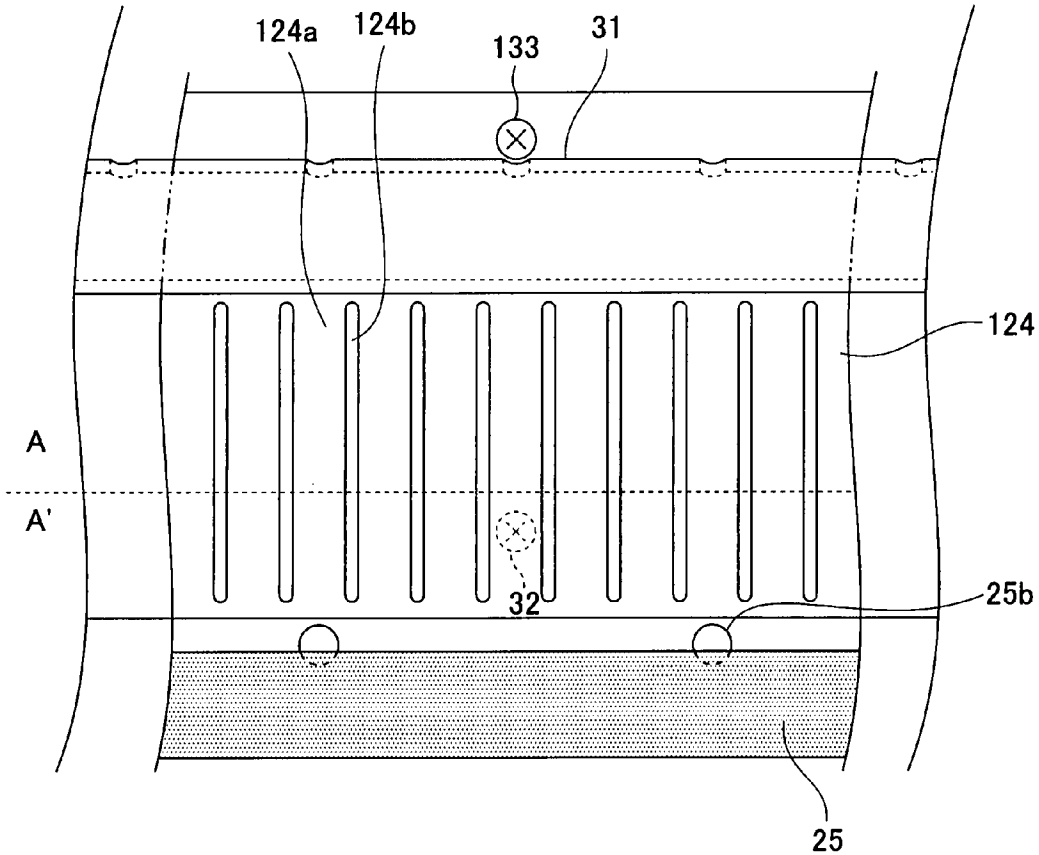

As shown in FIG. 16(*b*), the oil discharged from the holes 31*a* trickles down on the outer surface of the both sides of the pipe 31 (indicated by an arrow in FIG. 16(*b*)). The oil is evenly spread along the longitudinal direction of the pipe 31, at the gap formed below the pipe 31. The spread oil is then guided to the guide sheet 124.

The spread oil passes through the surfaces of the guide sections 124*a* of the guide sheer 24, and via the felt supporter 25*a* provided on the downstream (downward), the oil consequently reaches the felt 25, with the state of the spreading being maintained.

Subsequently, the oil is applied to the surface of the fixing roller 11, via the felt 25 and the oil application roller 16 (a virtual circle shown in FIG. 16).

As described above, in the present applying mechanism, the gap that allows the surface tension to act on the oil and extends along the longitudinal direction of the pipe 31 is formed between the pipe 31 and the guide sheet 124.

Therefore, to this gap, the oil spilling over from the holes 31*a* of the pipe 31 is guided, and on this occasion the oil is in contact with the guide sheet 124. On this oil guided to the gap, the surface tension acts. On this account, the oil can spread along the longitudinal direction of the gap (i.e. along the longitudinal direction of the pipe 31).

In the present applying mechanism, the oil can be supplied to the oil application roller 16, with the oil being maintained to spread along the longitudinal direction of the gap.

For this reason, in the present applying mechanism, the oil discharged from the pipe 31 can be evenly supplied to the whole length (entirety) of the application roller 16. With this, to the entirety of the fixing roller 11, the releasing agent can be applied extremely evenly (i.e. an amount of the applied releasing agent is balanced).

The guide sheet 124 is made of a material resistant to the oil. This material resistant to the oil indicates a material that can avoid the permeation of the oil (i.e. the material that does not allow the oil to permeate the same).

On this account, the oil does not permeate the inside of the guide sheet 124. For this reason, the oil guided by the guide sheet 124 flows on the whole of one surface (front surface; the surface to which the oil is guided) of the guide sheet 124. Since the back surface of the guide sheet 124 is not used for the supply of the oil, a required amount of the oil can be reduced. Moreover, the speed of supplying the oil to the felt 25 (felt supporter 25*a*) by the guide sheet 124 can be increased.

When the guide sheet 124 allows the oil to permeate the same, the oil permeates the inside of the guide sheet 124, so that the surface tension does not act on the oil. Also, the supply of the oil to the felt supporter 25*a* and the felt 25 is performed only after a sufficiently amount of oil has permeated the guide sheet 124. A large amount of the oil is therefore required at the time of starting (preparing for) the use of the present applying mechanism, and the preparation for the use takes time.

On the other hand, when the guide sheet 124 is resistant to the oil, it is unnecessary to cause the releasing agent to permeate the guide sheet 124. On this account, an amount of the oil required for the preparation can be reduced, and the time for the preparation can be significantly shortened.

In the present applying mechanism, one end of the guide sheet (i.e. the end on the upstream side of the oil flow) is designed so as to step over the vertical line S passing through the center of the pipe. This vertical line S passing through the center of the pipe is a virtual straight line vertically going down from the center of the pipe 31. With the arrangement above, the oil discharged from the both sides of the pipe 31 can be certainly guided to the guide sheet 124.

The present applying mechanism has the partition sections 124*b* that extend from the end of the guide sheet 124 on the felt supporter 25*a* side (i.e. from the end (bottom portion) of the guide sheet 124 on the downstream side of the oil flow; the end on the side of being in contact with the felt supporter 25*a*) and jut towards the pipe 31. In short, these partition sections 124*b* are partitions formed on the guide sheet 124.

On this account, the oil flows on areas partitioned by the partition sections 124*b* (i.e. flows between the partition sections 124*b*). The oil flowing on the guide sheet 124 does not climbs over the partition sections 124*b*. This makes it possible to avoid the oil to be mixed on the guide sheet 124. On this account, the oil evenly reaches the felt 25 and the felt supporter 25*a* (applying members), with the state of spreading along the longitudinal direction of the pipe 31 being maintained.

In the present applying mechanism the partition sections 124*b* may be in touch with the pipe 31.

According to this arrangement, between the partition sections 124*b* being in touch with the pipe 31, the aforesaid gap is formed. Since the partition sections 124*b* are in touch with the pipe 31, the guide sheet 124 is supported at the points of the contact. On this account, the gap whose width is substantially identical with the height of each partition section 124*b* is certainly formed, and this makes it easy to form the gap.

It is preferable that the pipe 31 have protruding sections 31*b* that protrude from the surface of the pipe 31, and this protruding sections 31*b* be in touch with the guide sheet 124.

This arrangement can be realized by forming, as the second protruding sections, a ring put on the pipe.

According to this arrangement, the aforesaid gap is formed between the protruding sections 31*b* being in touch with the guide sheet 124. Since the protruding sections 31*b* are in touch with the guide sheet 124, the guide sheet 124 is supported at the points of contact. On this account, the gap whose width is substantially identical with the heights of the protruding sections 31*b* is certainly formed, and this makes it easy to form the gap.

The guide sheet 124 is preferably in touch with the pipe 31 on account of the elasticity of the guide sheet 124. According to this arrangement, it is unnecessary to attach the guide sheet to the pipe 31 using, for instance, an adhesive. The present applying mechanism is therefore manufactured easily. Furthermore, it is possible to avoid the partial decrease of the spreadability (evenness) of the supplied oil because of the irregularity of the adhered parts (i.e. some parts are adhered while other are not). (The spreadability decreases if there is a part that is not properly adhered).

Also, it is possible to avoid the guide sheet 124 to be torn away from the pipe 31 due to the decrease of the adhesive property, during the use of the present applying mechanism. Furthermore, with the arrangement above, the guide sheet 124 can be easily replaced.

It is preferable that, at a part where the aforesaid gap is formed, the guide sheet 124 be on the slant with respect to the pipe 31. For instance, the guide sheet 124 is preferably on the slant with respect to the pipe 31, with the side close to the felt supporter 25*a* falling downward.

This state of "on the slant" is of course neither a horizontal state nor a perpendicular (vertical) state.

According to this arrangement, the guide sheet 124 inclines from the side close to the felt supporter 25*a* (felt 25) to the side far from the felt supporter 25*a*, with respect to the gap formed with the pipe 31.

This allows the oil, which is caught on the side of the guide sheet 124 close to the felt supporter 25*a* (felt 25), to flow to the felt supporter 25*a* (felt 25). Also, it is possible to prevent the oil, which is caught on the side far from the felt supporter 25*a* (felt 25), from flowing in the direction away from the felt supporter 25*a* (felt 25) on the guide sheet 124.

In the present applying mechanism, the releasing agent guide is provided with the guide sections 124*a* and the partition sections 124*b*.

The partition sections 124*b* are provided so as to jut along the direction of supplying the oil. With this, it is possible to prevent the oil supplied to one guide section 124*a* from mixing with the oil supplied to the neighboring guide section 124*a*. Thus, from the gap, the oil is supplied to the felt supporter 25*a* (application roller 16) with the state of evenly spread by the guide sections 124*a* being maintained.

In the present applying mechanism, the guide sheet 124 is supported so as to form the aforesaid gap. According to this arrangement, a member for forming the gap is not necessary, and the guide sheet 124 can be easily replaced.

In the present applying mechanism, the guide sheet 124 is on the slant towards the application roller 16 side. This makes it possible to smoothly supply the oil on the guide sheet 124.

In the present applying mechanism, the guide sheet 124 is made of a material that does not allow the oil to permeate the same. On this account, the oil can be supplied only on the front surface (one surface) of the guide sheet 124. Since the oil is not necessarily supplied via the both surfaces of the guide sheet 124, an amount of the required oil can be reduced. Moreover, it is unncessary to collect the oil tricking down on the back surface of the guide sheet 124.

In the present applying mechanism, the guide sheet 124 is fixed to the supporter 34 without using an adhesive. On this account, the aforesaid gap is always kept constant and the oil is stably supplied.

In the present applying mechanism, the width of the gap is narrow. On this account, even if the fixing device 217 is not used for a long period of time, toner, paper powder, dust, and the like do not adhere to the holes 31*a*.

In the present applying mechanism, the guide sheet 124 has high rigidity. On this account, the guide sheet 124 can be fixed to the supporter 34 by the elasticity, and hence the fixation and adhesion using a connecting member (e.g. a screw) and an adhesive are unnecessary.

In the present applying mechanism, the guide sheet 124 is made of a material that does not allow the oil to permeate the same. On this account, the oil can be supplied to the felt supporter 25*a* (felt 25) only via the guide sections 124*a* on the front surface. Since the oil is not necessarily supplied via the both surfaces of the guide sheet 124, an amount of the required oil can be reduced.

In the present applying mechanism, the partition sections 124*b* are provided on the front surface (surface for supplying the oil) of the guide sheet 124 at predetermined intervals and extend towards the direction of supplying the oil. The guide sections 124*a* are also formed at predetermined intervals. On this account, an amount of the oil supplied to the guide sections 124*a* is even. For this reason, it is possible to evenly supply the oil to the entirety of the felt 25.

Figure 17:
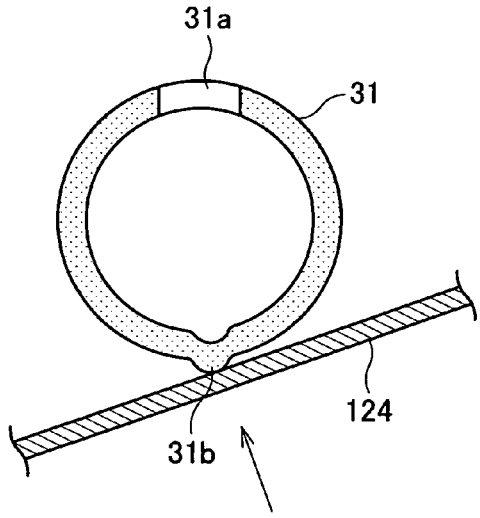
FIG. 17(*a*) is a cross section of another arrangement of the releasing agent guide in the oil applying mechanism of the embodiment of the present invention.
Figure 17:
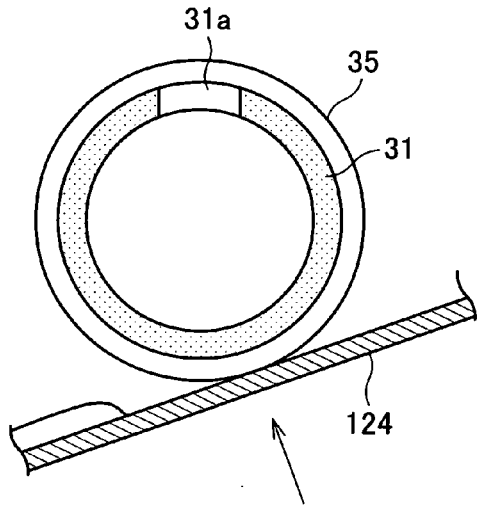
Figure 17:
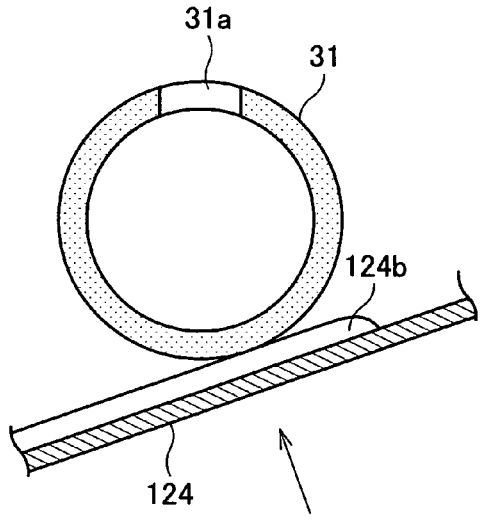
Figure 18:
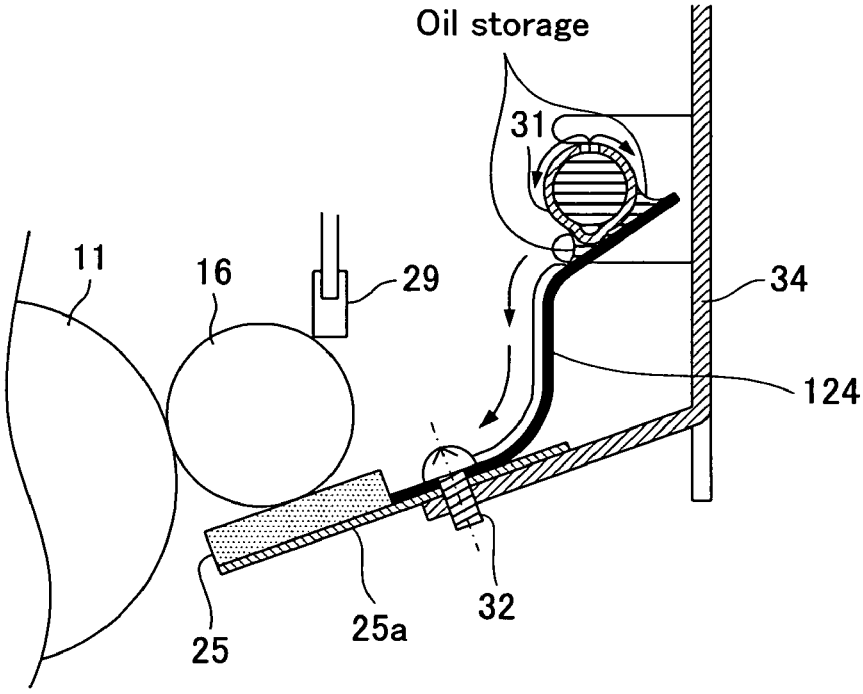
FIG. 18 is a cross section of the releasing agent guide shown in FIG. 17(*a*).
Figure 19:
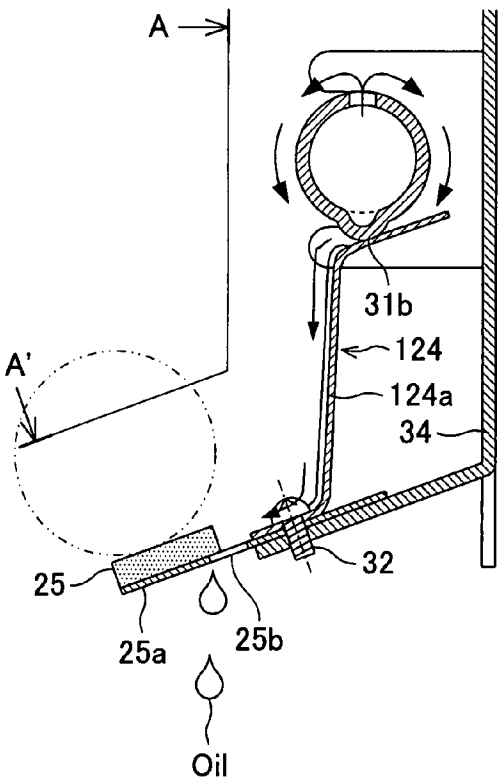
FIG. 19(*a*) is an expansion plan view of the releasing agent guide shown in FIGS. 17(*a*) and 18.
Figure 19:
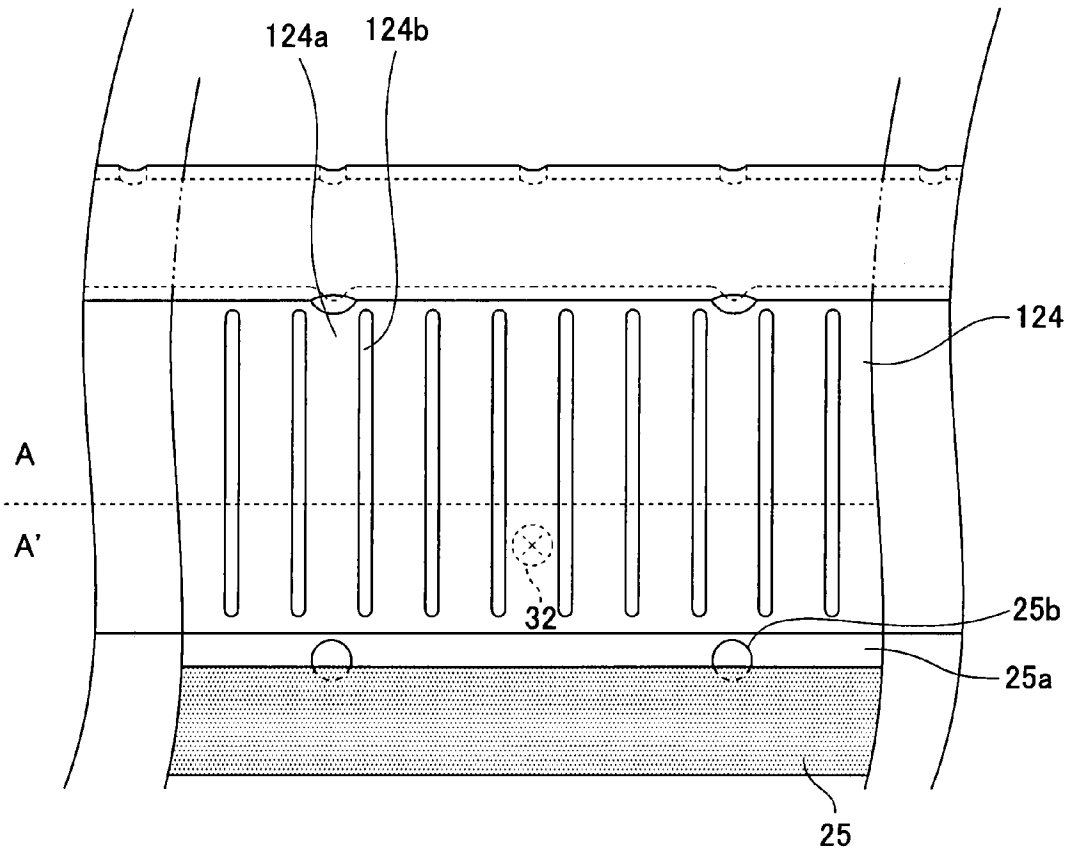
Figure 20:
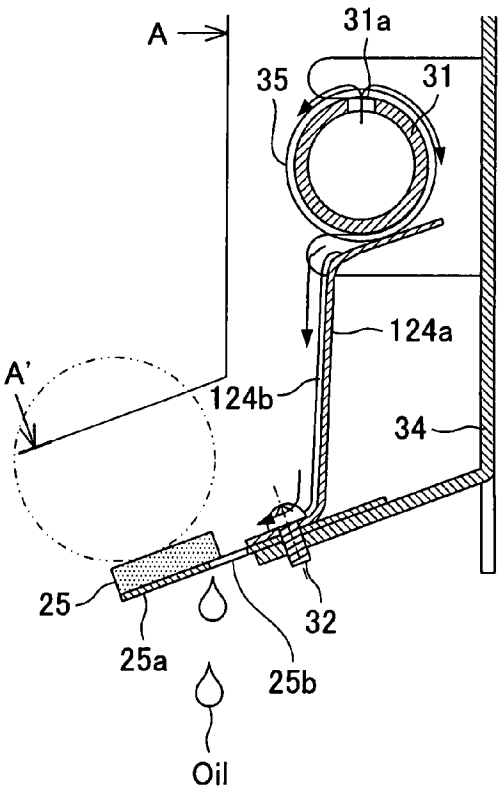
FIG. 20(*a*) is an expansion plan view of the releasing agent guide shown in FIG. 17(*b*).
Figure 20:
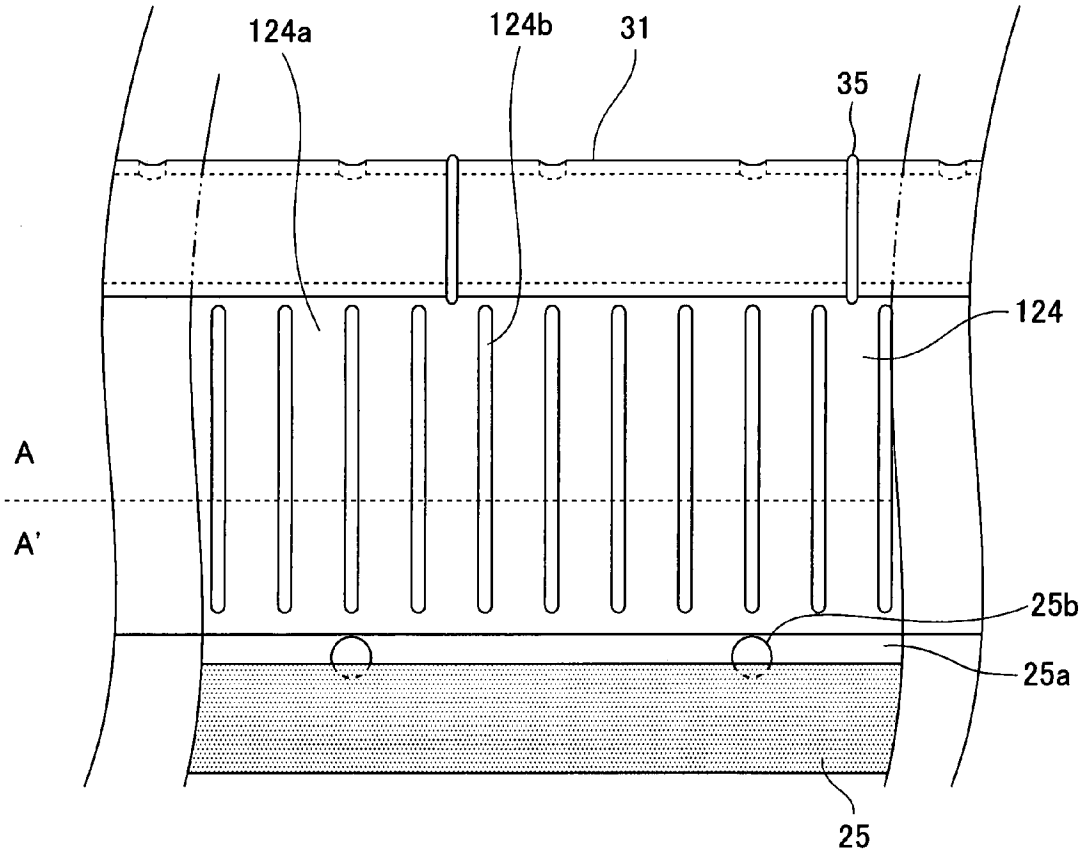
Figure 21:
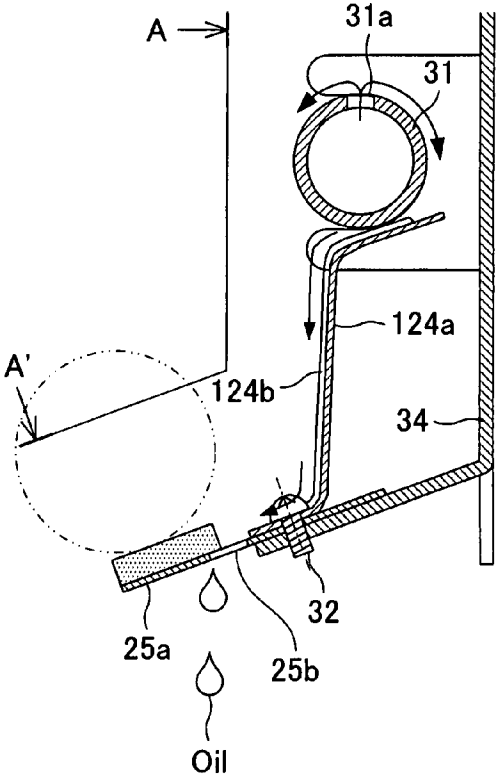
FIG. 21(*a*) is an expansion plan view of the releasing agent guide shown in FIG. 17(*c*).
Figure 21:
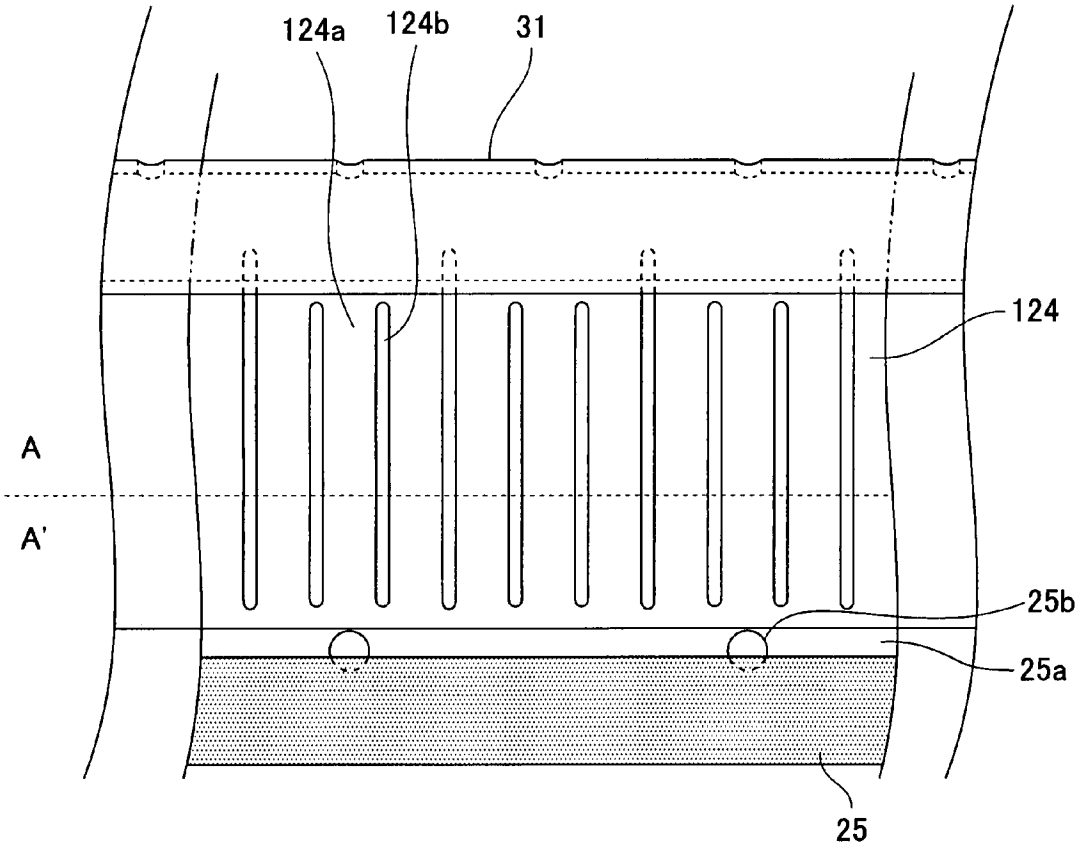

Note that, the gap between the guide sheet 124 and the pipe 31 may be formed in the following manners. FIGS. 17(*a*)-17(*c*) and 22 are cross sections of the guide sheets 124 and the pipes 31. FIGS. 19(*a*), 20(*a*), 21(*a*), and 23(*a*) are expansion plan views of the present applying mechanisms. FIGS. 19(*b*), 20(*b*), 21(*b*), and 23(*b*) are cross sections of the present applying mechanisms. FIG. 18 is a cross section of the applying mechanisms shown in FIGS. 17(*a*), 19(*a*), and 19(*b*).

Note that, as in FIG. 16(*a*), A and A' in FIGS. 19(*a*), 20(*a*), 21(*a*), and 23(*a*) indicate the borders of the plan views in the corresponding figures.

In FIGS. 17(*a*), 18, 19(*a*), and 19(*b*), the gap is formed by the protrusions 31*b* (second protruding sections) formed on the pipe 31. These protrusions 31*b* are formed by causing parts of the pipe 31 to bulge outward, and are provided at predetermined intervals. The protrusions 31*b* are formed on the lower side of the pipe 31. These protrusions 31*b* can be formed by pressuring the pipe 31 from the inside by inserting sticks into the holes 31*a*, or by compressing the pipe 31.

As shown in FIGS. 19(*a*) and 19(*b*), the protrusions 31*b* are formed directly below the corresponding holes 31*a* (i.e. the protrusions 31*b* are formed on the opposite side of the holes 31*a*). When the protrusions 31*b* contact the guide sheet 124, the gap is formed between the lower side of the pipe 31, where the protrusions 31*b* are not formed, and the guide sheet 124.

In this applying mechanism, the guide sheet 124 is in touch with the protrusions 31*b*. On this account, the end of the guide sheet 124 on the pipe 31 side is not necessarily fixed by the a connecting member.

Moreover, it is unnecessary to provide an additional member for forming the gap between the guide sheet 124 and the pipe 31.

In FIGS. 17(*b*), 20(*a*), and 20(*b*), the gap is formed by rings 35 formed around the pipe 31. In other words, each of the rings 35 is provided between the holes 31*a* and circumscribes the pipe 31. The rings 35 are in touch with the guide sheet 124. On this account, between the lower part of the pipe 31 where the rings 35 are not provided and the guide sheet 124, the aforesaid gap is formed.

In this applying mechanism, the guide sheet 124 is in touch with the rings 35, so that the end of the guide sheet 124 on the pipe 31 side is not necessarily fixed by a connecting member.

Moreover, the gap can be surely formed only by putting the rings 35 on the pipe 31. It is therefore unnecessary to process the pipe 31.

Note that each ring 35 is a ring that circumscribes the surface (outer surface) of the pipe 31, at a halfway point between the two holes 31*a* and 41 of the pipe 31.

These rings 35 do not obstruct the holes 31*a* (i.e. the rings 35 are not closely in contact with the holes 31*a*), so that the oil can be smoothly discharged from the holes 31*a*.

The material of the rings 35 can be chosen from PPS (polyphenylene sulfide), PET (polyethylene terephthalate), PAI (polyamide-imide), PEEK (polyetheretherketone), and the like. The thickness of the ring 35 is determined in consideration of the gap between the pipe 31 and the guide sheet 124.

The ring 35 can be provided between any neighboring two holes 31*a*, on condition that the hole 31*a* is not obstructed by the ring 35.

The rings 35 are not necessarily formed on all spaces between all of the neighboring holes 31*a*. As long as the oil discharged from the holes 31*a* are not obstructed (by the rings 35), the rings 35 can be arbitrarily provided.

The shape of the ring 35 is not particularly limited, as long as the gap is formed between the lower side (bottom side) of the pipe 31 where the rings 35 are not provided and the guide sheet 124.

Now, in FIGS. 17(*c*), 21(*a*), and 21(*b*), the gap is formed by extending the partition sections 124*b* of the guide sheet 124 so as to reach the pipe 31. That is to say, the partition sections 124*b* of the guide sheet 124 are in touch with the pipe 31. With this, the aforesaid gap is formed between the pipe 31 and the guide sheet 124 not being in touch with the pipe 31.

In this applying mechanism, the partition sections 124*b* are in touch with the pipe 31, so that the end of the guide sheet 124 on the pipe 31 side is not necessarily fixed by a connecting member.

Moreover, the gap can be surely formed by causing the pipe 31 to be in touch with the partition sections 124*b*, so that the gap is easily formed. It is therefore unnecessary to process the pipe 31.

Note that, as long as some of the partition sections 124*b* are in touch with the pipe 31 at predetermined intervals, it is unnecessary to cause all of the partition sections 124*b* to be in touch with the pipe 31.

Figure 22:
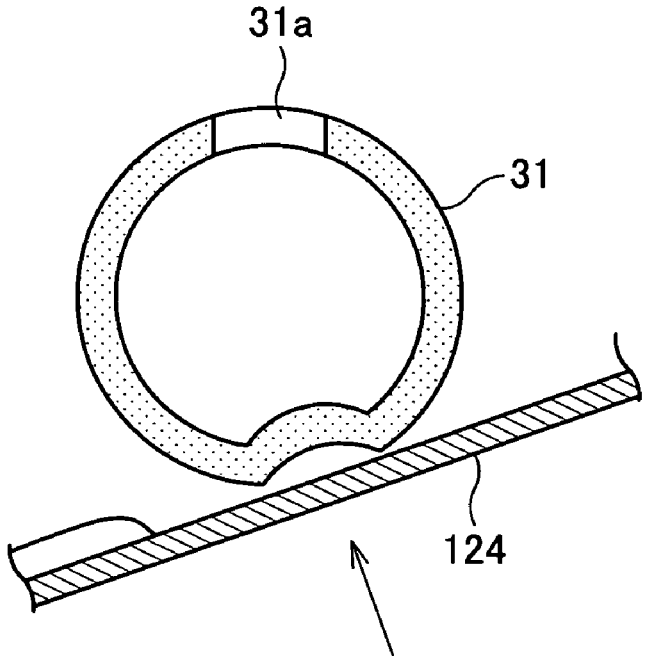
FIG. 22 is a cross section of a releasing agent guide of an oil applying mechanism of an embodiment of the present invention.
Figure 23:
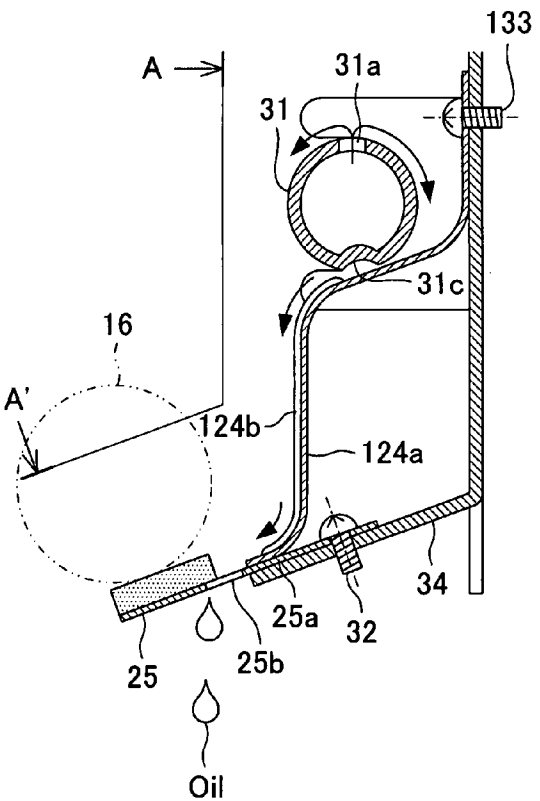
FIG. 23(*a*) is an expansion plan view of the releasing agent guide shown in FIG. 22.
Figure 23:
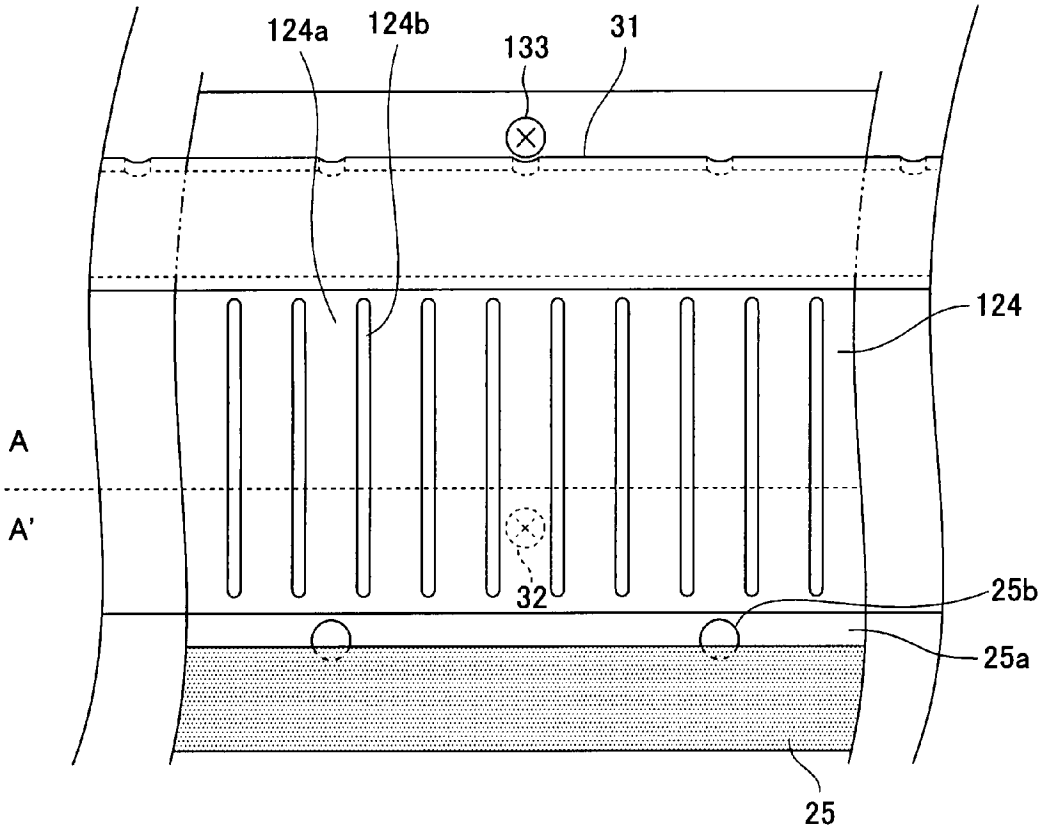
Figure 24:
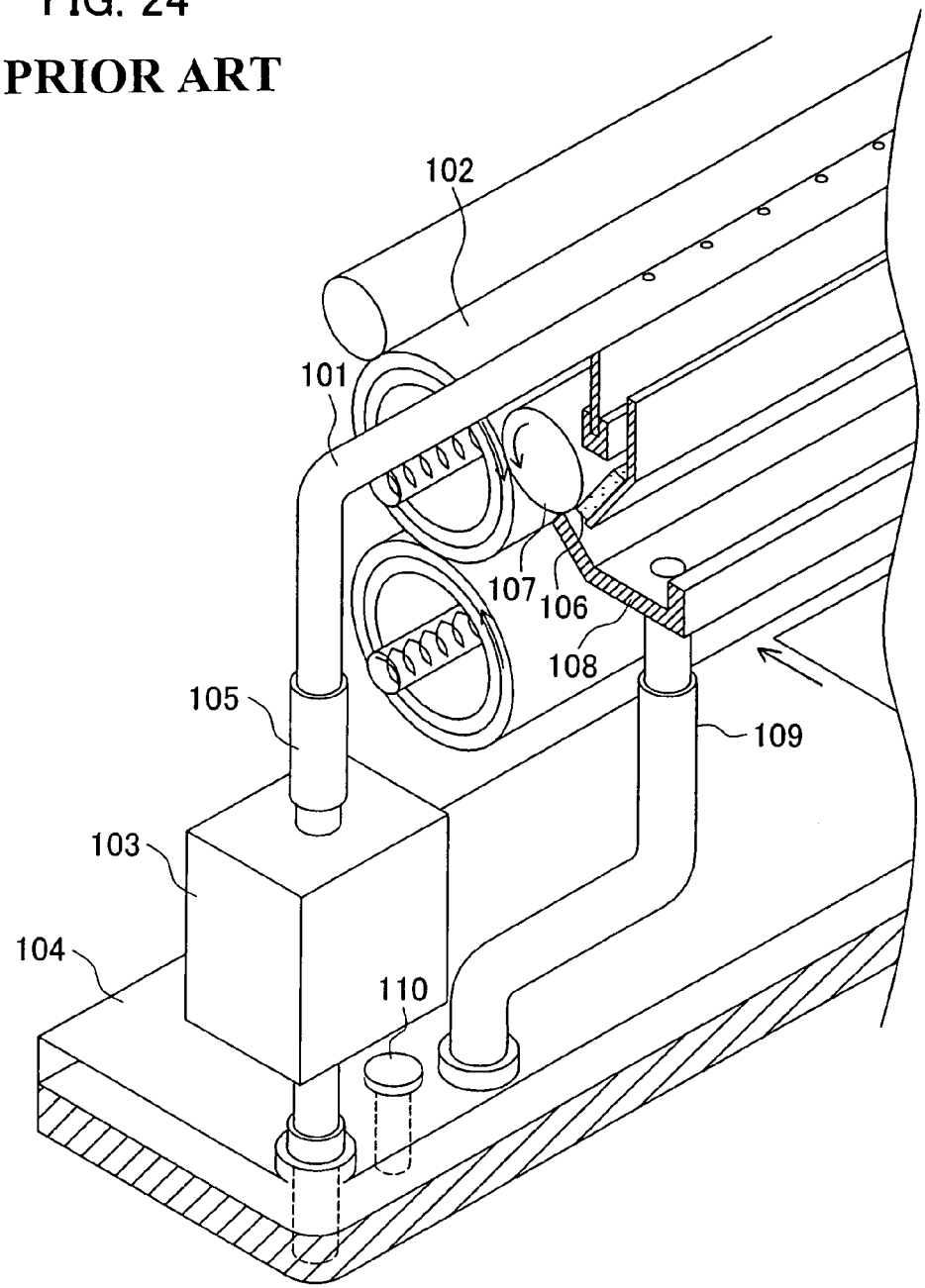
FIG. 24 PRIOR ART
FIG. 24 illustrates a conventional oil applying technique.
Figure 25:
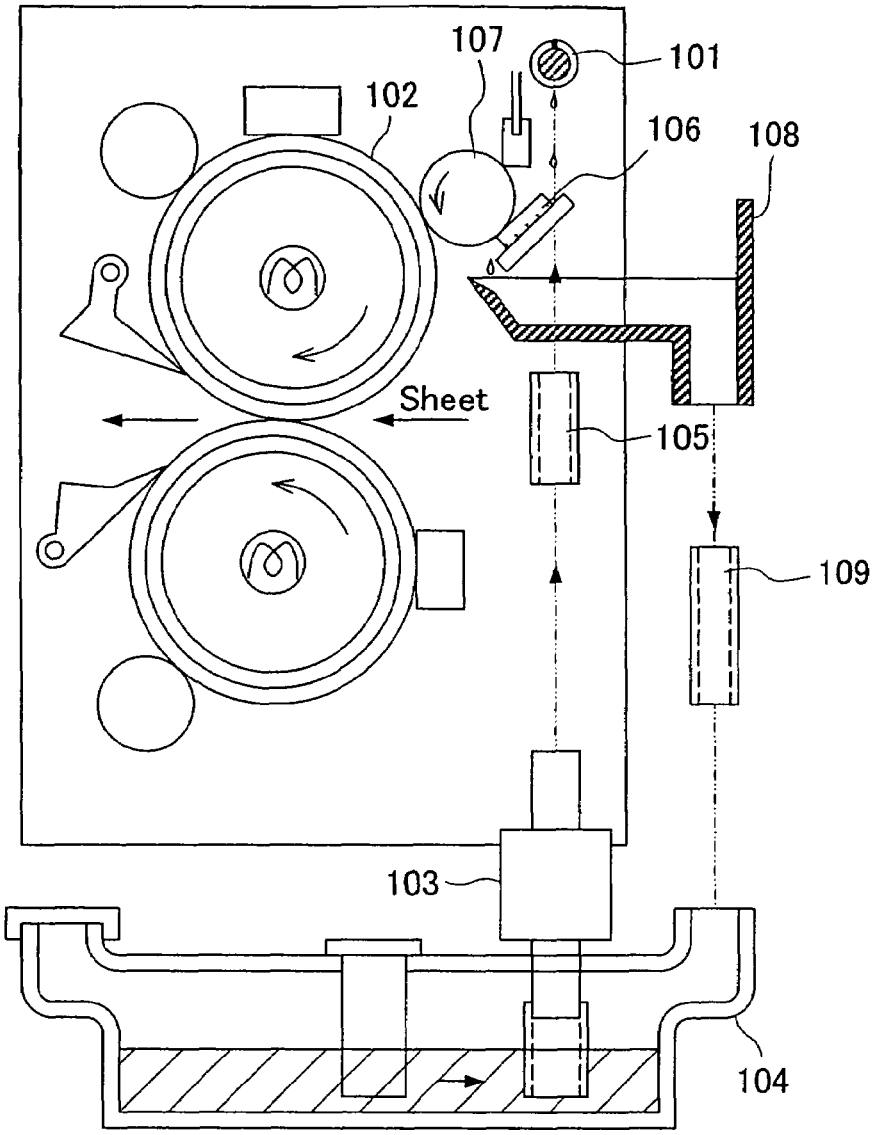
FIG. 25 PRIOR ART
FIG. 25 illustrates a conventional oil applying technique.

In FIGS. 22, 23(*a*), and 23(*b*), the gap is formed by a concave section (groove) 31*c* formed at the bottom part of the pipe 31 (i.e. the part opposing to the holes 31*a*) and extending along the longitudinal direction of the pipe 31. That is to say, the partition sections 124*b* of the guide sheet 124 are in touch with the pipe 31. On this account, the aforesaid gap is formed between the pipe 31 and the guide sheet 124 not being in touch with the pipe 31.

In this applying mechanism, the guide sheet 124 and the pipe 31 may be or may not be in touch with each other. If these members are in touch with each other, a part where the concave section (groove) 31*c* is not formed is caused to be in touch with the guide sheet 124. With this, the concave section 31*c* can be used as the gap. In this case, since the guide sheet 124 is in touch with the pipe 31, the end of the guide sheet 124 on the pipe 31 side (the end on the upstream side of the oil flow) does not have to be fixed by, for instance, a connecting member.

Moreover, the gap can be surely formed by causing the guide sheet 124 to be in touch with the pipe 31 (i.e. a part of the pipe 31 where the concave section 31 is not formed). This makes it easy to form the gap.

In the present embodiment, the side of the guide sheet 124 on the downstream of the oil is on the slant toward the application roller 16 (fixing roller 11), in the vicinity of the pipe 31. However, in the vicinity of the pipe 31, the pipe 31 and the guide sheet 124 may be in horizontal positions. This is because the oil is intermittently discharged from the pipe 31 and hence the oil can flow on the guide sheet 124 even if the pipe 31 and the guide sheet 124 are in the horizontal positions.

In the present embodiment, the releasing agent guide is made up of the guide sheet 124, the felt 25, and the felt supporter 25*a*. However, the releasing agent guide may be a single member.

For instance, the felt supporter 25*a* is not adopted and the releasing agent guide is integrally formed by the guide sheet 124 and the felt 25.

In the present embodiment, silicone oil is adopted as the releasing agent. However, not being limited to the silicone oil, any types of releasing agent may be used. As the releasing agent, an agent whose kinetic viscosity falls within the range between 100 cs and 300 cs can be used. The silicone oil as the releasing agent has, for instance, kinetic viscosity of 100 cs at 25° C. Silicon oil having kinetic viscosity less than 100 cs has a low flashing point, so that adopting this oil may cause flash at the fixing device. Meanwhile, silicon oil having kinetic viscosity more than 300 cs cannot be easily supplied using a piezo pump and a solenoid pump.

In the present embodiment, the oil application roller 16 rotates in accordance with the rotation of the fixing roller 11. However, the oil application roller 16 may be driven by a driving mechanism different from that of the fixing roller 11. The rotative direction of the oil application roller 16 may be identical with that of the fixing roller 11 or different from that of the fixing roller 11.

In the present embodiment, the present applying mechanism has the felt 25. It is, however, possible to adopt such an arrangement that the felt 25 is not provided, and the oil is supplied directly from the guide sheet 124 to the oil application roller 16 or supplied via the felt supporter 25*a*.

The felt 25 (oil supplying felt) may be a heat-resistant Nomex® felt. A heat-resistant Nomex® felt that is about 1 mm to 5 mm thick can be adopted as the felt 25. It is possible to say that this oil supplying felt 25 is pasted on the felt supporter (supporting member; made up of a stainless steel plate 0.2 mm thick) 25*a*, and is pressurized towards the oil application roller 16.

In the aforementioned embodiment, the guide sheet 124 may be made of a heat-resistant material. In this case, a thin guide sheet 124 that is about 0.025 mm-0.25 mm thick is adopted. Although depending on the material, a too thin guide sheet 124 is liable to breakage in the assembling process in a factory, and also the elasticity of such a thin guide sheet 124 is low.

The guide sheet 124 is preferably made of a material such as plastic and metal that can form a thin plate. Moreover, heat resistance (to a temperature about 200° C.) and oil resistance are necessary for the guide sheet 124. For this reason, a plate made of polyimide, polyethylene terephthalate, polyamide, etc., or a metal plate such as a stainless steel plate are suitable.

The guide sheet 124 must be made of a material that does not allow the oil spilling over from the pipe 31 (pipe-shaped member) to permeate the guide sheet 124. This is because the surface tension acting on the oil is generated in the narrow gap between the guide sheet 124 and the pipe 31 (i.e. the gap along the longitudinal direction of the pipe 31), so that the oil is caused to spread along the longitudinal direction of the pipe 31.

When the guide sheet 124 allows the oil to permeate the same, for instance when the guide sheet 124 is made of felt, the capillary phenomenon occurs almost exclusively inside of the guide sheet 124. Furthermore, the oil permeates the inside of the guide sheet 124. For these reasons, the surface tension barely acts on the oil. This causes such problems that the spreadability in the longitudinal direction of the guide sheet 124 deteriorates, the oil remains inside the felt 25 and hence the releasing agent is liable to degrade, and an amount of the releasing agent has to be uneconomically increased.

When the guide sheet 124 is made of a material with low rigidity (i.e. having elasticity), for instance, when the guide sheet 124 is made of a film or a metal thin plate, the guide sheet 124 is fixed to the supporter (base) 34 using a connecting member such as a screw, in such a manner as to pressurize the guide sheet 124 towards the pipe 31 by the elasticity of the guide sheet 124. In this case, the guide sheet 124 and the pipe 31 are not adhered to each other using an adhesive and the like. For this reason, the oil spilling over to the side opposite to the pipe 31 also seeps through the gap between the pipe 31 and the guide sheet 124. On account of the tilt of the guide sheet 124, the seeped oil is guided towards the fixing roller 11 that is the supply target, via the oil application roller 16.

The width of the narrow gap between the guide sheet 124 and the pipe 31 preferably falls within the range about between 0.5 mm and 1 mm. With this width, the oil can spread along the longitudinal direction of the pipe 31 on account of the capillary phenomenon, without causing the clogging of paper powder, dust and the like.

Note that the gap is formed between the pipe 31 and the guide sheet 124, extends along the longitudinal direction of the pipe 31, and has the width that allows the surface tension to act on the oil. Incidentally, with "the width that allows the surface tension to act on the oil", the oil discharged from the pipe 31 can be carried to the guide sheet 124 while being in touch with the guide sheet 124 and the pipe 31, and also the oil at the gap can spread along the longitudinal direction of the pipe 31.

The width of the gap is suitably set in accordance with the type of the oil, the viscosity of the oil, the material of the guide sheet 124, the amount (speed) of the oil supplied from the pipe 31 to the gap, the diameter of the pipe 31, and the like.

The protrusions (second protruding sections) 31*b* on the pipe 31 are formed by causing parts of the outer surface of the pipe 31 to protrude using the holes 31*a*, by grabbing the pipe 31 and compressing the same so as to cause parts of the outer surface to protrude, or by attaching the rings 35 on the outer surface of the pipe 31. Alternatively, the gap between the guide sheet 124 and the guide sections 124*a* may be formed by denting the bottom surface (lower side) of the pipe 31 and forming a gap (concave section) that concaves from the bottom surface of the pipe 31 towards the inside of the pipe 31.

To form a gap between the guide sections 124*a* of the guide sheet 124 and the pipe 31, it is possible to adopt such a method that the partition sections (first protruding sections) 124*b* on the guide sheet 124 are partially elongated and caused to be in touch with the pipe 31, and consequently the gap is formed.

When the guide sheet 124 is made up of, for instance, a stainless steel plate having high rigidity, the pipe 31 can be fixed to the supporting member in such a manner as to form a narrow gap therebetween, without processing the pipe 31.

The guide sheet 124 may be made up of a thin steel plate or plastic (film or thin molded article). In this case, when the gap is formed by causing the pipe 31 to contact the guide sheet 124, it is possible to cause the guide sheet 124 to certainly contact the pipe 31 by utilizing the elasticity of the guide sheet 124. In doing so, for instance, the guide sheet 124 is fixed to the supporter 34 by using a connecting member such as a screw, in such a manner as to cause the guide sheet 124 to be pressurized towards the pipe 31.

Since the guide sheet 124 is not adhered to the pipe 31 using, for instance, an adhesive, the assembly is easily carried out. Moreover, it is possible to prevent the unsteadiness of the contact between the guide sheet 124 and the pipe 31 on account of the unevenness of the amount of the adhesive. For this reason, partial deterioration of the spreadability of the oil (i.e. whether or not the oil is evenly supplied) at the gap on account of the unevenness of the adhesive can be avoided. Also, the guide sheet 124 is not peeled off on the occasion of using the present applying mechanism. Furthermore, the guide sheet 124 can be easily replaced without moving other members.

The partition sections 124*b* of the guide sheet 124 can be formed by pressing if the guide sheet 124 is made of metal, while the partition sections 124*b* can be formed by molding if the guide sheet 124 is made of plastic. The height of each partition section 124*b* preferably falls within the range of 0.5 mm and 1 mm.

As described above, the pump 22 of the present applying mechanism is, for instance, either a piezo pump or an electromagnetic pump.

A piezo pump operates in accordance with a frequency of an AC power supply, and is more expensive than an electromagnetic pump that is driven by a D.C power supply (the price of the piezo pump is about twice as much as that of the electromagnetic pump). For this reason, the low-priced electromagnetic pump may be suitable in some cases.

As the pump 22 of the present applying mechanism, it is possible to adopt an electromagnetic pump that can be driven by a DC pulse current (having a cycle of 30 ms-300 ms and a pulse width of 3 ms-50 ms).

The flow of such an electromagnetic pump can be set within the range between 1 cc/min and 10 cc/min, by adjusting the pulse width and the cycle of the supplied pulse current.

Since a permeable guide member (allowing the releasing agent to permeate the same) has conventionally been adopted, the flow of the electronic pump was 4-5 cc/min. This is because the releasing agent was supplied on the both surfaces of the guide member.

On the contrary, since a guide member that does not allow the releasing agent to permeate the same is adopted in the present invention, the flow of the electronic pump can be decreased to 2-3 cc/min. This is because the releasing agent is supplied only on the front surface (one surface) of the guide member.

The releasing agent applying method of the present invention can be rephrased as follows: a releasing agent applying method by which a releasing agent is applied to a fixing roller of a printing apparatus, comprises the steps of: discharging the releasing agent from holes formed on a pipe along the fixing roller; and supplying, using a releasing agent guide, the releasing agent discharged from the pipe to a releasing agent application roller that rotates while being in touch with the fixing roller, the releasing agent guide having a bulged portion in the vicinity of the pipe, where the releasing agent guide bulges along the pipe and towards the releasing agent application roller, the releasing agent discharged from the holes of the pipe being supplied to the releasing agent application roller, via the bulged portion.

The rings 35 shown in FIG. 17(*b*) and the like circumscribe the outer surface of the pipe 31, in the direction orthogonal to the axis (longitudinal direction) of the pipe 31. Note that, instead of providing these rings 35, the protruding sections may be formed by directly processing the pipe 31. That is to say, the present embodiment adopts the rings 35 that are not parts of the pipe 31. However, even if the rings 35 are not used, the aforesaid form is obtained and the aforesaid effects are achieved by processing the pipe 31.

The objective of the present invention can be rephrased as follows: the objective of the present invention is to provide (i) a fixing device that includes a releasing agent supplying apparatus arranged in such a manner that a guide member is provided between a releasing agent applying member that is in touch with an application target member so as to supply a releasing agent and a pipe-shaped member, and after spreading the releasing agent by the guide member and the pipe-shaped member, the guide member guides the releasing agent so that the releasing agent is evenly applied to the fixing roller that is the application target member and the pressure roller, the releasing agent supplying apparatus being able to evenly supply the releasing agent to the application target member without causing the releasing agent to permeate the guide member, on account of the use of the guide member that does not allow the releasing agent to permeate the same, and (ii) an image forming apparatus including the fixing device.

The method of supplying the silicone oil to the application roller, by which the silicone oil is applied to the fixing roller 11 in the fixing device shown in FIG. 14, may be rephrased as below. That is, oil is in an oil tank 21 under a fixing device (either inside or outside the fixing device), to which the oil can be supplied from the outside. From this oil tank 21, the oil is evenly supplied along the longitudinal direction of a fixing roller 11 and through a tube-shaped member 23, using a piezo or electronic pump 22 provided above the oil tank 21. In doing so, a pipe 31 having a plurality of holes is used and the oil spilling over from these holes trickles down on the surface of the pipe 31, so that the oil spreads on account of the capillary phenomenon at a narrow gap between the pipe 31 and guide sections (guide sections 124*a*) of the guide member (guide sheet 124) below the pipe 31. This guide member is slightly on the slant, so that the oil further comes down and hence the oil is evenly supplied to an oil supplying felt (felt 25) that is pressurized toward and closely in contact with an oil application roller 16. By the way, the lowest stream of the pipe 31 is caulked (stamped by, for instance, a pressing machine) in order to prevent the oil leakage, so that the oil is not discharged other than from the holes.

The oil supplied to the oil supplying felt 25 permeates the oil supplying felt 25, and is then supplied to the oil application roller 16 via the oil supplying felt 25. The oil supplied to the application roller 16 is evenly spread by an applying blade (blade 29) made up of a rubber member, in order to evenly supply a stable amount of the oil to the surface of the fixing roller 11. The redundant oil not used for the oil application by the supply means is collected by an oil pan 26 that is a concave member below the application roller 16 and the felt (oil supplying felt) 25, via the discharging holes 25*b* and the like. Then the collected oil returns the oil bottle (resin layer 21) via a tube-shaped member 27 connected to the oil pan 26. Thanks to this system, the oil circulates in the oil supplying apparatus and the applying apparatus (applying mechanism), and when the amount of the circulated oil in the oil bottle is likely to be short supply, this situation is detected by a sensor 28 that measures the remaining amount of the oil and is provided in the oil tank 21, and a display panel and the like on the image forming apparatus prompts the user to supply the oil or the printing by the machine is temporarily brought to a halt. In this case, a normal operation may be resumed when the oil is supplied.

The present invention described in the present embodiment can be rephrased as the below-mentioned first to seventh releasing agent supplying apparatuses, a first fixing device, and a first image forming apparatus. The first releasing agent supplying apparatus supplies a releasing agent to a fixing device that has a fixing section made up of a rotatable fixing roller and a pressure roller pressurized to and closely contacting the fixing roller, and in this releasing agent supplying apparatus, the releasing agent is supplied by a releasing agent supply pump spills over from holes that are aligned along the axis of a pipe-shaped member and are made on the top side of the pipe-shaped member, and the releasing agent is then supplied to at least one of the fixing roller and the pressure roller, via intermediate guide means, and in this releasing agent supplying apparatus, the guide member and the pipe-shaped member are placed in such a manner as to spread the releasing agent by the guide member forming the intermediate guide means and the pipe-shaped member, so that the releasing agent is supplied with the spreading state being maintained. According to this arrangement, when the releasing agent is supplied to the supply target via the guide member, the releasing agent is spread at the top of the upstream side by the capillary phenomenon generated between the pipe-shaped member and the guide member, and the releasing agent is guided with the spread state being maintained, in order to further improve the capability of widely spreading the releasing agent by the guide member and guiding the releasing agent with the spread state being maintained. On this account, the releasing agent is evenly supplied to the supply target by the guide member, so that the condition of the fixation is suitably maintained.

The second releasing agent supplying apparatus is arranged in such a manner that, in the first releasing agent supplying apparatus, the guide member has guide sections and partition sections, the partition sections are provided on the guide sections side of the releasing agent, and the guide member is provided with respect to the pipe-shaped member in such a manner as to form a narrow gap between the guide sections and the pipe-shaped member. According to this arrangement, the narrow gap is formed between the pipe-shaped member and the guide sections of the guide member, so that the capillary phenomenon is generated between the pipe-shaped member and the guide sections of the guide member. On this account, the releasing agent can be spread at the guide sections, and by the partition sections provided on the guide sections side, the releasing agent having been spread can be guided with the spread state being maintained.

The third releasing agent supplying apparatus is arranged in such a manner that, in the second releasing agent supplying apparatus, the gap between the pipe-shaped member and the guide sections of the guide member is formed by causing the partition sections of the guide member to be in touch with the pipe-shaped member. According to this arrangement, the partition sections of the guide member are in touch with the pipe-shaped member, so that the gap having a predetermined width is formed and the capillary phenomenon is suitably generated. For this reason, the releasing agent can spread on the guide sections of the guide member. The fourth releasing agent supplying apparatus is arranged in such a manner that, in the second releasing agent supplying apparatus, the gap between the tube-shaped member and the guide sections of the guide member is formed by causing protrusions formed on the surface of the pipe-shaped member to be in touch with the guide sections of the guide member. According to this arrangement, the guide sections of the guide member are in touch with the protrusions of the pipe-shaped member, so that the gap having a predetermined width is formed and the capillary phenomenon is suitably generated, and consequently the releasing agent can spread at the guide sections of the guide member.

The fifth releasing agent supplying apparatus is arranged in such a manner that, in the third or fourth releasing agent supplying apparatus, the contact between the guide member and the pipe-shaped member is achieved by the elasticity of the guide member. According to this arrangement, the predetermined gap is suitably formed between the guide sections of the guide member and the pipe-shaped member, by utilizing the elasticity of the guide member. The sixth releasing agent supplying apparatus is arranged in such a manner that, in one of the first to fifth releasing agent supplying apparatuses, the guide member below the pipe-shaped member is on the slant with respect to the pipe-shaped member. According to this arrangement, the guide member is provided below the pipe-shaped member and is on the slant with respect to the pipe-shaped member, so that all of the releasing agent spilling over from the holes on the upper side of pipe-shaped member is caught by the guide member and the releasing agent spreads on account of the capillary phenomenon, and consequently the releasing agent can be guided to the supply target.

The seventh releasing agent supplying apparatus is arranged in such a manner that, in one of the first to sixth releasing agent supplying apparatuses, the guide member is made of a material not allowing the releasing agent to permeate the same, and the releasing agent is guided and supplied to the supply target by causing the releasing agent to flow on the surface of the guide member. According to this arrangement, since the guide member is made of a material not allowing the releasing agent to permeate the same, the capillary phenomenon is suitably generated between the guide member and the pipe-shaped member, and the releasing agent is suitably spread. Furthermore, since the releasing agent does not permeate inside of the guide member, an amount of the releasing agent to be supplied can be reduced. Also, the working efficiency improves at the time of, for instance, replacing the guide member, and an amount of the releasing agent lost at the time of the replacement can be reduced. The first fixing device includes a fixing section made up of a rotative fixing roller and a pressure roller pressurized to and closely contacting the fixing roller, and from a pipe-shaped member that is provided above the fixing roller and has a plurality of holes on the upper side in the axis direction, the releasing agent supplied by a releasing agent supplying pump spills over from the holes, and is supplied to either the fixing roller or the pressure roller via the intermediate guide means, and the first fixing device has one of the aforesaid first to seventh releasing agent supplying apparatuses. According to this arrangement, the aforesaid effects can be achieved by the fixing device. The first image forming apparatus includes the first fixing device. According to this arrangement, the image forming device includes the aforesaid fixing device so that the aforesaid effects are achieved and image formation is suitably performed.

As described above, in the present embodiment, the aforesaid releasing agent guide is preferably provided with first protruding sections protruding along the paths of the releasing agent on the releasing agent guide.

In other words, the first protruding sections are partitions formed on the releasing agent guide.

According to this arrangement, the releasing agent flows on the parts (between the first protruding sections) partitioned by the first protruding sections. The releasing agent flowing on the releasing agent guide does not climbs over the first protruding sections. On this account, it is possible to avoid the releasing agent from being mixed on the releasing agent guide. It is therefore possible to cause the releasing agent to evenly reach the releasing agent application roller, with the state of spread of the releasing agent along the longitudinal direction of the pipe being maintained.

In the arrangement above, the first protruding sections are preferably in touch with the pipe.

According to this arrangement, the aforesaid gap is formed between the first protruding sections being in touch with the pipe. Thus, since the first protruding sections are in touch with the pipe, the releasing agent can be supported by the points of contact. On this account, the gap whose width is substantially identical with the heights of the first protruding sections is certainly formed between the releasing agent guide and the pipe, and this makes it easy to form the gap.

The pipe is preferably arranged in such a manner that second protruding sections jut from the surface of the pipe and these second protruding sections are in touch with the releasing agent guide.

This arrangement can be realized by forming the second protruding sections by rings put on the pipe.

According to this arrangement, the aforesaid gap is formed between the second protruding sections being in touch with the releasing agent guide. Since the second protruding sections are in touch with the releasing agent guide, the releasing agent guide can be supported at the points of contact. On this account, the gap whose width is substantially identical with the heights of the second protruding sections is certainly formed between the releasing agent guide and the pipe, and this makes it easy to form the gap.

The releasing agent guide is preferably in touch with the pipe on account of the elasticity of the releasing agent guide. According to this arrangement, it is unnecessary to attach the releasing agent guide to the pipe using an adhesive and the like. On this account, the present applying mechanism can be easily assembled. Furthermore, it is possible to avoid the partial decrease of the spreadability (evenness) of the releasing agent because of the irregularity of the adhered parts (i.e. some parts are adhered while other are not). (The spreadability decreases if there is a part that is not properly adhered).

Furthermore, the releasing agent guide and the pipe are not peeled off from each other on account of the decrease of the adhesive property, during the use of the present applying mechanism, and the releasing agent guide can be replaced with ease.

Moreover, at the part on the releasing agent guide where the gap is formed, the releasing agent is preferably on the slant with respect to the pipe. For instance, the releasing agent guide is preferably on the slant with respect to the pipe, with the side close to the application roller falling downward.

This state of "on the slant" is of course neither a horizontal state nor a perpendicular (vertical) state.

According to this arrangement, the releasing agent guide inclines from the side close to the releasing agent application roller to the side far from the releasing agent application roller, with respect to the gap formed with the pipe.

This allows the oil, which is caught on the side of the releasing agent guide close to the releasing agent application roller, to flow to the releasing agent application roller. Also, it is possible to prevent the oil, which is caught on the side far from the releasing agent application roller, from flowing in the direction away from the releasing agent application roller on the releasing agent guide.

It is also preferable that one end of the releasing agent guide on the side close to the pipe be designed so as to step over the vertical line passing through the center of the pipe. This vertical line passing through the center of the pipe is a virtual straight line vertically going down from the center of the pipe. With the arrangement above, the oil discharged from the both sides of the pipe can be certainly guided to the releasing agent guide.

By the way, "close to (far from) the applying member" indicates the length from the pipe to the applying member, measured along the releasing agent guide, so that this length is nothing to do with the actual length.

As described above, the present invention can be suitably adopted to a releasing agent applying mechanism for applying a releasing agent to a fixing roller of a printing apparatus, a fixing device, and a printing apparatus.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A releasing agent applying mechanism for applying a releasing agent to a fixing roller of a printing apparatus, the releasing agent being discharged from a plurality of holes made on a pipe extending along the fixing roller, and a releasing agent application roller that is in contact with the fixing roller so as to rotate, the releasing agent discharged from the pipe being supplied via a releasing agent guide, the releasing agent applying mechanism comprising an applying member that applies the releasing agent to the releasing agent application roller from below, the pipe being provided above the releasing agent application roller, the releasing agent guide being designed so as to supply, to the applying member, the releasing agent discharged from the pipe, and a part of the releasing agent guide bulging away from the releasing agent application roller, with respect to a vertical line passing through a center of the pipe.

2. The releasing agent applying mechanism as defined in claim 1, wherein, a bottom portion of the releasing agent guide is fixed to the applying member, and from a point where the bottom portion is fixed to the applying member, the releasing agent guide extends away from the releasing agent application roller, with respect to the vertical line, and is then folded back and crosses over the vertical line, and consequently touches a lower part of the pipe.

3. The releasing agent applying mechanism as defined in claim 2, wherein, the releasing agent guide has slits extending from the bottom portion and toward a contact point between the releasing agent guide and the pipe.

4. The releasing agent applying mechanism as defined in claim 3, wherein, on the releasing agent guide, the slits extend beyond the contact point.

5. The releasing agent applying mechanism as defined in claim 2, wherein, the releasing agent guide is in contact with the pipe so as to be on a slant with respect to the pipe.

6. The releasing agent applying mechanism as defined in claim 3, wherein, the slits are larger in number than the holes made on the pipe.

7. The releasing agent applying mechanism as defined in claim 2, wherein, the releasing agent guide is in contact with the pipe so as to be on a slant with respect to the pipe, with a side of the releasing agent guide closest to the applying member sloped downward.

8. The releasing agent applying mechanism as defined in claim 1, wherein, the releasing agent guide is made of a material that is resistant to the releasing agent.

9. A releasing agent applying mechanism for applying a releasing agent to a fixing roller of a printing apparatus, the releasing agent being discharged from a plurality of holes made on a pipe extending along the fixing roller, and a releasing agent application roller that is in contact with the fixing roller so as to rotate, the releasing agent discharged from the pipe being carried via a releasing agent guide, part of the releasing agent guide is located substantially near the pipe such that the releasing agent spreads between the releasing agent guide and the pipe due to surface tension, and part of the releasing agent guide is in contact with the pipe, the releasing agent guide having a releasing agent storage that extends along a longitudinal direction of the pipe and is provided on releasing agent supplying paths on the releasing agent guide.

10. The releasing agent applying mechanism as defined in claim 9, wherein, the releasing agent storage is a groove extending along the longitudinal direction of the pipe.

11. A releasing agent applying mechanism for applying a releasing agent to a fixing roller of a printing apparatus, the releasing agent being discharged from a plurality of holes made on a pipe extending along the fixing roller, and a releasing agent application roller that is in contact with the fixing roller so as to rotate, the releasing agent discharged from the pipe being carried via a releasing agent guide having a plurality of releasing agent supplying paths, the releasing agent guide having a releasing agent storage that extends along a longitudinal direction of the pipe and is provided on the releasing agent supplying paths of the releasing agent guide, wherein, the releasing agent guide has a protruding section that extends along the longitudinal direction of the pipe and is provided on the releasing agent supplying paths.

12. The releasing agent applying mechanism as defined in claim 11, wherein, the releasing agent guide has an applying member for applying the releasing agent to the releasing agent application roller, the applying member is placed on a supporting member, the supporting member has a part where the supporting member is superposed on the releasing agent guide, and the supporting member at the part functions as the protruding section.

13. The releasing agent applying mechanism as defined in claim 11, wherein, in a longitudinal direction, the protruding section is wider than total widths of the releasing agent supplying paths except the protruding section on the releasing agent guide.

14. The releasing agent applying mechanism as defined in claim 13, wherein, the supporting member is fixed to the releasing agent guide, and in a longitudinal direction, the releasing agent guide is wider than the supporting member.

15. The releasing agent applying mechanism as defined in claim 13, wherein, both ends of the releasing agent guide have respective bump sections protruding over the supporting member and towards an upstream side of the releasing agent supplying paths.

16. The releasing agent applying mechanism as defined in claim 12, wherein, the supporting member is made of metal having elasticity.

17. The releasing agent applying mechanism as defined in claim 11, wherein, the protruding section is not less than 0.025 mm high and not more than 0.5 mm high.

18. The releasing agent applying mechanism as defined in claim 11, wherein, the protruding section is formed at ends of the releasing agent supplying paths on the releasing agent guide.

19. A releasing agent applying mechanism for applying a releasing agent to a fixing roller of a printing apparatus, the releasing agent being discharged from a plurality of holes made on a pipe extending along the fixing roller, and a releasing agent application roller that is in contact with the fixing roller so as to rotate, the releasing agent discharged from the pipe being carried via a releasing agent guide having a plurality of releasing agent supplying paths, the releasing agent guide having a releasing agent storage that extends along a longitudinal direction of the pipe and is provided on the releasing agent supplying paths of the releasing agent guide, wherein, the releasing agent guide has slits extending from the releasing agent storage and towards a contact point between the releasing agent guide and the pipe.

20. The releasing agent applying mechanism as defined in claim 19, wherein, the slits extend beyond the contact point between the releasing agent guide and the pipe.

21. A releasing agent applying mechanism for applying a releasing agent to a fixing roller of a printing apparatus, the releasing agent being discharged from a plurality of holes made on a pipe extending along the fixing roller, and a releasing agent application roller that is in contact with the fixing roller so as to rotate, the releasing agent discharged from the pipe being supplied via a releasing agent guide, part of the releasing agent guide is located substantially near the pipe such that the releasing agent spreads between the releasing agent guide and the pipe due to surface tension, and part of the releasing agent guide is in contact with the pipe, the releasing agent guide being made of a material resistant to the releasing agent, and a gap between the releasing agent guide and the pipe that extends along a longitudinal direction of the pipe produces said surface tension which causes the releasing agent to spread between the releasing agent guide and the pipe.

22. The releasing agent applying mechanism as defined in claim 21, wherein, the releasing agent guide is on a slant with respect to the pipe, at a part on the releasing agent guide where the gap is formed.

23. A releasing agent applying mechanism for applying a releasing agent to a fixing roller of a printing apparatus, the releasing agent being discharged from a plurality of holes made on a pipe extending along the fixing roller, and a releasing agent application roller that is in contact with the fixing roller so as to rotate, the releasing agent discharged from the pipe being supplied via a releasing agent guide having a plurality of releasing agent supplying paths, the releasing agent guide being made of a material resistant to the releasing agent, and between the releasing agent guide and the pipe, a gap that extends along a longitudinal direction of the pipe and allows surface tension to act on the releasing agent being formed, wherein, the releasing agent guide has first protruding sections jutting along paths of the releasing agent of the releasing agent guide.

24. The releasing agent applying mechanism as defined in claim 23, wherein, the first protruding sections are in touch with the pipe.

25. The releasing agent applying mechanism as defined in claim 24, wherein, the pipe has second protruding sections jutting from a surface of the pipe, and the second protruding sections are in touch with the releasing agent guide.

26. The releasing agent applying mechanism as defined in claim 25, wherein, the second protruding sections are rings put on the pipe.

27. The releasing agent applying mechanism as defined in claim 24, wherein, the releasing agent guide is in touch with the pipe, on account of elasticity of the releasing agent guide.

28. A releasing agent applying mechanism for applying a releasing agent to a fixing roller of a printing apparatus, the releasing agent being discharged from a plurality of holes made on a pipe extending along the fixing roller, and a releasing agent application roller that is in contact with the fixing roller so as to rotate, the releasing agent discharged from the pipe being supplied via a releasing agent guide, the releasing agent guide being made of a material resistant to the releasing agent, and between the releasing agent guide and the pipe, a gap that extends along a longitudinal direction of the pipe such that the releasing agent spreads between the releasing agent guide and the pipe due to surface tension, wherein, an end of the releasing agent guide is provided so as to step over a vertical line passing through a center of the pipe.

29. A fixing device including a releasing agent applying mechanism for applying a releasing agent to a fixing roller of a printing apparatus, in this releasing agent applying mechanism, the releasing agent being discharged from a plurality of holes made on a pipe extending along the fixing roller, and a releasing agent application roller that is in contact with the fixing roller so as to rotate, the releasing agent discharged from the pipe being supplied via a releasing agent guide, the releasing agent applying mechanism comprising an applying member that applies the releasing agent to the releasing agent application roller from below, the pipe being provided above the releasing agent application roller, the releasing agent guide being designed so as to supply, to the applying member, the releasing agent discharged from the pipe, and a part of the releasing agent guide bulging away from the releasing agent application roller, with respect to a vertical line passing through a center of the pipe.

30. A fixing device including a releasing agent applying mechanism for applying a releasing agent to a fixing roller of a printing apparatus, in this releasing agent applying mechanism, the releasing agent being discharged from a plurality of holes made on a pipe extending along the fixing roller, and a releasing agent application roller that is in contact with the fixing roller so as to rotate, the releasing agent discharged from the pipe being carried via a releasing agent guide having a plurality of releasing agent supplying paths, part of the releasing agent guide is located substantially near the pipe such that the releasing agent spreads between the releasing agent guide and the pipe due to surface tension, the releasing agent guide having a releasing agent storage that extends along a longitudinal direction of the pipe and is provided on the releasing agent supplying paths of the releasing agent guide.

31. A fixing device including a releasing agent applying mechanism for applying a releasing agent to a fixing roller of a printing apparatus, in this releasing agent applying mechanism, the releasing agent being discharged from a plurality of holes made on a pipe extending along the fixing roller, and a releasing agent application roller that is in contact with the fixing roller so as to rotate, the releasing agent discharged from the pipe being supplied via a releasing agent guide, part of the releasing agent guide is located substantially near the pipe such that the releasing agent spreads between the releasing agent guide and the pipe due to surface tension, the releasing agent guide being made of a material resistant to the releasing agent, and a gap between the releasing agent guide and the pipe that extends along a longitudinal direction of the pipe produces said surface tension which causes the releasing agent to spread between the releasing agent guide and the pipe.

32. A printing apparatus including a fixing device provided with a releasing agent applying mechanism, in this releasing agent applying mechanism for applying a releasing agent to a fixing roller of the printing apparatus, the releasing agent being discharged from a plurality of holes made on a pipe extending along the fixing roller, and a releasing agent application roller that is in contact with the fixing roller so as to rotate, the releasing agent discharged from the pipe being supplied via a releasing agent guide, the releasing agent applying mechanism comprising an applying member that applies the releasing agent to the releasing agent application roller from below, the pipe being provided above the releasing agent application roller, the releasing agent guide being designed so as to supply, to the applying member, the releasing agent discharged from the pipe, and a part of the releasing agent guide bulging away from the releasing agent application roller, with respect to a vertical line passing through a center of the pipe.

33. A printing apparatus including a fixing device provided with a releasing agent applying mechanism, in this releasing agent applying mechanism for applying a releasing agent to a fixing roller of the printing apparatus, the releasing agent being discharged from a plurality of holes made on a pipe extending along the fixing roller, and a releasing agent application roller that is in contact with the fixing roller so as to rotate, the releasing agent discharged from the pipe being carried via a releasing agent guide having a plurality of releasing agent supplying paths, part of the releasing agent guide is located substantially near the pipe such that the releasing agent spreads between the releasing agent guide and the pipe due to surface tension, the releasing agent guide having a releasing agent storage that extends along a longitudinal direction of the pipe and is provided on the releasing agent supplying paths of the releasing agent guide.

34. A printing apparatus including a fixing device provided with a releasing agent applying mechanism, in this releasing agent applying mechanism for applying a releasing agent to a fixing roller of the printing apparatus, the releasing agent being discharged from a plurality of holes made on a pipe extending along the fixing roller, and a releasing agent application roller that is in contact with the fixing roller so as to rotate, the releasing agent discharged from the pipe being supplied via a releasing agent guide, part of the releasing agent guide is located substantially near the pipe such that the releasing agent spreads between the releasing agent guide and the pipe due to surface tension, the releasing agent guide being made of a material resistant to the releasing agent, and a gap between the releasing agent guide and the pipe that extends along a longitudinal direction of the pipe produces said surface tension which causes the releasing agent to spread between the releasing agent guide and the pipe.

* * * * *